US011596242B1

(12) United States Patent
Flannery et al.

(10) Patent No.: US 11,596,242 B1
(45) Date of Patent: Mar. 7, 2023

(54) PLAYYARD

(71) Applicant: Regalo International, LLC, Longboat Key, FL (US)

(72) Inventors: Mark A. Flannery, Longboat Key, FL (US); Brian M. McMahon, Palatine, IL (US); Caleb Summers, Minneapolis, MN (US)

(73) Assignee: Regalo International, LLC, Longboat Key, FL (US)

( * ) Notice: Subject to any disclaimer, the term of this patent is extended or adjusted under 35 U.S.C. 154(b) by 95 days.

(21) Appl. No.: 17/335,036

(22) Filed: May 31, 2021

Related U.S. Application Data

(63) Continuation of application No. 16/894,798, filed on Jun. 6, 2020, now Pat. No. 11,026,522, which is a continuation of application No. 16/600,558, filed on Oct. 13, 2019, now Pat. No. 10,674,835, which is a continuation of application No. 15/080,502, filed on Mar. 24, 2016, now Pat. No. 10,448,752, which is a continuation-in-part of application No. 15/069,717, filed on Mar. 14, 2016, now Pat. No. 10,194,755.

(60) Provisional application No. 62/189,177, filed on Jul. 6, 2015, provisional application No. 62/145,501, filed on Apr. 9, 2015.

(51) Int. Cl.
*A47D 13/06* (2006.01)

(52) U.S. Cl.
CPC ..... *A47D 13/063* (2013.01)

(58) Field of Classification Search
CPC ..... A47D 13/06; A47D 13/063
See application file for complete search history.

(56) References Cited

U.S. PATENT DOCUMENTS

| | | | |
|---|---|---|---|
| 927,738 | A | 7/1909 | Malaby |
| 1,374,333 | A | 4/1921 | Stotler |
| 1,413,068 | A | 4/1922 | Stotler |
| 1,950,603 | A | 3/1934 | Fischer |
| 2,308,608 | A | 1/1943 | Kennedy |
| 2,490,296 | A | 12/1949 | Fournier |
| 2,570,446 | A | 10/1951 | Hodman |
| 2,574,610 | A | 11/1951 | Aarestad |
| 2,698,443 | A | 1/1955 | Ralick |
| D177,208 | S | 3/1956 | Berlin |
| 2,974,325 | A | 3/1961 | Mango |
| 3,206,772 | A | 9/1965 | Sarasin |
| 3,430,273 | A | 3/1969 | Stillwaugh |
| 3,777,321 | A | 12/1973 | Hargett |

(Continued)

OTHER PUBLICATIONS

DealsDirect, Foldable Pet Playpen with Carry Bag, DealsDirect.com.au, three pages, Grays eCommerce Group, Ingelburn, Australia.

(Continued)

*Primary Examiner* — Eric J Kurilla

(57) ABSTRACT

The present playyard includes an endless frame, an endless sidewall within the frame, and a floor within the sidewall. The sidewall and floor form the shape of a receptacle having an open top and a closed bottom defined by the floor. Each of the frame, sidewall and floor takes the shape of a hexagon. The frame is a scissoring frame. The frame includes upper and lower junctions. The upper junction engages the sidewall. A strap engages the lower junction to a periphery of the floor, an inner portion of the floor, and the sidewall.

12 Claims, 30 Drawing Sheets

(56) References Cited

U.S. PATENT DOCUMENTS

| | | | | |
|---|---|---|---|---|
| 4,186,454 | A | 2/1980 | Cone | |
| 4,202,065 | A | 5/1980 | Sullivan | |
| D257,299 | S | 10/1980 | Cone | |
| 4,245,850 | A | 1/1981 | Boudreau | |
| 4,304,017 | A | 12/1981 | Mortimer | |
| 4,573,224 | A | 3/1986 | Saint | |
| 4,739,527 | A | 4/1988 | Kohus et al. | |
| 5,099,866 | A | 3/1992 | Solis et al. | |
| 5,513,399 | A | 5/1996 | Weng | |
| 5,530,977 | A | 7/1996 | Wang | |
| 5,826,285 | A * | 10/1998 | Mariol | A47D 13/063 5/99.1 |
| 5,890,263 | A | 4/1999 | Wu | |
| 5,904,344 | A | 5/1999 | Pope | |
| 6,035,877 | A | 3/2000 | Losi, Jr. et al. | |
| 6,131,218 | A | 10/2000 | Wang | |
| 6,305,037 | B1 | 10/2001 | Cheng | |
| 6,332,231 | B1 | 12/2001 | Wang | |
| 6,336,234 | B1 | 1/2002 | Kuo | |
| 6,438,773 | B1 | 8/2002 | Hsia | |
| 6,865,756 | B2 | 3/2005 | Clapper et al. | |
| 7,055,191 | B1 | 6/2006 | Chen | |
| 7,401,367 | B2 | 7/2008 | Gehr et al. | |
| 7,418,746 | B2 | 9/2008 | Gehr et al. | |
| 7,568,243 | B2 | 8/2009 | Gehr et al. | |
| 7,617,550 | B2 | 11/2009 | Gehr et al. | |
| D626,755 | S | 11/2010 | Spitz | |
| 8,024,825 | B2 | 9/2011 | Harrison et al. | |
| 9,144,325 | B1 | 9/2015 | Sousa et al. | |
| 2002/0166170 | A1 | 11/2002 | Hartenstine | |
| 2005/0166316 | A1 | 8/2005 | Gehr | |
| 2006/0021137 | A1 | 2/2006 | Waldman | |
| 2006/0021138 | A1 | 2/2006 | Waldman | |
| 2006/0080776 | A1 | 4/2006 | Clapper | |
| 2006/0253978 | A1 | 11/2006 | Paesang | |
| 2009/0260156 | A1 | 10/2009 | Yu | |
| 2010/0260536 | A1 | 10/2010 | Yu | |
| 2012/0192355 | A1 | 8/2012 | Manzanares | |
| 2012/0216346 | A1 | 8/2012 | Rampton | |
| 2013/0312178 | A1 | 11/2013 | Jackson | |
| 2013/0326808 | A1 | 12/2013 | Saint | |
| 2014/0061563 | A1 | 3/2014 | Weisbeck et al. | |
| 2014/0068857 | A1 | 3/2014 | Jackson | |
| 2014/0191173 | A1 | 7/2014 | Saint | |
| 2016/0242566 | A1 | 8/2016 | Tadipatri | |
| 2017/0065100 | A1 | 3/2017 | Lange | |

OTHER PUBLICATIONS

Overstock, Precision Pet Navy/Tan Medium Softside Play Pen, five pages, Overstock.com.

* cited by examiner

PLAYYARD

This application is a continuation of U.S. patent application Ser. No. 16/894,798 filed Jun. 6, 2020 (U.S. Pat. No. 11,026,522 issued Jun. 8, 2021) and claims the benefit thereof under 35 U.S.C. § 120, which application is a continuation of U.S. patent application Ser. No. 16/600,558 filed Oct. 13, 2019 (U.S. Pat. No. 10,674,835 issued Jun. 9, 2020) and claims the benefit thereof under 35 U.S.C. § 120, which application is a continuation of U.S. patent application Ser. No. 15/080,502 filed Mar. 24, 2016 (U.S. Pat. No. 10,448,752 issued Oct. 22, 2019) and claims the benefit thereof under 35 U.S.C. § 120, which application is a continuation-in-part of U.S. patent application Ser. No. 15/069,717 filed Mar. 14, 2016 (U.S. Pat. No. 10,194,755 issued Feb. 5, 2019) and claims the benefit thereof under 35 U.S.C. § 120, which application claims the benefit under 35 U.S.C. 119(e) of the following U.S. provisional patent application Nos. : 1) 62/189,177 filed Jul. 6, 2015, and 2) 62/145,501 filed Apr. 9, 2015, all of which nonprovisional and provisional applications are hereby incorporated by reference in their entireties into this application.

FIELD OF THE INVENTION

The present invention relates to a playyard, and more specifically to a playyard that is foldable out from a compact form to an open form and foldable in from the open form to the compact form.

BACKGROUND OF THE INVENTION

Playyards may have a relatively great number and assortment of parts. For example, playyards may have hubs, frames, sleeves, cords, bags, male frame members, female frame members. This rather large number and variety of parts may maximize set up and take down time and the number of steps that the caregiver must perform during set up or take down and may lead to an incorrect construction, broken or torn parts, and anxiety on the part of the caregiver.

SUMMARY OF THE INVENTION

A feature of the present invention is the provision in a playyard, of an endless frame.

Another feature of the present invention is the provision in a playyard, of an endless and flexible sidewall engaged to the frame, the flexible sidewall engaged inwardly of the frame.

Another feature of the present invention is the provision in a playyard, of a flexible floor engaged inwardly of the endless sidewall.

Another feature of the present invention is the provision in a playyard, of the endless sidewall and floor taking the shape of a receptacle with an open top and a closed bottom defined by the floor.

Another feature of the present invention is the provision in a playyard, of the frame having upper junctions, the sidewall being engaged to the frame at the upper junctions.

Another feature of the present invention is the provision in a playyard, of the frame having lower junctions, the floor being engaged to the frame at the lower junctions.

Another feature of the present invention is the provision in a playyard, of the playyard being foldable up into a compact configuration for storage.

Another feature of the present invention is the provision in a playyard, of the playyard being foldable out from the compact configuration to an open configuration.

Another feature of the present invention is the provision in a playyard, of the sidewall being engaged to the frame at the lower junctions. Another feature of the present invention is the provision in a playyard, of a strap engaging the floor to the lower junction, the strap being flexible.

Another feature of the present invention is the provision in a playyard, of a strap engaging the sidewall to the lower junction, the strap being flexible.

Another feature of the present invention is the provision in a playyard, of a strap engaging each of the sidewall and floor to the lower junction, the strap being flexible.

Another feature of the present invention is the provision in a playyard, of a strap having proximal and distal ends, the proximal end of the strap being engaged to the lower junction, the distal end of the strap being engaged to the floor at a floor location inwardly of the lower junction, the floor location being spaced from the lower junction, the strap being flexible.

Another feature of the present invention is the provision in a playyard, of the strap including an intermediate section between the proximal and distal ends of the strap, the intermediate section being free of connection to the floor.

Another feature of the present invention is the provision in a playyard, of a strap and of a slot in the floor, the slot being adjacent to the lower junction, the strap engaging the slot and the junction when the playyard is in the compact position, the strap engaging the slot and the junction when the playyard is in the open position, the slot and strap slidable relative to each other when the playyard is folded between the compact and open positions, the strap being flexible.

Another feature of the present invention is the provision in a playyard, of the frame including a pair of hinged frame members, each of the hinged frame members having two ends, one of the ends of one hinged frame member forming part of one of the upper junctions and the other of the ends forming part of one of the lower junctions.

Another feature of the present invention is the provision in a playyard, of the frame defining a hexagon or a combination of straight or substantially planar side peripheral frame portions.

Another feature of the present invention is the provision in a playyard, of the sidewall defining a hexagon or a combination of straight side or substantially planar peripheral wall portions.

Another feature of the present invention is the provision in a playyard, of the floor defining a hexagon or a combination of straight side peripheral edge portions.

Another feature of the present invention is the provision in a playyard, of each of the frame, sidewall, and floor defining a hexagon or a combination of peripheral frame, wall or floor portions that are straight or substantially planar.

Another feature of the present invention is the provision in a playyard, of a strap, of a slot in the lower junction, of a slot in a periphery of the floor, and of a loop engaged to the sidewall, the strap being flexible, the strap engaging a) the slot of the lower junction, b) the slot of the periphery of the floor, c) the loop engaged to the sidewall, and d) an interior portion of the floor.

Another feature of the present invention is the provision in a playyard, of a strap, the strap being flexible, the strap engaging a periphery of the floor and the strap further engaging an interior of the floor at a floor location spaced from the periphery of the floor.

Another feature of the present invention is the provision in a playyard, of one of the upper junctions being a lockable junction such that, when the upper junction is locked, the frame may not be folded between open and compact configurations.

Another feature of the present invention is the provision in a playyard, of one of the upper junctions being a lockable junction and of each of the remaining junctions including no locks and being free to pivot at any time.

Another feature of the present invention is the provision in a playyard, of each of the lower junctions including no locks and being free to pivot at any time.

Another feature of the present invention is the provision in a playyard, of two adjacent upper junctions being lockable junctions and of each of the remaining junctions including no locks and being free to pivot at any time.

Another feature of the present invention is the provision in a playyard, of the frame being a scissoring frame.

Another feature of the present invention is the provision in a playyard of a frame, the frame being endless, the frame having upper junctions, intermediate junctions, and lower junctions, and the frame being a scissoring frame.

Another feature of the present invention is the provision in a playyard of a flexible pen, the flexible pen engaged to the frame, the flexible pen disposed inwardly of the frame, and the flexible pen including a sidewall, a floor and an open top.

Another feature of the present invention is the provision in a playyard, of the frame and flexible pen being foldable up from an open configuration into a closed configuration for storage, and of the frame and flexible pen being foldable out from the closed configuration to the open configuration.

Another feature of the present invention is the provision in a playyard, of a set of flexible straps, where each of the flexible straps includes a proximal end and a distal end, where the proximal end is engaged to the sidewall, where the distal end is engaged to the floor, where each of the flexible straps slides through a respective lower junction when the frame and flexible pen are being folded up from the open configuration to the closed configuration, and where each of the flexible straps slides through the respective lower junction when the frame and flexible pen are being folded out from the closed configuration to the open configuration.

Another feature of the present invention is the provision in a playyard, of the floor including a central portion and where the distal end of the flexible strap is engaged to the central portion.

Another feature of the present invention is the provision in a playyard, of the sidewall including an upper edge and where the proximal end of the flexible strap is engaged to the sidewall at or adjacent to the upper edge.

Another feature of the present invention is the provision in a playyard, of the flexible strap slidingly engaging a flexible pen slot at or adjacent to a flexible pen junction between the floor of the flexible pen and the sidewall of the flexible pen.

Another feature of the present invention is the provision in a playyard, of the flexible strap slidingly engaging a flexible pen slot at or adjacent to a flexible pen junction between the floor of the flexible pen and the sidewall of the flexible pen, where the flexible strap is free of the floor between the central portion of the floor and the flexible pen slot.

Another feature of the present invention is the provision in a playyard, of the sidewall including an upper edge, where the flexible pen includes a flexible pen junction between the floor of the flexible pen and the sidewall of the flexible pen, where the flexible strap is engaged to the sidewall from an upper location at or adjacent to the upper edge to a lower location spaced from the flexible pen junction between the floor and the sidewall, and where the strap is free of the sidewall from the lower location to the flexible pen junction.

Another feature of the present invention is the provision in a playyard, of the set of flexible straps including first and second flexible straps, where the first and second flexible straps are disposed diametrically of each other, where the distal ends of the flexible straps are engaged to each other.

Another feature of the present invention is the provision in a playyard, of the flexible strap including a strap portion adjacent to the floor of the pen, where the strap portion extends radially toward a center of the floor.

Another feature of the present invention is the provision in a playyard, of a portion of the flexible strap being engaged to the flexible pen and a portion of the flexible strap being free of the flexible pen, and of a quick connection between the portion that is engaged to the flexible pen and the portion that is free of the flexible pen.

Another feature of the present invention is the provision in a playyard, of the frame including first and second support members with respective first and second lower ends that are pivotally engaged to each other, where the lower junction includes the first and second lower ends, and where the first and second lower ends include bottommost faces.

Another feature of the present invention is the provision in a playyard, of the lower junction further including a foot, where the foot is pivotally engaged to the lower junction and includes a bottommost face that is adjacent to the bottommost faces of the first and second lower ends such that the bottommost face of the foot can rock toward and away from each of the bottommost faces of the first and second lower ends to provide greater stability to the playyard.

Another feature of the present invention is the provision in a playyard, of the first and second lower ends and the foot pivoting about a common axis.

Another feature of the present invention is the provision in a playyard, of the foot including a slot, and of a flexible strap having a proximal end and a distal end, the proximal end being engaged to the sidewall, where the distal end is engaged to the floor, and where the flexible strap is slidingly engaged in the slot.

Another feature of the present invention is the provision in a playyard, of the frame including a set of support member pairs, where each support member pair includes two support members scissoring relative to each other, where the frame includes a first support member pair having first and second support members with respective first and second intermediate portions, where the first and second intermediate portions have a first intermediate junction where the first and second support members pivot relative to each other, where the first intermediate junction is lockable such that the first and second support members are locked relative to each other, and where the first intermediate junction is unlockable such that the first and second support member can pivot relative to each other.

Another feature of the present invention is the provision in a playyard, of a second lock, where the second lock is engaged between the support members of a support member pair, and where the second lock includes an over center mechanism where an over center position is a locked position.

Another feature of the present invention is the provision in a playyard, of the support members of the support member pair having the second lock including lower portions, where each of the lower portions extends from the intermediate junction to the lower junction, and where the second lock is engaged to the lower portions of the support members of the support member pair.

Another feature of the present invention is the provision in a playyard, of the second lock including first and second elongate members, where each of the first and second elongate members includes a proximal end and a distal end, where the proximal ends are pivotally engaged to each other, where each of the distal ends are pivotally engaged to one of the support members of the support member pair having the second lock, where the second lock further includes a channel piece with a back plate and an open face, where the back plate and opposing face are disposed across from each other, where the channel piece receives the proximal ends of the first and second elongate support members, where proximal end portions of the proximal ends swing through the open face of the channel when the second lock is opened and closed, and where the back plate brings pressure to bear upon proximal end portions of the proximal ends when the second lock is locked.

Another feature of the present invention is the provision in a playyard, of the frame including a set of support member pairs, where each support member pair includes two support members scissoring relative to each other, where the frame includes a second support member pair having third and fourth support members with respective third and fourth intermediate portions, where the third and fourth intermediate portions include a second intermediate junction where the third and fourth support members pivot relative to each other, where the second intermediate junction is lockable such that the third and fourth support members are locked relative to each other, where the second intermediate junction is unlockable such that the third and fourth support member can pivot relative to each other.

Another feature of the present invention is the provision in a playyard, of the second support member being pivotally engaged to the third support member at one of the upper junctions, and where the first support member is pivotally engaged to the fourth support member at one of the lower junctions such that the first and intermediate junctions are close to each other such that a caretaker can unlock the first intermediate junction with the left hand and the second intermediate junction with the right hand at the same time.

Another feature of the present invention is the provision in a playyard, of all of the support member pairs minus the first support member pair and further minus the second support member pair define all remaining support member pairs, and where each of the all remaining support member pairs includes no lock and is free to pivot at any time.

Another feature of the present invention is the provision in a playyard, of the sidewall of the flexible pen having a set of extensions, where each of the extensions is paired with and engaged to one of the upper junctions, where the extension extends about an upper face, an outer face, an under face, and an inner face of a respective upper junction.

Another feature of the present invention is the provision in a playyard, of the extension including a distal end, where the distal end is engaged to the inner face of the respective upper junction.

Another feature of the present invention is the provision in a playyard, of the extension extending from the sidewall to the upper face of the upper junction, then extends to the outer face of the upper junction, then extends to the under face of the upper junction, and then extends to the inner face of the upper junction where the distal end is engaged.

Another feature of the present invention is the provision in a playyard, of a flexible strap, where the flexible strap includes a proximal end and a distal end, where the distal end is engaged to the floor, and where the proximal end is engaged to the sidewall at a location adjacent to the extension.

Another feature of the present invention is the provision in a playyard, of the frame being lockable in the open configuration such that the frame, when locked, cannot be folded into the closed configuration, where when the frame is locked the flexible pen is removable from the frame, and where, after the flexible pen has been removed from the frame, the frame remains locked.

Another feature of the present invention is the provision in a playyard, of the flexible pen being removably engaged to the frame at the upper junctions and at the lower junctions.

Another feature of the present invention is the provision in a playyard, of the flexible pen including an access door in the sidewall, where the access door includes a periphery, where at least a portion of the periphery of the access door is defined by a quick connection between the access door and the sidewall.

Another feature of the present invention is the provision in a playyard, of the frame including a first support member having a first upper end and a second support member having a second upper end, where one of the upper junctions is a first upper junction and includes the first and second upper ends where the first and second upper ends pivot relative to each other, where the first upper junction is lockable such that the first and second support members are locked relative to each other, where the first upper junction is unlockable such that the first and second support members can pivot relative to each other.

Another feature of the present invention is the provision in a playyard, of the frame including a third support member having a third upper end and a fourth support member having a fourth upper end, where one of the upper junctions is a second upper junction and includes the third and fourth upper ends where the third and fourth upper ends pivot relative to each other, where the second upper junction is lockable such that the third and fourth support members are locked relative to each other, where the second upper junction is unlockable such that the third and fourth support members can pivot relative to each other.

Another feature of the present invention is the provision in a playyard, of the first and second upper junctions being immediately adjacent to each other such that no other upper junctions are disposed between the first and second upper junctions such that a caretaker can unlock the first upper junction with the left hand and the second upper junction with the right hand at the same time.

Another feature of the present invention is the provision in a playyard, of the upper junctions minus the first upper junction and further minus the second upper junction defining all remaining upper junctions, and where each of the all remaining upper junctions includes no lock and is free to pivot at any time.

Another feature of the present invention is the provision in a playyard, of a frame, the frame being endless, the frame having upper junctions, intermediate junctions, and lower junctions, the frame being a scissoring frame, of a flexible pen, the flexible pen engaged to the frame, the flexible pen disposed inwardly of the frame, the flexible pen including a sidewall, a floor and an open top, of the frame and flexible pen being foldable up from an open configuration into a closed configuration for storage with the flexible pen disposed inwardly of the frame, of the frame and flexible pen being foldable out from the closed configuration to the open configuration with the flexible pen disposed inwardly of the frame, of the frame including a set of support member pairs, each support member pair including two support members scissoring relative to each other, and of a lock, the lock being engaged between the support members of a support member pair, the lock having an over center mechanism where an over center position is a locked position.

Another feature of the present invention is the provision in a playyard, of support members of the support member pair having the lock including lower portions, where each of the lower portions extend from the intermediate junction to the lower junction, and where the lock is engaged to the lower portions of the support members of the support member pair.

Another feature of the present invention is the provision in a playyard, of the lock including first and second elongate members, where each of the first and second elongate members include a proximal end and a distal end, where the proximal ends are pivotally engaged to each other, where each of the distal ends are pivotally engaged to one of the support members of the support member pair having the lock.

Another feature of the present invention is the provision in a playyard, of each of the upper junctions being freely swingable at all times except when the lock is locked.

Another feature of the present invention is the provision in a playyard, of each of the upper junctions including no lock.

Another feature of the present invention is the provision in a playyard, of each of the upper junctions being free to pivot except when the lock is locked.

Another feature of the present invention is the provision in a playyard, of the lock including first and second elongate members, where each of the elongate members includes a length, where each of the support members include a length, and where the length of each of the elongate members is adjacent to one of the support members when the playyard is in the closed configuration.

Another feature of the present invention is the provision in a playyard, of the lock including first and second elongate members, where the first and second elongate members form an inverted V shape when the playyard is in the closed configuration.

Another feature of the present invention is the provision in a playyard, of the lock including first and second elongate members, where each of the first and second elongate members includes a respective first and second axis, and where the first and second axis are at one time in a straight line when the playyard is folded out from the closed configuration to the open configuration.

Another feature of the present invention is the provision in a playyard, of the lock including first and second elongate members, where the first and second elongate members form an upright V shape when the lock is in the locked position and the playyard is in the open configuration.

Another feature of the present invention is the provision in a playyard, of the lock including a first elongate member having a first axis and a second elongate member having a second axis, where the first elongate member is pivotally engaged to a first support member at a first pivot point, where the second elongate member is pivotally engaged to a second support member at a second pivot point, where a first distance between the first and second pivot points when the first and second axis form a straight line is defined by a distance A, where the first and second axis form a straight line at a point in time when the playyard is being folded out from the closed configuration to the open configuration, where a second distance between the first and second pivot points is defined by a distance B when the lock is in the locked position, and where distance A is greater than distance B.

Another feature of the present invention is the provision in a playyard, of the lock further having a channel piece with a back plate and an open face, where the back plate and open face are disposed across from each other, and where the channel piece receives and is pivotally engaged to the proximal ends of the first and second elongate support members.

Another feature of the present invention is the provision in a playyard, of each of the first and second elongate members including an intermediate portion between the proximal and distal end of the elongate member, where the intermediate portion swings through the open face of the channel when the lock is opened and closed, where the back plate covers proximal end portions of the proximal ends when the lock is locked.

Another feature of the present invention is the provision in a playyard, of the first and second elongate members forming an upright V when the lock is in the locked position, where the first and second elongate members define a first angle of a first degree therebetween when the lock is in the locked position, where the back plate confronts the elongate members when the lock is in the locked position and prevents the elongate members from forming a second angle having a second degree less than the first degree of the first angle when the lock is in the locked position.

Another feature of the present invention is the provision in a playyard, of a frame, the frame being endless, the frame having upper junctions, intermediate junctions, and lower junctions, the frame being a scissoring frame, of a flexible pen, the flexible pen engaged to the frame, the flexible pen disposed inwardly of the frame, the flexible pen including a sidewall, a floor and an open top, of the frame and flexible pen being foldable up from an open configuration into a closed configuration for storage with the flexible pen disposed inwardly of the frame, of the frame and flexible pen being foldable out from the closed configuration to the open configuration with the flexible pen disposed inwardly of the frame, of the frame including a set of support member pairs, each support member pair including two support members scissoring relative to each other, of a split tension locking bar engaged between a first support member pair having first and second support members, the split tension bar having first and second elongate members, the first elongate member having a first proximal end and a first distal end, the second elongate member having a second proximal end and a second distal end, the first and second proximal ends being pivotally engaged to each other, the first distal end being pivotally engaged to the first support member of the first support member pair, the second distal end being pivotally engaged to the second support member of the first support member pair, the split tension locking bar forming an inverted V when the playyard is in the closed configuration, the split tension locking bar being lockable, the split tension locking bar when locked forming an upright V, the split tension locking bar being locked when the playyard is in the open position, the split tension locking bar forming a straight line at a point in time when the playyard is folded in from the open configuration to the closed configuration, of each of the upper junctions, intermediate junctions, and lower junctions of the frame being a free swinging junction except when the split tension locking bar is locked, and of each of the upper junction, intermediate junctions, and lower junctions being prevented from swinging when the split tension locking bar is locked.

An advantage of the present invention is a simple and easy set up and take down. For example, for set up the caregiver need to only fold out the foldable frame and lock two adjacent upper junctions in one embodiment or two adjacent intermediate junctions in another embodiment. For take down, the caregiver need to only unlock the two adjacent junctions and fold in the foldable frame to the compact form and, optionally, in one embodiment, release a second over center lock with his or her foot.

Another advantage of the present invention is that the sidewall and floor may be easily disengaged from the frame for washing. A quick connect strap is disengaged from itself at each of the lower junctions, the sidewall is disengaged from each of the upper junctions, and then the sidewall and floor is pulled off the frame.

Another advantage of the present invention is that the floor of the playyard is pulled relatively tightly and flat during set up so as to minimize the chances of children tripping over folds in the floor as they run and play. One feature contributing to this advantage is the strap engaged to both of the periphery of the floor of the playyard and to an inward floor location of the playyard spaced from the periphery of the floor of the playyard.

Another advantage of the present invention is that the playyard is relatively simple, easy and inexpensive to manufacture.

Another advantage is that the frame is self-supporting. In other words, the frame does not rely upon soft components such as the flexible pen to keep the frame in an open position.

DESCRIPTION

Figure 1:
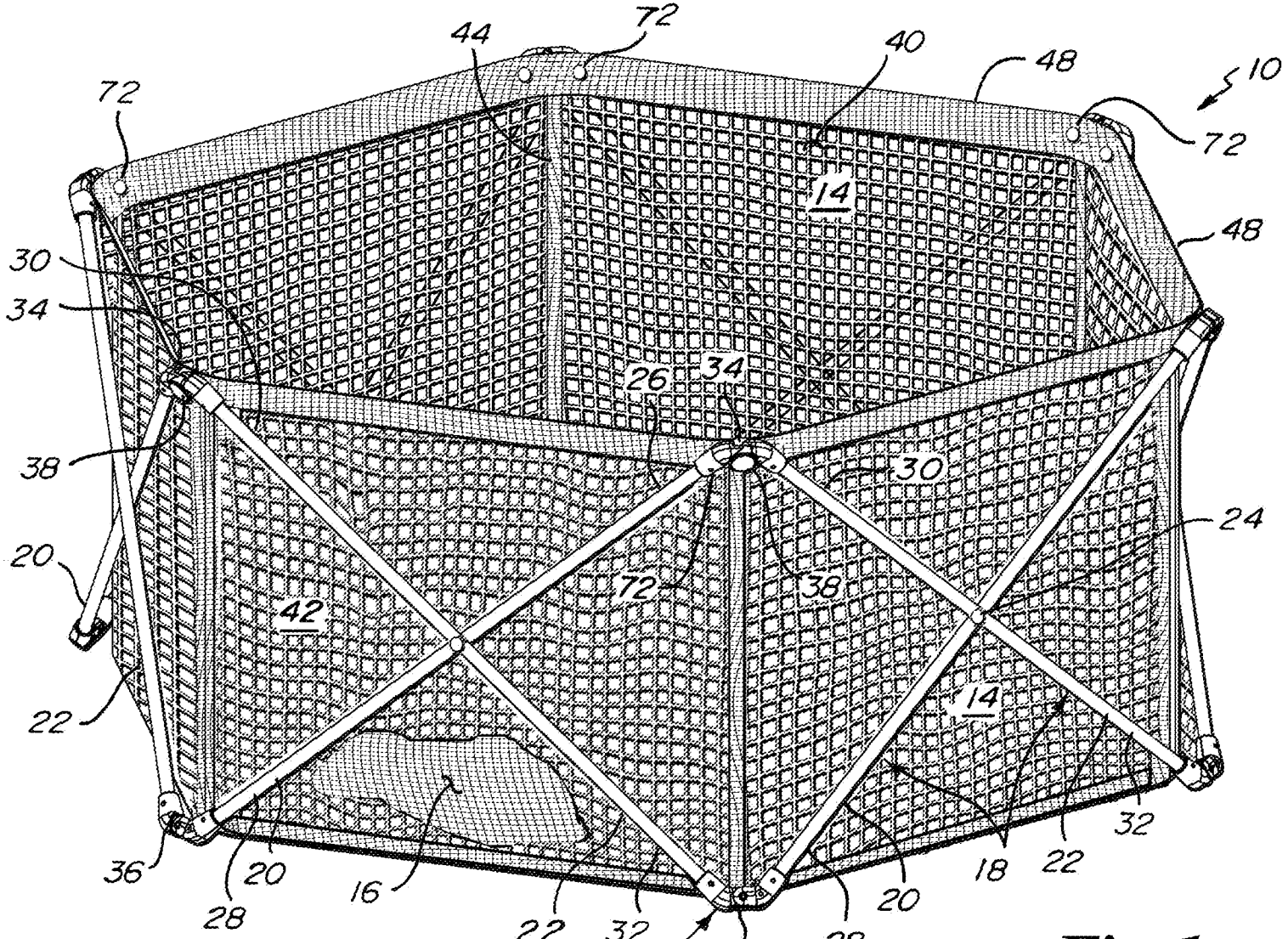
FIG. 1 is a perspective view of the playyard of the present invention in an open form.

As shown in FIG. 1, the present playyard is indicated by the reference numeral 10. Playyard 10 includes an endless frame 12, an endless sidewall 14, and a floor 16.

Frame 12 is a scissoring folding frame. Frame 12 includes six folding scissoring sections 18. Each of the sections 18 includes a pair of tubular frame members 20, 22 interconnected by a pin connector 24. Frame member 20 is adjacent to and spaced from sidewall 14 with no other frame members, including frame member 22, between such frame member 20 and the sidewall 14. The other of the frame members, namely frame member 22, is adjacent to and spaced from the sidewall 14 with frame member 20 being between such frame member 22 and the sidewall 14. Frame section 18 can scissor out to the expanded "X" form shown in FIG. 1 and can scissor in to the retracted "X" form shown in FIG. 5.

Frame member 20 includes an upper end 26 and a lower end 28. Frame member 22 includes an upper end 30 and a lower end 32.

Upper end 26 of frame member 20 of one frame section 18 is pivotally engaged at an upper junction 34 to upper end 30 of frame member 22 of an adjacent frame section 18.

Lower end 28 of frame member 20 of one frame section 18 is pivotally engaged at a lower junction 36 to lower end 32 of frame member 22 of an adjacent frame section 18.

Two adjacent upper junctions 34 have button locks 38 that are normally locked. In other words, the button locks 38 are normally biased in an outward position such that the locking mechanism prevents upper ends 26, 30 from pivoting relative to each other, which in turn prevents all of the remaining four upper junctions 34 from pivoting and further prevents all six lock free lower junctions 36 from pivoting. When pressed in, the button locks 38 unlock the upper ends 26, 30 from each other, thereby allowing such upper ends 26, 30 to pivot relative to each other, thereby unlocking such two upper junctions 34 to pivot, thereby permitting the remaining four upper junctions 34 to pivot, thereby permitting all six lock free lower junctions 36 to pivot, and thereby permitting the frame 12 and playyard as a whole to fold from an open form or configuration shown in FIG. 1 to the closed and compact form or configuration shown in FIG. 5.

Endless sidewall 14 is flexible. Endless sidewall 14 may be formed of a fabric material. Endless sidewall 14 may be formed of a mesh material as indicated by reference number 40.

Figure 6:
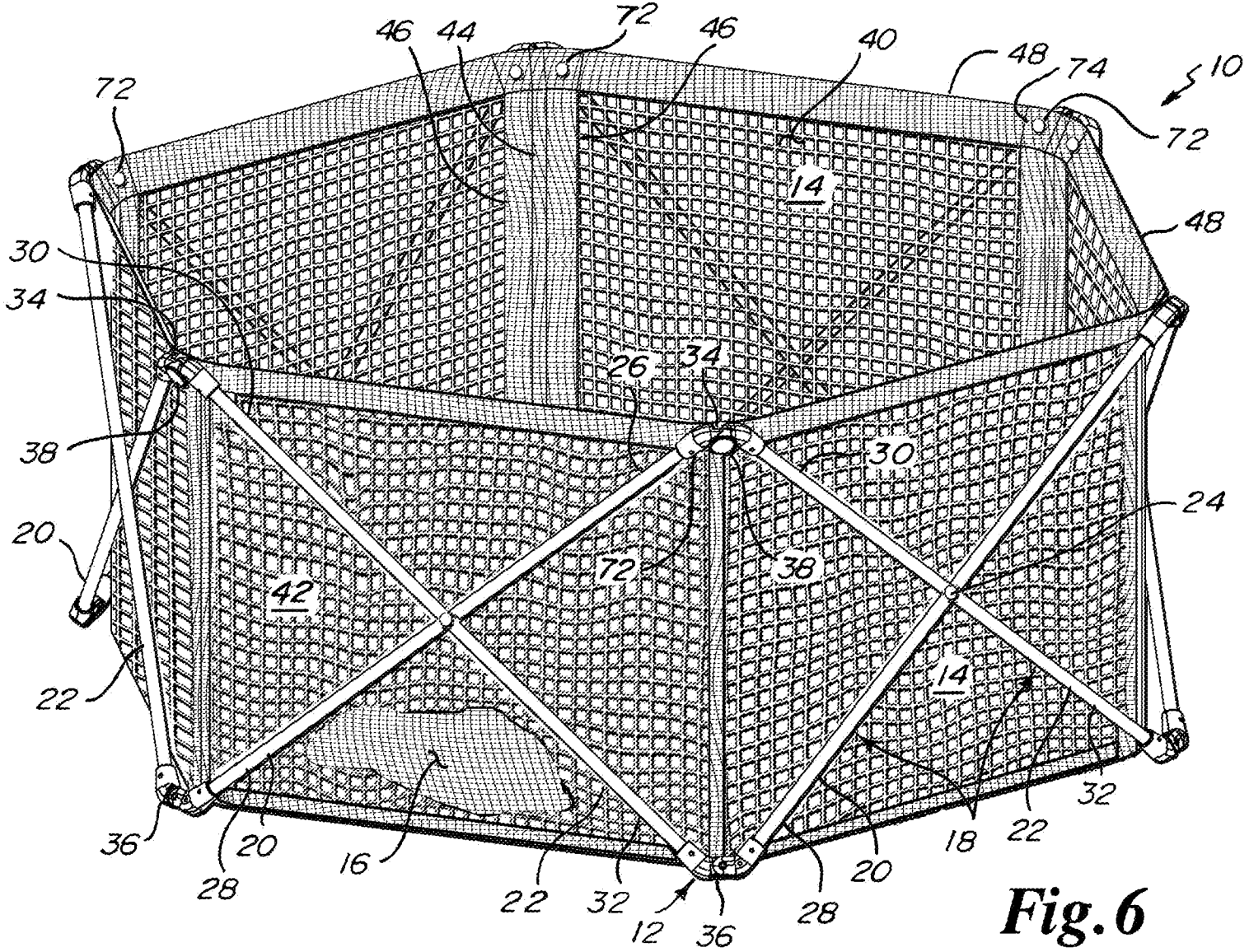
FIG. 6 is a perspective view of the playyard of the FIG. 1 in an open form, where such playyard where the playyard includes vertically running and reinforcing strips of fabric on vertical outer portions of the six fabric panel portions of the endless sidewall.

Endless sidewall 14 includes six sections 42 joined to each other. Section 42 may include peripheral reinforcement material that is not a mesh material such that section 42 may be partially formed of mesh and partially formed of a non-see-through fabric material. An elongate strap like flexible piece 44 is stitched or engaged vertically between adjacent sections 42. If desired, a non-mesh or non-see-through elongate strip 46 may be stitched or engaged vertically between piece 44 and mesh 40, or partially over mesh 40, as shown in FIG. 6. As shown by its absence in FIG. 1, strip 46 may not be included in the playyard 10 such that the mesh 40 is directly engaged to elongate strap like flexible piece 44, which engagement is shown in FIGS. 1, 2A, 2B and 3.

An upper peripheral reinforcing piece 48 of fabric material forms an upper horizontally extending portion of section 42. If desired, this piece 48 may be tubular and receive horizontally extending frame members that may be free of upper junctions 34 or that may pivotally tie into upper junctions 34.

Playyard floor 16 is engaged to endless sidewall 14 by an endless transition strip 50 stitched or otherwise engaged to and between the sidewall 14 and the floor 16. Vertical strip or piece 44 runs to and between upper horizontal strip or piece 48 and lower horizontal strip or piece 50.

Floor 16 defines a closed bottom to the playyard 10. Floor 16 is opposite of an open top of the playyard 10. Floor 16 is hexagonal. Floor 16 includes a hexagonal periphery, which periphery is stitched to strip 50. Floor 16 is flexible. Floor 16 is formed of a fabric or fabric like material. Floor 16 is formed of a non-see-through material. Floor 16 may be formed of a water-tight or a water-proof material. Floor 16 may be formed of a material having pores or spaces that keep out water or moisture in a liquid form but that permit water or moisture in a gas form to pass therethrough. Floor 16 may be formed of a material having pores or spaces that permit water or moisture in a liquid or gas form to pass therethrough. Floor 16 may be formed of a material having pores or spaces that do not permit the passage of either water or moisture in a liquid or gas form.

Figure 2A:
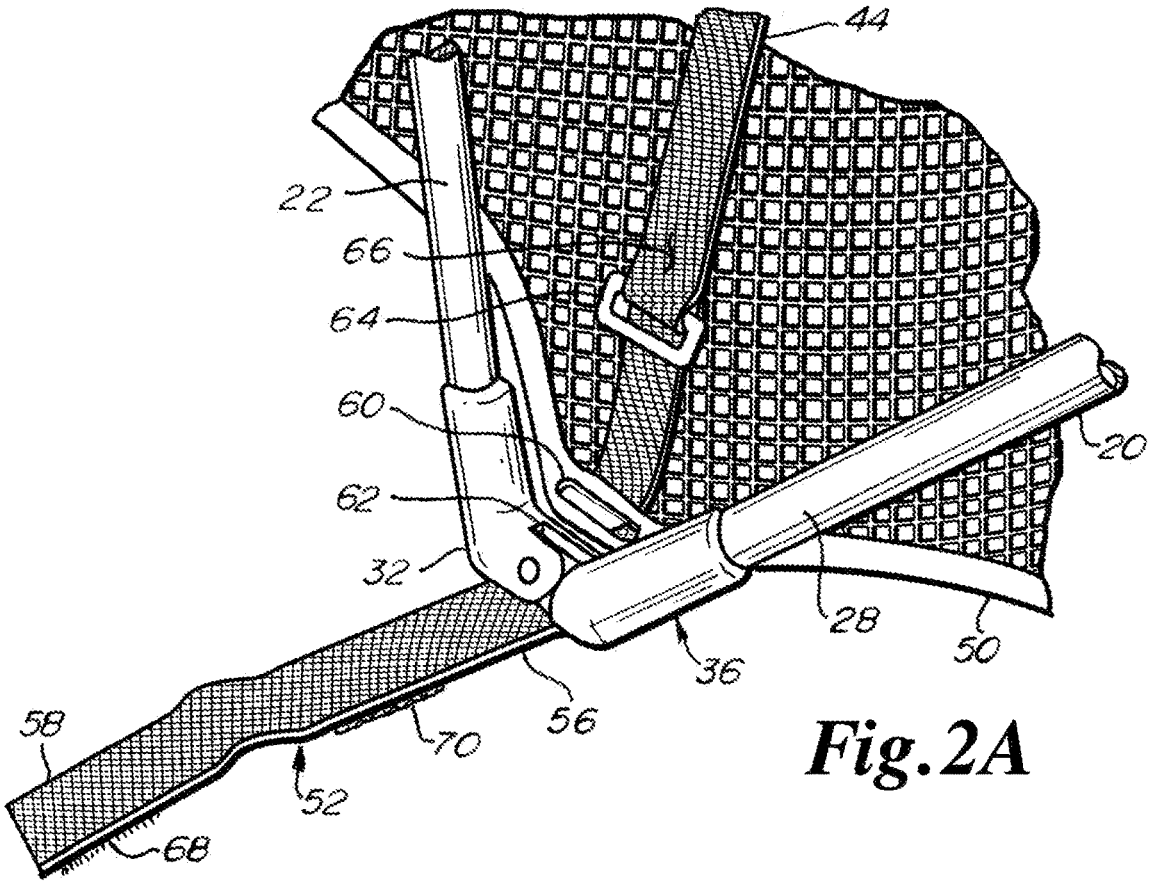
FIG. 2A is a perspective view of a lower junction of the playyard of FIG. 1 showing a strap, floor of the playyard, and sidewall of the playyard in a disassembled form.
Figure 2B:
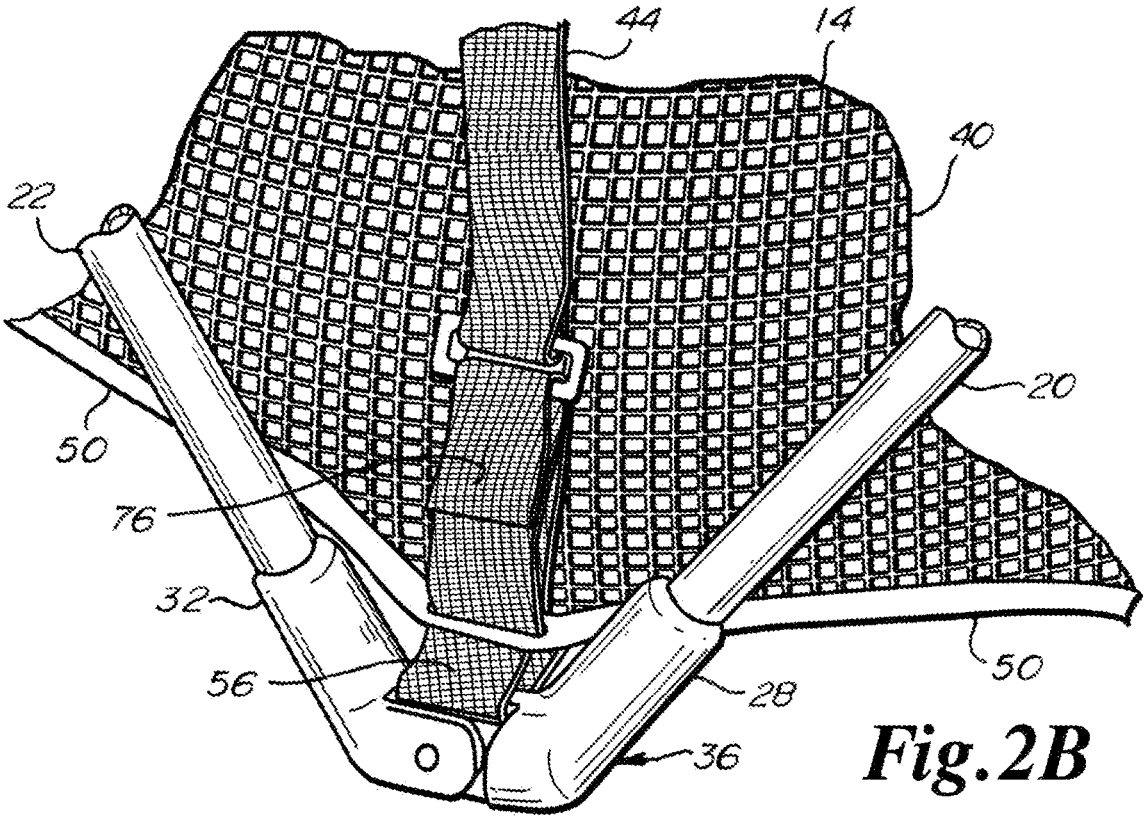
FIG. 2B is a perspective of the lower junction of the playyard of FIG. 2A showing the strap, floor of the playyard, and sidewall of the playyard in an assembled form.
Figure 3:
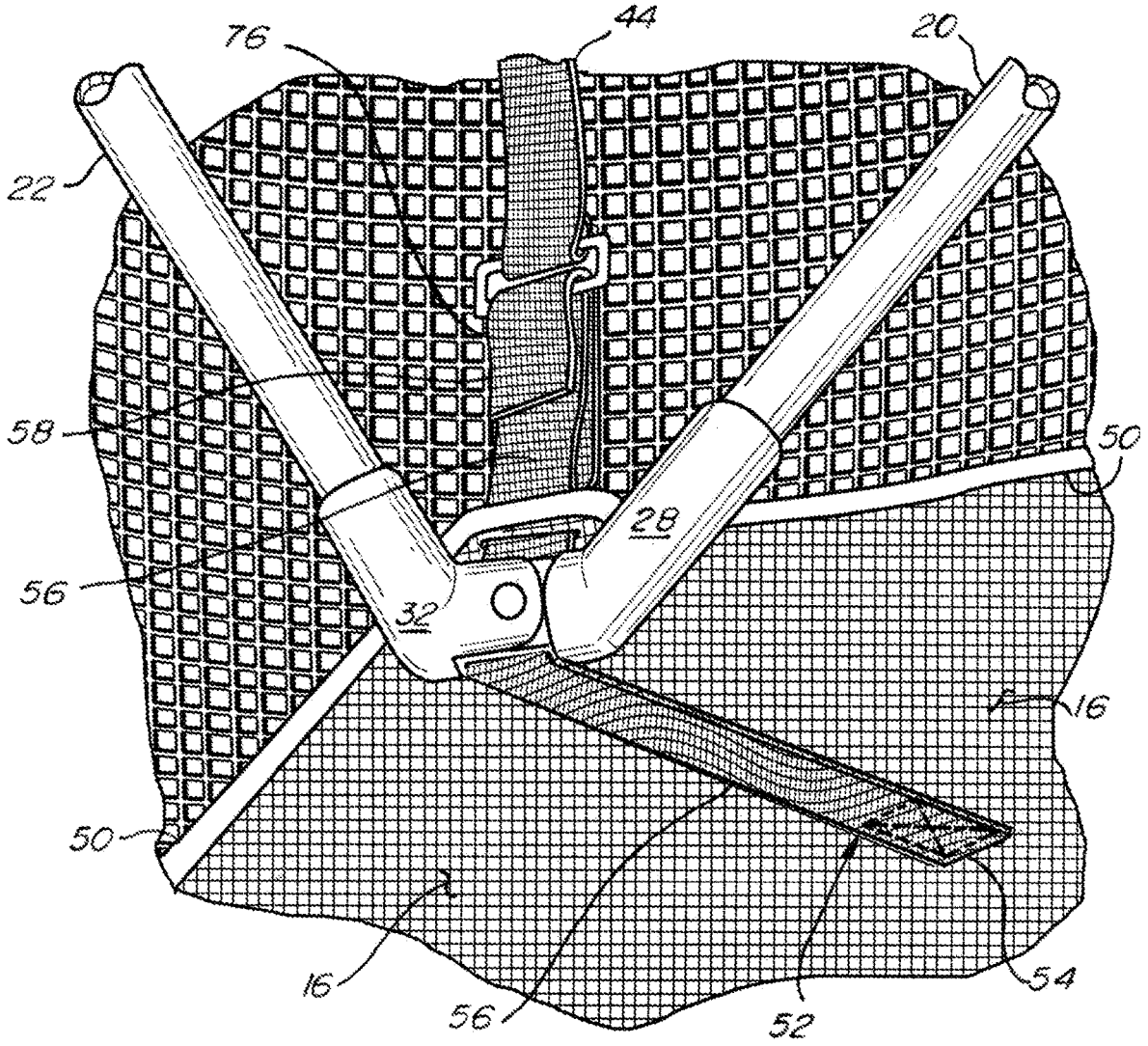
FIG. 3 is a perspective bottom view of the assembled lower junction of the playyard of FIG. 2B showing a greater portion of the floor of the playyard and the distal end of the strap.
Figure 4A:
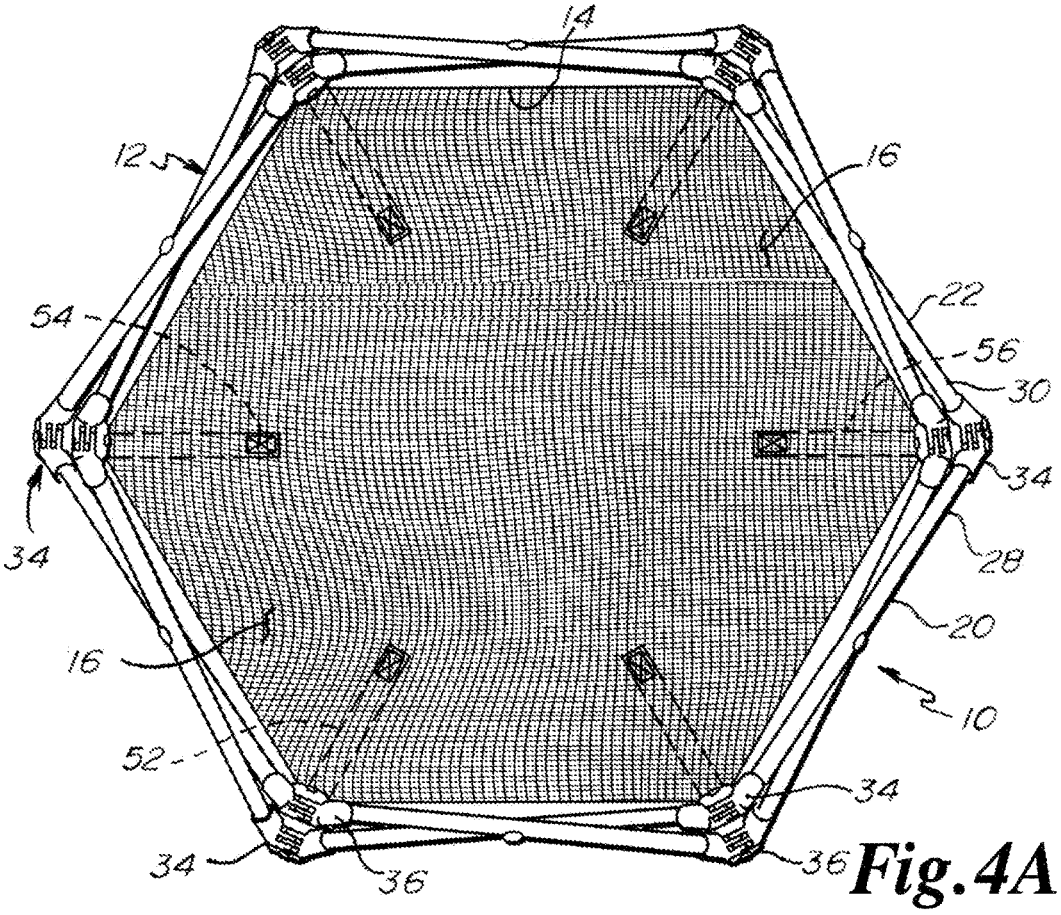
FIG. 4A is a top plan view of the playyard of FIG. 1 showing portions of the straps in phantom.
Figure 4B:
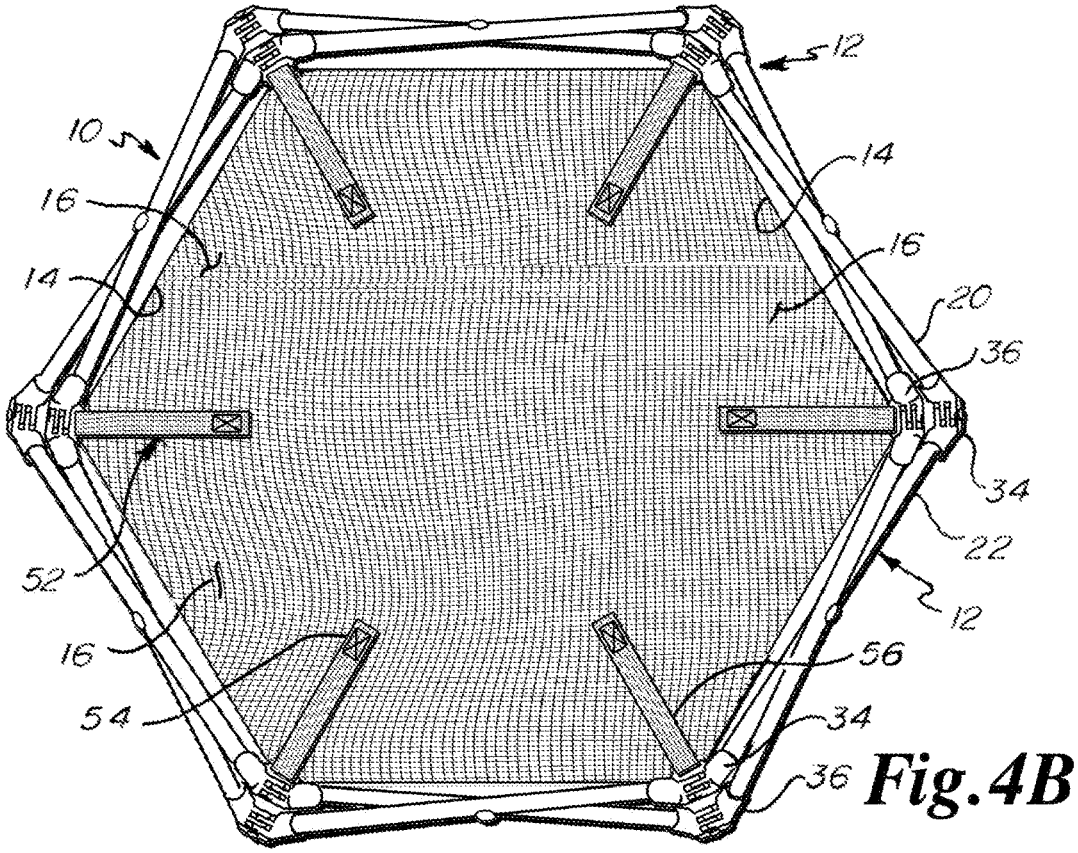
FIG. 4B is a bottom plan view of the playyard of FIG. 1.

Playyard 10 further includes a radially extending and floor pulling or floor tightening strap 52 shown in FIGS. 2A, 2B, 3, 4A and 4B. As shown in FIG. 3, strap 52 includes a distal end or distal end portion 54. Distal end or distal end portion 54 is stitched or otherwise engaged, such as by adhesive, to floor 16. Strap 52 confronts the bottom face of floor 16. Strap 52 further includes a remainder strap portion made up of an intermediate strap portion 56 and a proximal end or proximal end portion 58. This remainder strap portion that includes the intermediate strap portion 56 and the proximal end or proximal end portion 58 is not engaged to the floor 16 except through a slot 60 formed in peripheral, transition, and horizontal strip 50 of the floor 16. Intermediate strap portion 56 is between the proximal and distal end portions 54, 58 such that strap 52 can be defined to include a proximal end portion 58, a distal end portion 54, and an intermediate strap portion 56 between the proximal end portion 58 and the distal end portion 54. Distal end 54 of strap 52 is engaged on floor 16 at a location between peripheral piece 50 and a center of floor 16. Distal end 54 is spaced from peripheral piece 50 and is spaced from the center of floor 16.

As shown by a comparison between FIGS. 2A and 2B, in assembling the playyard 10, proximal end portion 58 is fed upwardly through a through slot 62 of lower junction 36, then is fed through peripheral strip slot 60, then is fed through a rectangular loop 64 of rigid material such as metal or plastic, and then is engaged back onto itself using a quick connect material such as Velcro®. Rectangular loop 64 is pivotally engaged in a secondary loop 66 formed by auxiliary portions of vertical strip 44. The quick connect material may include hook quick connect material 68 and loop quick connect material 70 as shown in FIG. 2A.

Strap 52 pulls the floor 16 taut or relatively tight when the playyard is folded out from the compact form to the open form by engaging an interior portion of the floor 16 through distal end portion 54 and by engaging a peripheral portion of the floor 16 through peripheral slot 60.

Strap 52 pulls sidewall sections 42 taut or relatively tight by engaging loops 64. Sidewall sections 42 are also pulled taut or relatively tight by the upper junctions 34 engaging the upper peripheral strip or piece 48. Upper junctions 34 may be engaged to the upper peripheral strip or piece 48 by pin 72 pivotally engaging upper peripheral strip 48. In the embodiment shown in FIG. 6, it should be noted that upper peripheral strip 48 overlaps vertical strip 46 adjacent upper junctions 34 at overlap portions 74. Pins 72 may extend though horizontal strip 48 (in the embodiment of FIG. 1) or overlap portions 74 (in the embodiment of FIG. 6) and the upper ends 26, 30 of the frame members 20, 22, respectively. Horizontal strip 48 serves as a base for pins 72 in the embodiment of FIG. 1. Overlap portions 74 serve as a base for pins 72 in the embodiment of FIG. 6.

In operation, to assemble the playyard 10, the frame 12 is folded out, preferably to a position just short of being fully folded out. Then the upper junctions 34 are fixed relative to the sidewall 14 by engaging the pins 72 between a) the upper ends 26, 30 of frame members 20, 22 and b) the overlap portions 74. Then the lower junctions 36 are fixed to the sidewall 14 and floor 16 by feeding the strap 52 through junction slot 62 and peripheral floor slot 60 and sidewall loop 64, and then fixing the strap 52 back onto itself using the quick connect material 68, 70 to make a quick connect connection 76. Then, with the upper junctions 34 engaged to the sidewall 14 and the lower junctions 36 engaged to the sidewall 14 and floor 16, the frame 12 can be fully pulled out until the button locks 38 automatically snap into a locked position. When the frame 12 is fully opened and the locks 38 locked, sidewall sections 42 are substantially planar and flat with no folds and the floor 16 is substantially planar and flat with no folds.

Figure 5:
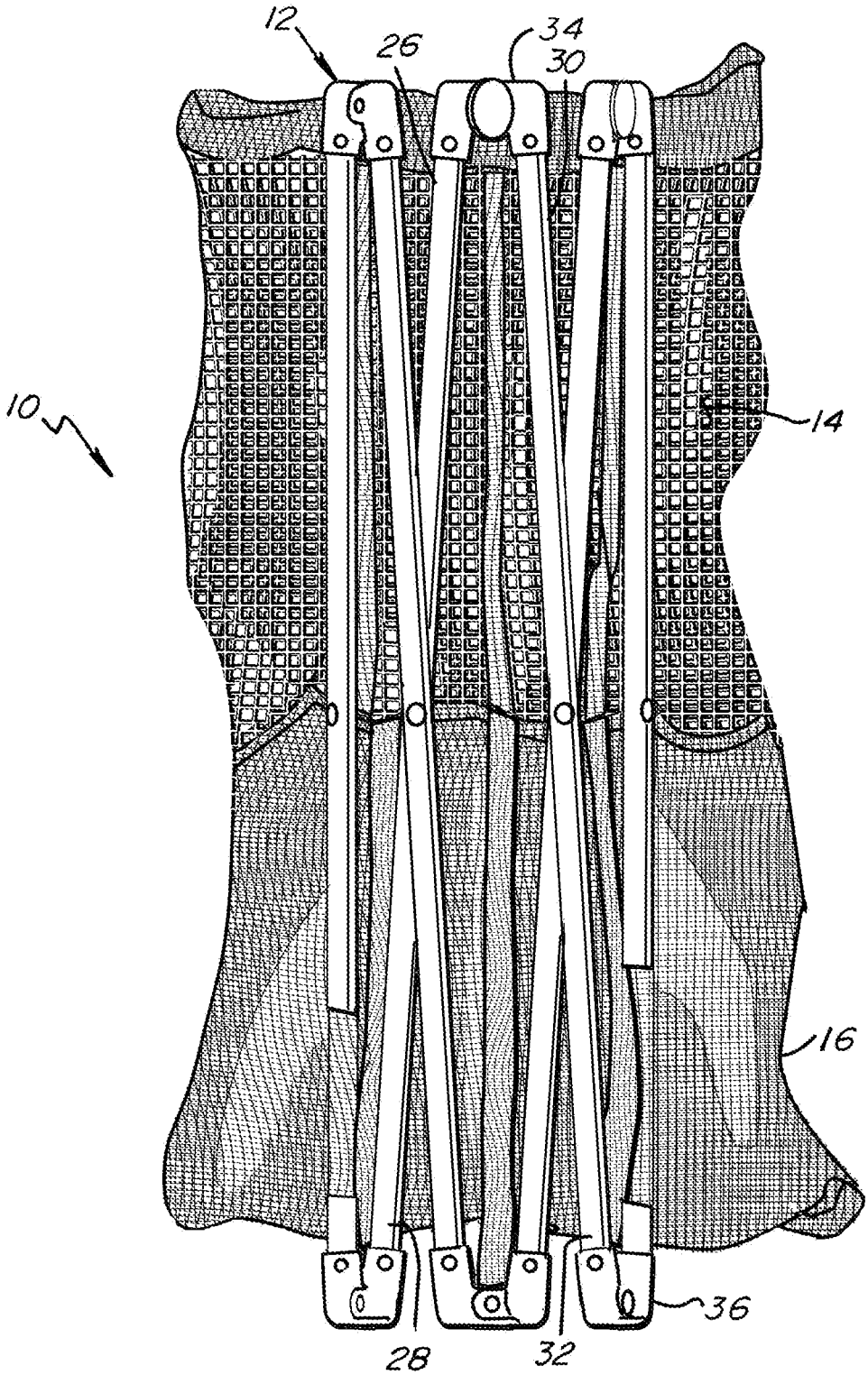
FIG. 5 is a perspective view of the playyard of FIG. 1 in a folded compact form.

To collapse the playyard 10 from the open position shown in FIG. 1 to the closed or compact position shown in FIG. 5, the two button locks 38 are pushed in, thereby permitting their respective upper junctions 34 to pivot, and further permitting the remaining four lock free upper junctions 34 to pivot and yet further permitting all six of the lock free lower junctions 36 to pivot. Then the frame 10 is simply folded further to place upper ends 26 and 30 of frame members 20, 22 adjacent to each other and to place lower ends 28 and 32 of frame members 20, 22 adjacent to each other. During this step of folding the playyard 10 from the open form to the closed or compact form, straps 52 remain fixed in place. It is not necessary to release the quick connection 76 or to disengage strap 52 from loop 64 or peripheral slot 60 or junction slot 62. During this step the slots 60 and 62 may slide along the intermediate portion 56 of the strap 52 or portions of the strap 52 slide through slots 60, 62.

To open the playyard 10 from the closed or compact form of FIG. 5 to the open form of FIG. 1, the frame members 20, 22 may grasped and pulled apart so as to pull the upper ends 26, 30 away from each other and so as to pull the lower ends 28, 32 away from each other. Subsequently, as the frame 12 attains its fully folded out form, locks 38 automatically lock, thereby fixing the frame 12 in its fully folded out position. During this step of folding the playyard 10 from the closed or compact form to the open form, straps 52 remain fixed in place. It is not necessary to release the quick connection 76 or to disengage strap 52 from loop 64 or peripheral slot 60 or junction slot 62. During this step the slots 60 and 62 may slide along the intermediate portion 56 of the strap 52 or portions of the strap 52 slide through slots 60, 62.

It should be noted that the present invention is neither limited to a playyard 10 having six sides nor limited to a playyard 10 in the shape of a hexagon. For example, one or more sidewall section 42 and respective frame section 18 combination may be added or removed from the six sided playyard 10 such that a playyard 10 according to the present invention may have four sides (four sidewall section 42/frame section 18 combinations) or five sides (five sidewall section 42/frame section 18 combinations) or seven sides (seven sidewall section 42/frame section 18 combinations) or eight sides (eight sidewall section 42/frame section 18 combinations).

As to the two upper junctions 34 that lock and unlock, U.S. Pat. No. 4,245,850 issued Jan. 20, 1981 to Boudreau and entitled Scissor Frame Lock is hereby incorporated by reference in its entirety.

Figure 7A:
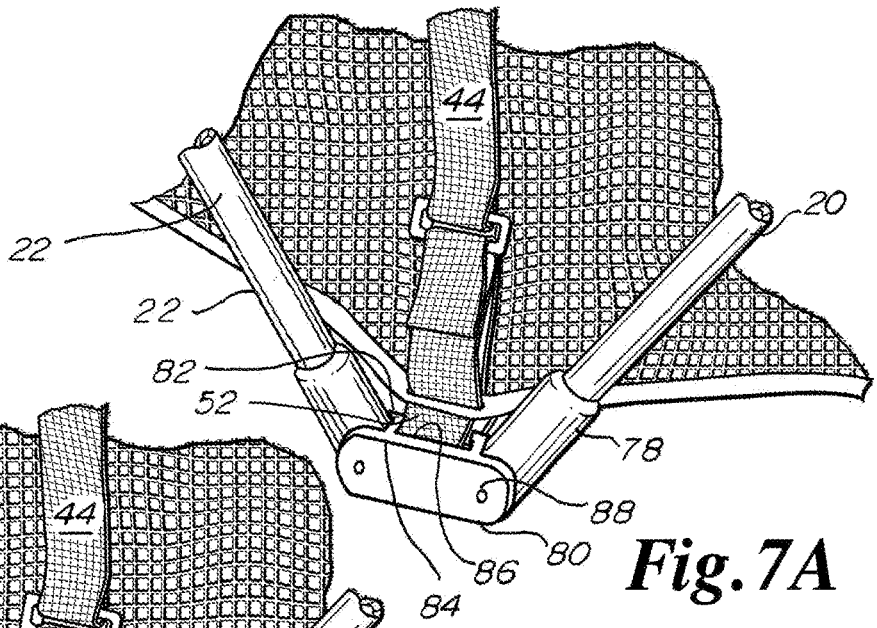
FIG. 7A shows a perspective detail view of a second embodiment of a connection between frame members at a lower junction of the playyard of FIG. 1, with the first embodiment of a connection between frame members at a lower junction being shown in FIGS. 2A and 2B.

FIG. 7A shows a perspective detail view of a second embodiment of a connection between frame members at a lower junction of the playyard of FIG. 1, with the first embodiment of a connection between frame members at a lower junction being shown in FIGS. 2A and 2B. This lower junction includes frame members 20, 22 that are pivotally joined to each other through a third piece. Each of frame members 20, 22 is received in a cylindrical female member 78. Lower ends of the female members 78 are pivotally engaged between a pair of plates 80, 82 that make up such third piece. Plates 80, 82 are set apart and engaged to each other by a number of cross members 84. Plates 80, 82 and cross members 84 form a slot 86 through which floor pulling strap 52 extends vertically. Front plate 80 includes no slot. Rear plate 82 includes a horizontally extending slot for floor pulling strap 52 at an upper portion of rear plate 82. Plates 80 and 82 lie in parallel planes. Pin 88 runs from plate 80 to plate 82 and engages female member 78 so as to pivotally engage one of the frame members 20, 22. FIG. 7A shows two cross members 82. These two cross members 82 that are shown are upper cross members 82. Two other cross members that are bottom cross members lie opposite of and below the two upper cross members. It should be noted that the plates 80, 82 may be lengthened and/or the two upper cross members 84 may be positioned closer together to better permit the frame members 20, 22 to pivoted to a position where the frame members 20, 22 are parallel to, or are close to being parallel to, each other in the compact form shown in FIG. 5. Such third piece is made up of plates 80, 82, a pair of upper cross members 84, and a pair of lower cross members. Each of base plates 80, 82 includes a generally flat or straight floor or floor portion.

Figure 7B:
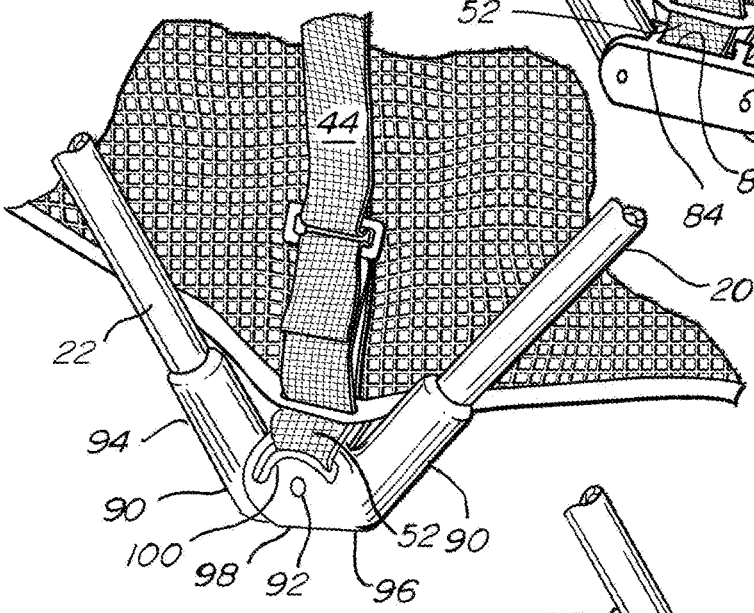
FIG. 7B shows a perspective detail view of a third embodiment of a connection between frame members at a lower junction of the playyard of FIG. 1.

FIG. 7B shows a perspective detail view of a third embodiment of a connection between frame members at a lower junction of the playyard of FIG. 1. This lower junction includes frame member 20 and frame member 22 that are directly pivotally joined to each other. This lower junction includes female members 90. Female members 90 are essentially an extension of frame members 20, 22. Female members 90 are pivotally joined to each other by a pin 92. Female member 90 is L-shaped. Female member 90 includes a cylindrical portion 94 that receives a respective frame member 20, 22. Female member 90 includes a base portion 96 that includes a generally flat or straight floor or floor portion 98. Base portion 96 includes a curved through slot 100. Slot 100 is U-shaped. Slot 100 is shaped in an inverted U. When female members 90 are placed so as to confront each other as shown in FIG. 7B, the U-shaped slots 100 align with each other such that floor pulling strap 52 can be inserted through the slots 100. Frame members 20, 22 can be pivoted to and away from each other. Frame members 20, 22 can be pivoted to a position where the frame members 20, 22 are parallel to each other or close to being parallel to each other as shown in FIG. 5.

Figure 7C:
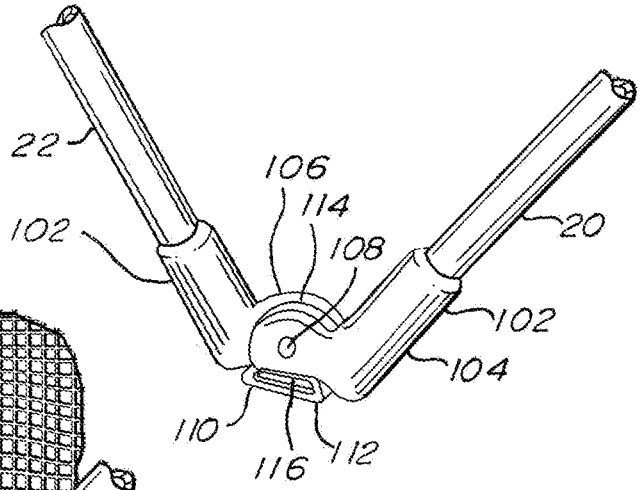
FIG. 7C shows a perspective detail view of a fourth embodiment of a connection between frame members at a lower junction of the playyard of FIG. 1 without showing soft components, such as the mesh sidewall, of the playyard.
Figure 7D:
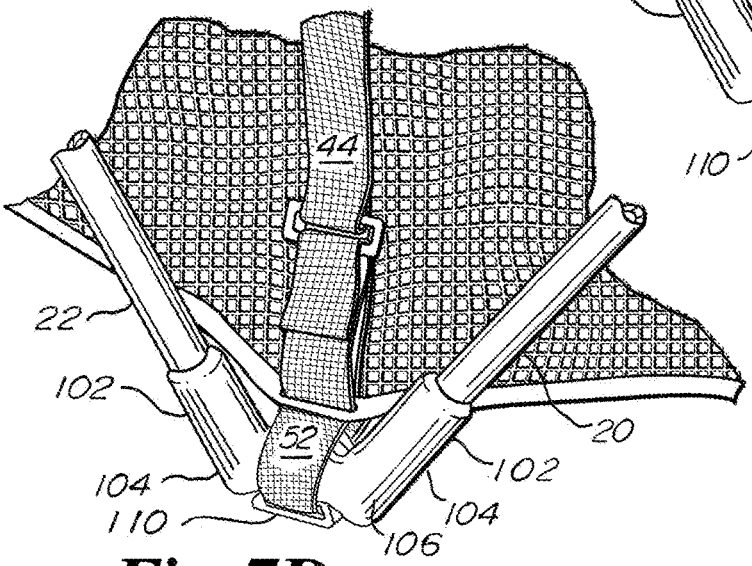
FIG. 7D shows a perspective detail view of the fourth embodiment of the connection between frame members of FIG. 7C and further shows portions of soft components of the playyard.

FIG. 7C shows a perspective detail view of a fourth embodiment of a connection between frame members at a lower junction of the playyard of FIG. 1 without showing soft components, such as the mesh sidewall, of the playyard. FIG. 7D shows a perspective detail view of the fourth embodiment of the connection between frame members of FIG. 7C and further shows portions of soft components of the playyard. In this embodiment, each of the lower ends of frame members 20, 22 are received in L-shaped female members 102. Each of the female members 102 includes a cylindrical portion 104 and a base portion 106. The base portions 106 are pivotally joined by a pin 108 such that the frame members 20, 22 can swing relative to each other. A T-shaped piece 110 is pinched between the base portions 106. T-shaped piece 110 includes a horizontally extending slot forming portion 112 and a vertically extending plate portion 114. Vertically extending plate portion 114 is pinched between base portions 106 and pin 108 extends through the vertically extending plate portion 114. Upper edges of the vertically extending plate portion 114 and base portions 106 are rounded and are generally flush with one another. Slot forming portion 112 includes a slot 116. Slot 116 is a through slot having a front open end and a rear open end. Floor pulling strap 52 is fed through slot 116. Slot forming portion 112 includes a generally flat or straight floor for providing stability for the playyard 10 in the open and operating form shown in FIG. 1 and the compact and folded form shown in FIG. 5.

Figure 8A:
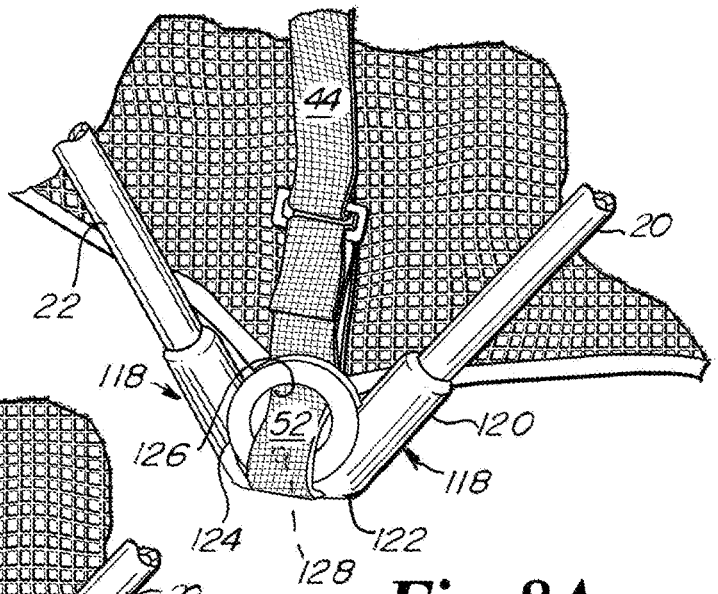
FIG. 8A shows a perspective detail view of a fifth embodiment of a connection between frame members at a lower junction of the playyard of FIG. 1.

FIG. 8A shows a perspective detail view of a fifth embodiment of a connection between frame members at a lower junction of the playyard of FIG. 1. In this embodiment each of the lower ends of frame members 20, 22 is received in a respective female member 118. Female member 118 includes a cylindrical portion 120 and a base portion 122. Base portion 122 includes a loop 124 forming an opening 126. Base portions 122 are pivotally joined to each other by a pin 128, shown in phantom in FIG. 8A, such that frame members 20, 22 swing relative to each other. Pin 128 extends through a lower portion of each of the loops 124. Openings 126 of respective female members 118 are aligned with each other. When the frame members 20, 22 are swung away from each other such that the playyard 10 is in the open and operating form shown in FIG. 1, lower ends of the cylindrical portion engage the floor or other surface on which the playyard 10 rests. In this position, the bottom faces of the base portions 124 extend obliquely upwardly to provide a space between the bottom faces and the floor of the environment for the floor pulling strap 52 that places tension on the floor 16 of the playyard 10.

Figure 8B:
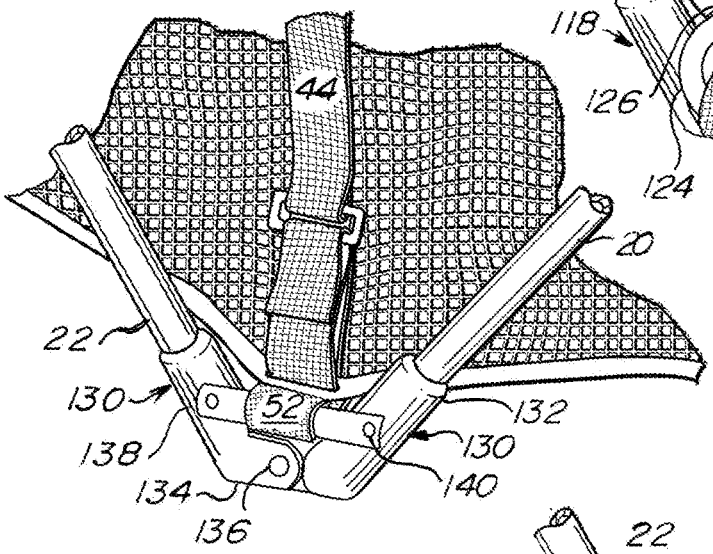
FIG. 8B shows a perspective detail view of a sixth embodiment of a connection between frame members at a lower junction of the playyard of FIG. 1.

FIG. 8B shows a perspective detail view of a sixth embodiment of a connection between frame members at a lower junction of the playyard of FIG. 1. In this embodiment lower ends of the frame members 20 and 22 are received in respective L-shaped female members 130. Each of the female members 130 includes a cylindrical portion 132 for receiving a respective frame member 20, 22 and a base portion 134. Base portions 134 are pivotally interconnected by a pin 136. Each of the cylindrical portions 132 extends fully to the environmental floor. In other words, base portion 134 extends integrally from a side of cylindrical portion 132. Base 134 includes a flat or straight bottom face and the distal end of cylindrical portion 132 includes a flat or straight bottom face and such flat or straight bottom faces confront the environmental floor when the playyard is in the open and operating form shown in FIG. 1. Base portion 134 has a thickness (in the axial direction of pin 136) less than the thickness (in the axial direction of pin 136) of the cylindrical portion 132 such that when base portions 134 confront each other, both female members 130 lie within two parallel planes disposed apart by the thickness of a single female member 130. This embodiment further includes a resilient or elastic strip 138. Each of the ends of strip 138 is pinned by a pin 140 to the front face of a respective female member 130. Strip 138 resiliently bends, such as outwardly, when the frame members 20, 22 pivot from the open position of FIG. 1 to the folded position of FIG. 5. A slot or opening for floor pulling strap 52 is formed between strip 138 and the upper faces of base portions 134. Floor pulling strap 52 winds about strip 138.

Figure 8C:
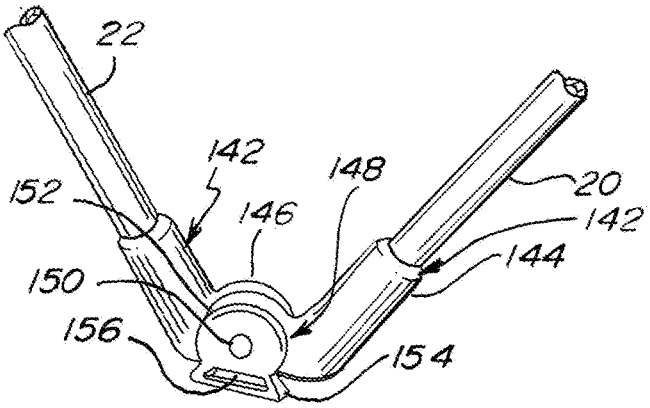
FIG. 8C shows a perspective detail view of a seventh embodiment of a connection between frame members at a lower junction of the playyard of FIG. 1 without showing soft components, such as the mesh sidewall, of the playyard.
Figure 8D:
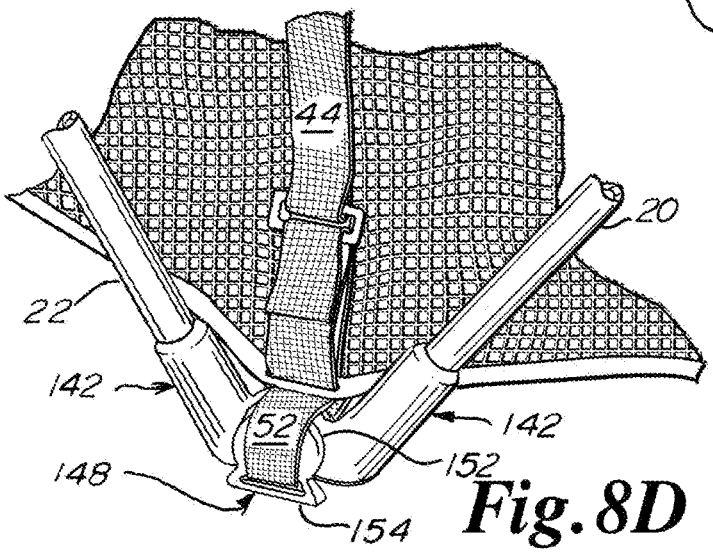
FIG. 8D shows a perspective detail view of the seventh embodiment of the connection between frame members of FIG. 8C and further shows portions of soft components of the playyard.

FIG. 8C shows a perspective detail view of a seventh embodiment of a connection between frame members at a lower junction of the playyard of FIG. 1 without showing soft components, such as the mesh sidewall, of the playyard. FIG. 8D shows a perspective detail view of the seventh embodiment of the connection between frame members of FIG. 8C and further shows portions of soft components of the playyard. In this embodiment lower ends of frame members 20, 22 are received in female members 142. Each of the female members 142 includes a cylindrical portion 144 that receives the lower end of a respective frame member 20, 22 and a base portion 146. This embodiment further includes a slotted keyhole shaped piece 148. Slotted piece 148 and base portions 146 are all pivotally engaged together by a pin 150. Slotted piece 148 includes a disc shaped portion 152 having a diameter that is generally the same as the diameter of base portions 146. Slotted piece 148 further includes a C-shaped or U-shaped portion 154 that forms a slot 156 with disc shaped portion 152. The thickness of base portion 146 (in the axial direction of pin 150) is less than the thickness (in the axial direction of pin 15) of cylindrical portion 144 to minimize space at such lower junction. The combined thickness (in the axial direction of pin 150) of disc shaped portion 152 and base portions 146 may be about the thickness (in the axial direction of pin 150)

of one cylindrical portion 144. The upper curved faces of disc shaped portion 152 and base portions 146 are generally aligned or flush with one another. The bottom face of the U-shaped portion 154 of piece 150 is straight or flat to provide stability to the playyard 10 in both the open form of FIG. 1 and the folded or closed form of FIG. 5. As shown in FIG. 8D, slot 156 receives the floor pulling strap 52.

Figure 9A:
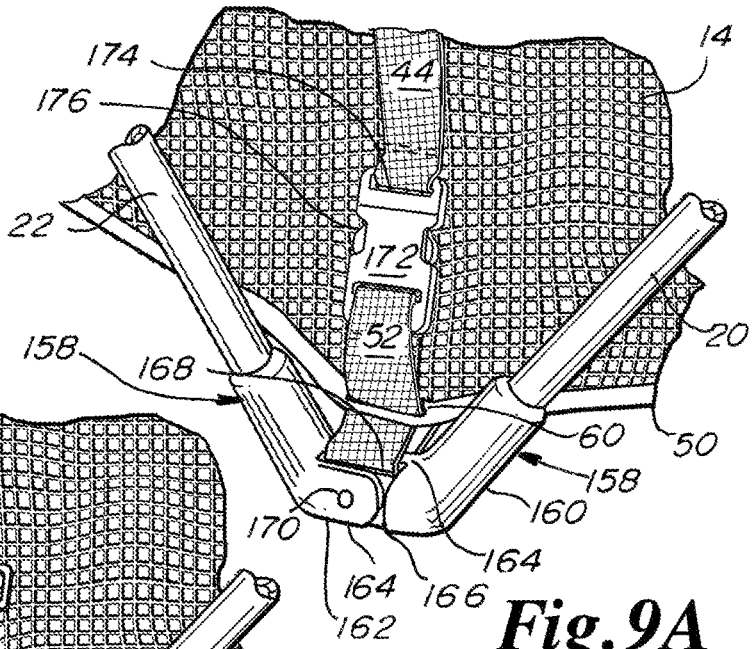
FIG. 9A shows a perspective detail view of second embodiment of a connection for the floor pulling strap at a lower junction of the playyard of FIG. 1, with the first embodiment of the connection for the floor pulling strap being shown in FIGS. 2A, 2B and 3.

FIG. 9A shows a perspective detail view of the first embodiment of the connection between frame members at a lower junction, with this first embodiment also being shown in FIGS. 1 to 6. In this first embodiment of such connection at the lower junction, such pivotal connection between frame members 20 and 22 is the same as the pivotal connection shown in FIGS. 1 to 6. In this pivotal connection, each of the lower ends of frame members 20, 22 is received in a female member 158. Each of the female members includes a cylindrical portion 160 for receiving the lower end of a respective frame member 20, 22 and a base portion 162. Each of the base portions 162 includes a pair of first and second prongs 164, 166. First prong 164 extends from a side face of base portion 162 and the second prong 166 is inset from an opposite side face of base portion 162. The inner face of prong 166 of frame member 20 and the inner face of prong 166 of frame member 22 form a slot 168 for the floor pulling strap 52. A first pin 170 extends through the first prong 164 of frame member 22 and the second prong 166 of frame member 20. A second pin extends through the second prong 166 of frame member 22 and the first prong of frame member 20. Bottom faces of base portions 162, including bottom faces of first and second prongs 164, 166, are flat or straight to provide stability for the playyard 10 relative to a surface on which the playyard 10 rests in the open and operating form shown in FIG. 1. Slot 168 is a vertically extending slot with an open bottom end and an open top end.

FIG. 9A also shows a perspective detail view of second embodiment of a connection for the floor pulling strap at a lower junction of the playyard of FIG. 1, with the first embodiment of the connection for the floor pulling strap being shown in FIGS. 2A, 2B and 3. In this second embodiment, the proximal end of strap 52 is engaged to one buckle piece 172 and a lower portion of elongate strip 44 is engaged to a second buckle piece 174. It should be noted that elongate strip 44 extends from between top horizontal strip 48 and bottom horizontal strip 50. Buckle piece 172 includes a female portion for a male portion of buckle piece 174. Proximal end of strap 52 is fed through a slot formed in buckle piece 172, wound about a post of buckle piece 172 and engaged back onto itself. A lower end portion of elongate strip 44 is not stitched to sidewall 14 and free of the sidewall 14, is fed through a slot formed in buckle piece 174, is wound partially about a post of buckle piece 174, is reattached to mesh sidewall 14, and continues downwardly to bottom horizontal strip 50. Buckle pieces 172, 174 form a quick release buckle. Buckle piece 174 includes resilient arms that, when pinched together, releases buckle piece 174 from buckle piece 172. Buckle piece 172 is sufficiently small in width and thickness to slip through slot 60 formed in the peripheral horizontal strip 50.

Figure 9B:
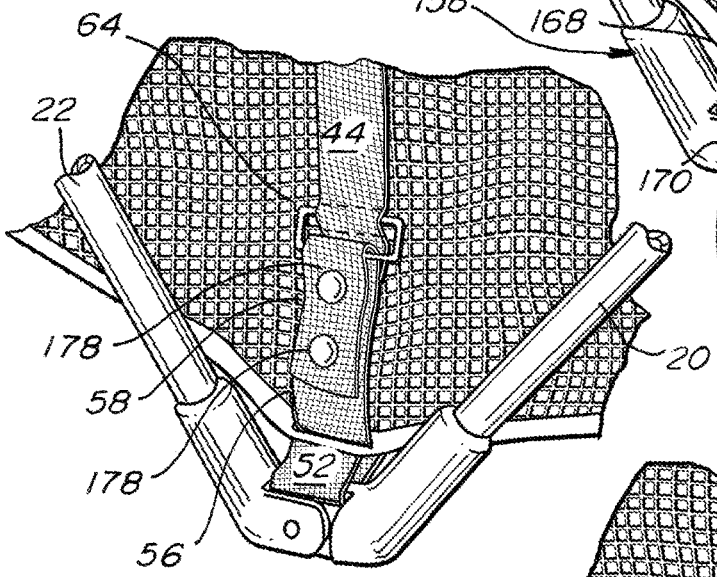
FIG. 9B shows a perspective detail view of a third embodiment of a connection for the floor pulling strap at a lower junction of the playyard of FIG. 1.

FIG. 9B shows a perspective detail view of a third embodiment of a connection for the floor pulling strap at a lower junction of the playyard of FIG. 1. This embodiment includes rectangular loop 64 of rigid material such as metal or plastic. A lower end portion of elongate strip 44 is not stitched to sidewall 14, is free of the sidewall 14, is fed through rectangular loop 64, is wound partially about top horizontal member of loop 64, is reattached to mesh sidewall 14, and continues downwardly to bottom horizontal strip 50. Proximal end 58 of floor pulling strap 52 includes a pair of first snap portions or first quick release button portions 178. Intermediate portion 56 of floor pulling strap 52 includes a pair of second snap portions or second quick release button portions that engage the first snap portions or quick release button portions 178. Floor pulling strap 52 engages the bottom horizontal member of loop 64. Proximal end 58 with first snap portions 178 is pulled through the loop 64 and then snapped down on the second snap portions that are engaged to the intermediate portion 56 of floor pulling strap 52. Each of the first snap portions 178 and second snap portions are sufficiently small in width and thickness to fit though slot 60 of bottom horizontal strip 50. Elongate strip 44 extends from top horizontal strip 48 to bottom horizontal strip 48.

Figure 9C:
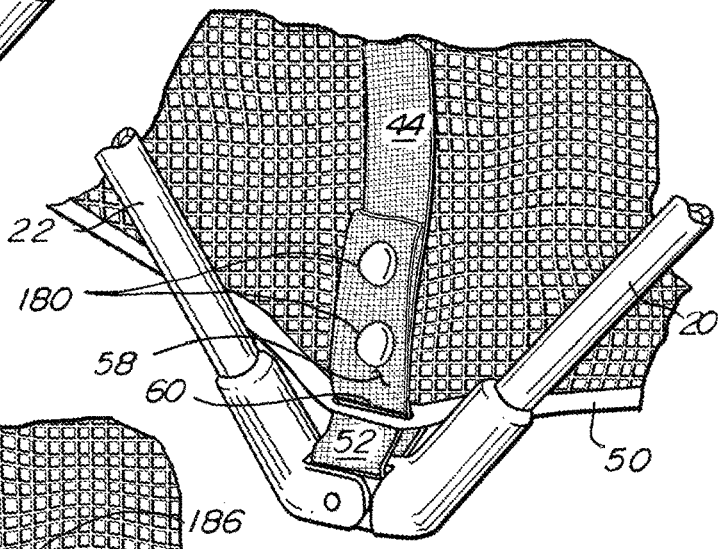
FIG. 9C shows a perspective detail view of a fourth embodiment of a connection for the floor pulling strap at a lower junction of the playyard of FIG. 1.

FIG. 9C shows a perspective detail view of a fourth embodiment of a connection for the floor pulling strap at a lower junction of the playyard of FIG. 1. In this embodiment, as in all embodiments unless mentioned otherwise, vertical elongate strip 44 extends from top horizontal strip 48 to bottom horizontal strip 50. Floor pulling strap 52 includes proximal end 58 that includes a pair of first snap portions or quick release button portions 180 that connect to a pair of second snap portions or quick release button portions which are engaged by the elongate strip 44. The size of the first snap portions 180, including thickness and width, is sufficiently small such that proximal end 58 including first snap portions 180 may slip through slot 60.

Figure 9D:
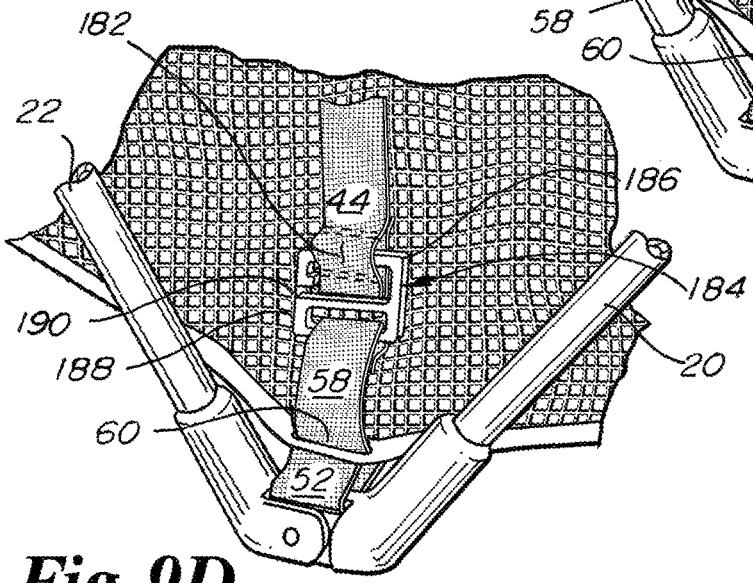
FIG. 9D shows a perspective detail view of a fifth embodiment of a connection for the floor pulling strap at a lower junction of the playyard of FIG. 1.

FIG. 9D shows a perspective detail view of a fifth embodiment of a connection for the floor pulling strap at a lower junction of the playyard of FIG. 1. Vertical strip 44 extends from the top horizontal strip 48 to the bottom horizontal strip 50. A lower end free portion 182 of elongate strip 44 is not stitched to sidewall 14 and is free of the sidewall 14. The elongate strip 44 is attached to mesh sidewall 14 on either end of free portion 182, extends upwardly therefrom to the top horizontal strip 48, and extends downwardly therefrom to bottom horizontal strip 50. A quick connect and release fork or buckle 184 includes an open loop 186 and a closed loop 188. Open loop 186 engages free portion 182 of elongate strip 44. Proximal end 58 of floor pulling strap 52 is inserted through closed loop 188, wound about the lower horizontal member of loop 188, and stitched back to itself such that fork 184 is permanently attached to the floor pulling strap 52. The size including the thickness and width of fork 184 is sufficiently small to permit the fork 184 to pass through slot 60. Open loop 186 includes a slot 190 through which free portion 182 enters and exits open loop 186.

Figure 10A:
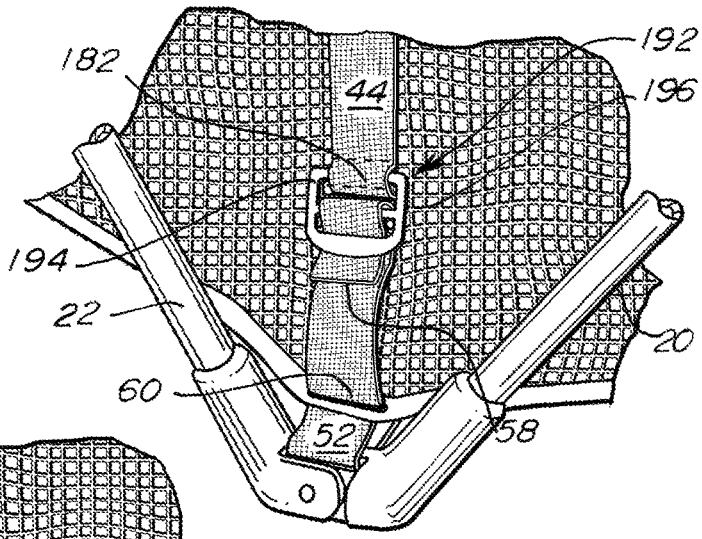
FIG. 10A shows a perspective detail view of a sixth embodiment of a connection for the floor pulling strap at a lower junction of the playyard of FIG. 1.

FIG. 10A shows a perspective detail view of a sixth embodiment of a connection for the floor pulling strap at a lower junction of the playyard of FIG. 1. Vertical strip 44 extends from the top horizontal strip 48 to the bottom horizontal strip 50. A lower end free portion 182 of elongate strip 44 is not stitched to sidewall 14 and is free of the sidewall 14. The elongate strip 44 is attached to mesh sidewall 14 on either end of free portion 182, extends upwardly therefrom to the top horizontal strip 48, and extends downwardly therefrom to bottom horizontal strip 50. A buckle 192 is engaged to free portion 182. Buckle 192 includes a first loop 194 and a second loop 196. Free portion 182 extends about the upper member of buckle 192 and then extends through the first loop 194. Proximal end 58 of floor pulling strap 52 may extend up through the first loop 194, then about the intermediate member of the buckle 192, and then down through the second loop 196, whereupon the proximal end 58 can be pulled tightly. This embodiment thus permits one to lengthen or shorten floor pulling strap 52 and/or to adjust the tightness of the floor pulling strap 52. Proximal end 58 can be slipped through slot 60. Buckle 192 is engaged permanently in the free portion 182.

Figure 10B:
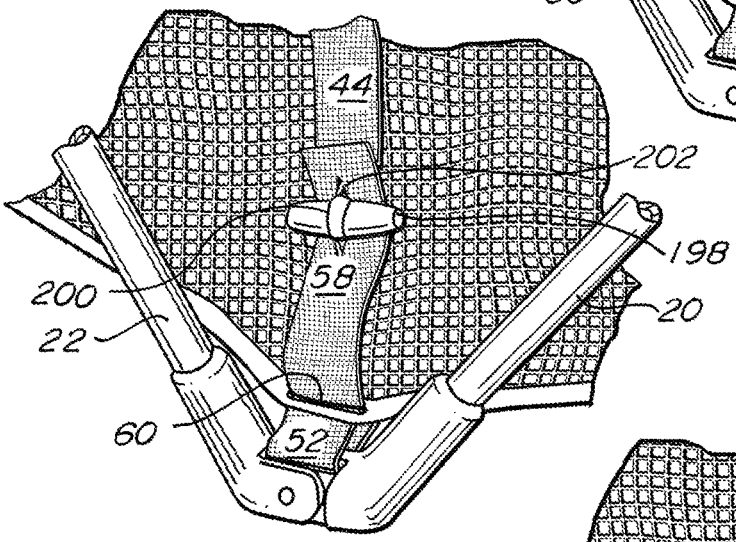
FIG. 10B shows a perspective detail view of a seventh embodiment of a connection for the floor pulling strap at a lower junction of the playyard of FIG. 1.

FIG. 10B shows a perspective detail view of a seventh embodiment of a connection for the floor pulling strap at a lower junction of the playyard of FIG. 1. Vertical elongate strip 44 extends from the top horizontal strip 48 to the bottom horizontal strip 50. A button 198 is engaged to the vertical strip 44. Button 198 is a wood dowel button that tapers in a frustoconical manner from the middle toward each of the ends. Button 198 is affixed to the elongate strip 44 with a tie 200 such that the button 198 can spin. Proximal end 58 of floor pulling strap 52 includes a slot 202. Slot 202 extends in the longitudinal direction of floor pulling strap 52 so as to extend in the vertical direction when proximal end 58 is engaged to button 198. Button 198 is a quick connect and disconnect button 198. When button 198 is in a horizontal or transverse or lateral position relative to slot 202 and floor pulling strap 52, then the floor pulling strap 52 is engaged to the elongate strip 44 and the mesh sidewall 14 of the playyard 10. To disengage the button 198, the button 198 is spun to a longitudinal position and one of the tapered ends of the button 198 can be slipped into the slot 202, wherein the proximal end 58 can be lifted off the button 198. Proximal end 58 can be slid through slot 60 of the bottom horizontal strip 50.

Figure 10C:
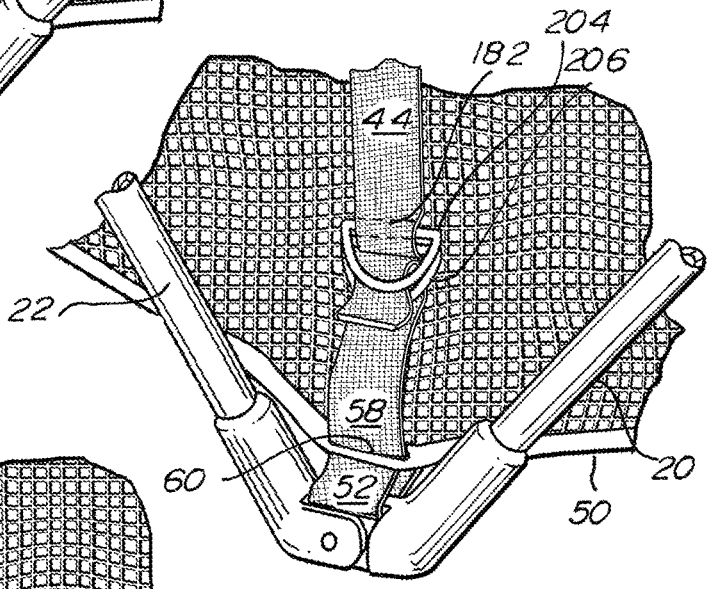
FIG. 10C shows a perspective detail view of an eighth embodiment of a connection for the floor pulling strap at a lower junction of the playyard of FIG. 1.

FIG. 10C shows a perspective detail view of an eighth embodiment of a connection for the floor pulling strap at a lower junction of the playyard of FIG. 1. Vertical strip 44 extends from the top horizontal strip 48 to the bottom horizontal strip 50. A lower end free portion 182 of elongate strip 44 is not stitched to sidewall 14 and is free of the sidewall 14. The elongate strip 44 is attached to mesh sidewall 14 on either end of free portion 182, extends upwardly therefrom to the top horizontal strip 48, and extends downwardly therefrom to bottom horizontal strip 50. This embodiment includes a pair of D-rings 204, 206. Each of the D-rings 204, 206 is permanently engaged in the free portion 182 of the elongate strip 44. Proximal end strap portion 58 of floor pulling strap 52 is fed first through D-ring 206, then through D-ring 204, then around D-ring 204, then down through D-ring 206, whereupon the proximal end strap portion 58 may be grabbed and pulled to tighten floor pulling strap 52. D-rings 204, 206 are a quick connect and quick disconnect attachment mechanism. To release the proximal end strap portion 58, the bite between the curved ring portions of D-rings 204, 206 are loosened and the proximal end strap portion 58 is pulled out from between the curved ring portions of the D-rings 204, 206. Proximal end strap portion 58 can be fed through slot 60.

Figure 10D:
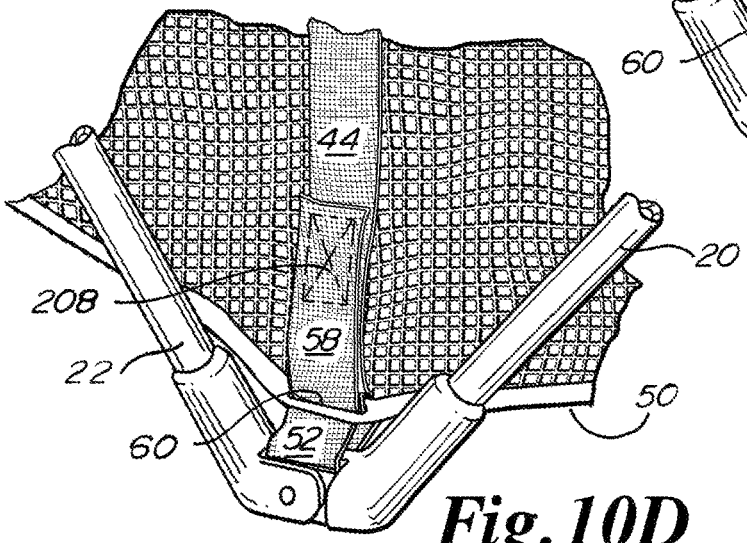
FIG. 10D shows a perspective detail view of a ninth embodiment of a connection for the floor pulling strap at a lower junction of the playyard of FIG. 1.

FIG. 10D shows a perspective detail view of a ninth embodiment of a connection for the floor pulling strap at a lower junction of the playyard of FIG. 1. Vertical strip 44 extends from the top horizontal strip 48 to the bottom horizontal strip 50. Proximal end strap portion 58 includes, on its inner face or underside, a strip of hook and/or loop material 208, such as Velcro®. Vertical strip 44 includes, on its upper face, a cooperating strip of hook and/or loop material, such as Velcro®. This embodiment, with the inclusion of such hook and loop material, is a quick connect and quick disconnect attachment mechanism for quick engagement and disengagement of the floor pulling strap 52 relative to the side of the playyard 10. Proximal end strap portion 58, including hook and/or loop material 208, can be fed through slot 60.

Figure 11A:
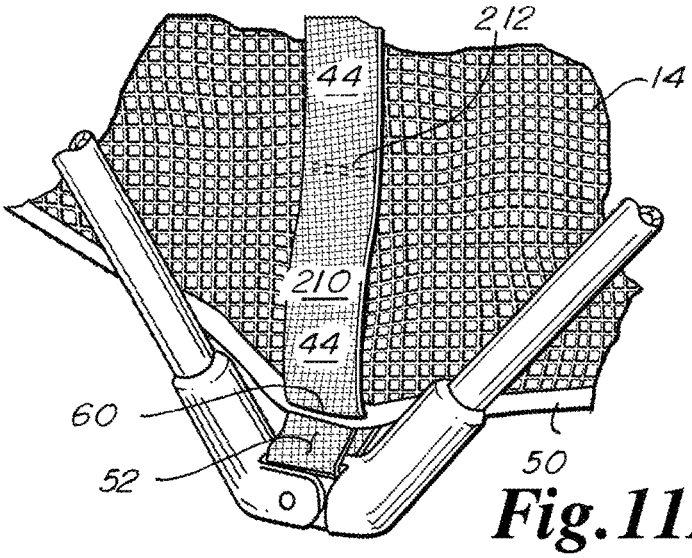
FIG. 11A shows a perspective detail view of a tenth embodiment of a connection for the floor pulling strap at a lower junction of the playyard of FIG. 1.

FIG. 11A shows a perspective detail view of a tenth embodiment of a connection for the floor pulling strap at a lower junction of the playyard of FIG. 1. In this embodiment, vertical strip 44 is integral and one-piece with floor pulling strip 52. Vertical strip 44 may have a portion 210 that may or may not be engaged to mesh sidewall 14. If portion 210 is not engaged to mesh sidewall 14, then the portion of the elongate strip 44 below stitching 212 is the portion 210 that is not engaged to the mesh sidewall 14 and the portion of the elongate strip 44 that is engaged to the mesh sidewall 14 is above stitching 212. If the entire length of the elongate strip 44 is engaged to the mesh sidewall 14, then there is no stitching 212. When the entire length of the elongate strip 44 is engaged to the mesh sidewall 14, the elongate strip 44 can be engaged immediately above slot 60. When less than the entire length of the elongate strip 44 is engaged to the mesh sidewall 14, stitching 212 may be placed an inch above strip 50, or two inches above strip 50, or three inches above strip 50, or at some location between about 0.0 inches above strip 50 and about 12 inches above strip 50. It should be noted that stitching 212 may not be needed as a transition between engaged and nonengaged portions of elongate strip 44 that are or are not engaged to sidewall 14. Elongate strip 44 may be glued or welded or otherwise affixed to sidewall 14.

Figure 12A:
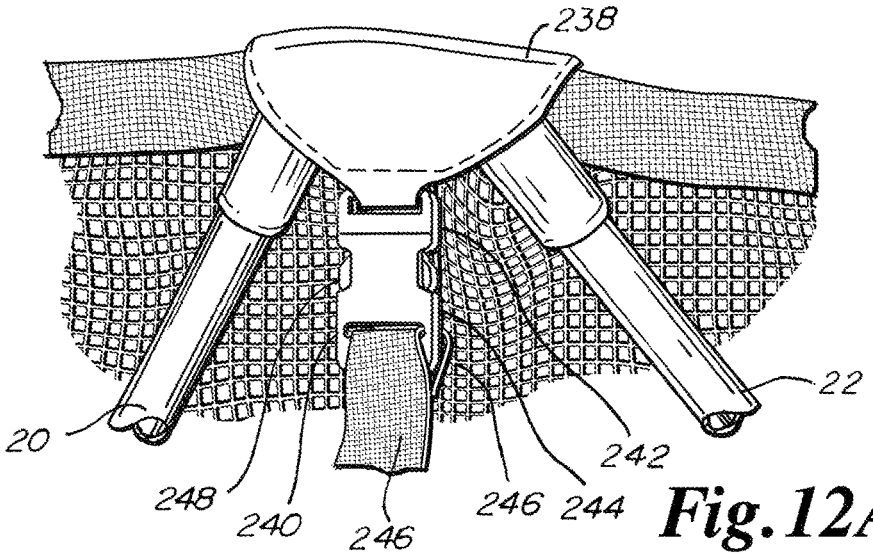
FIG. 12A shows a perspective detail view of a fourth embodiment of a connection for the side of the playyard to an upper junction of the playyard of FIG. 1.
Figure 12B:
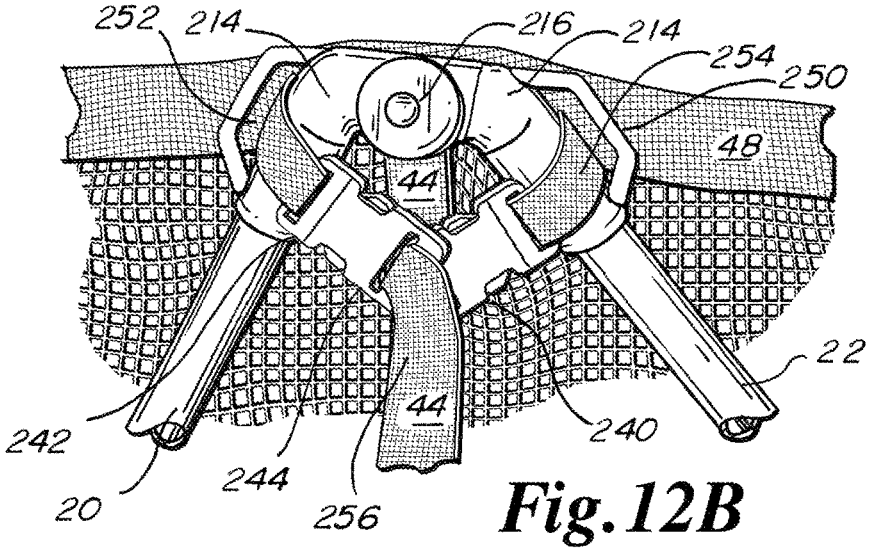
FIG. 12B shows a perspective detail view of a fifth embodiment of a connection for the side of the playyard to an upper junction of the playyard of FIG. 1.
Figure 12C:
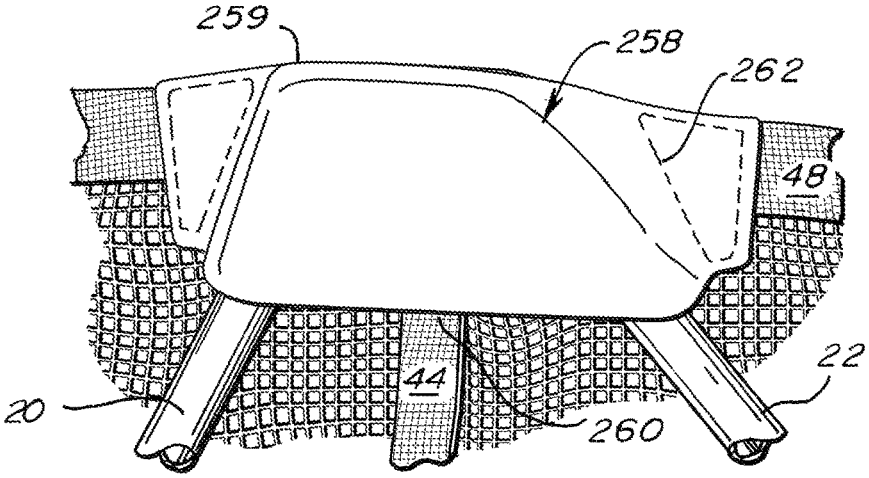
FIG. 12C shows a perspective detail view of a sixth embodiment of a connection for the side of the playyard to an upper junction of the playyard of FIG. 1.
Figure 13A:
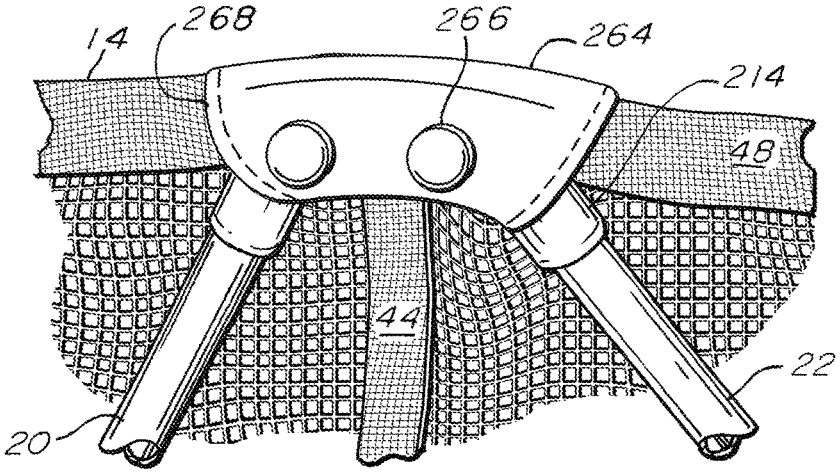
FIG. 13A shows a perspective detail view of a seventh embodiment of a connection for the side of the playyard to an upper junction of the playyard of FIG. 1.
Figure 13B:
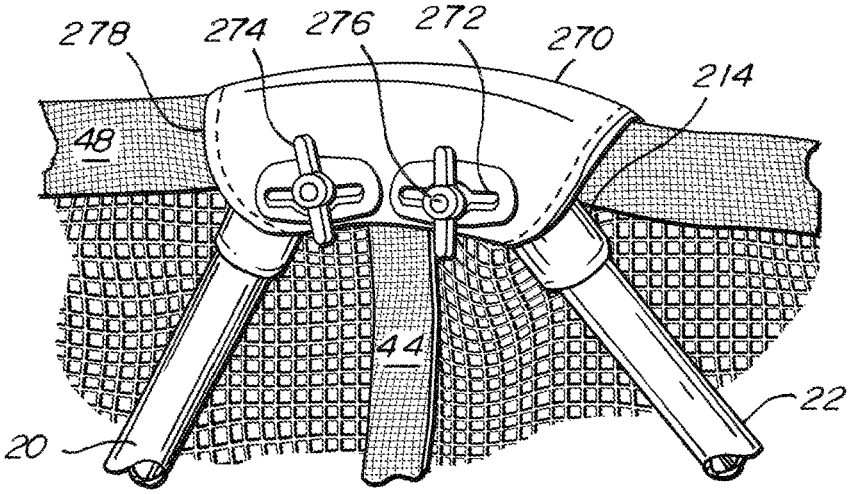
FIG. 13B shows a perspective detail view of an eighth embodiment of a connection for the side of the playyard to an upper junction of the playyard of FIG. 1.
Figure 13C:
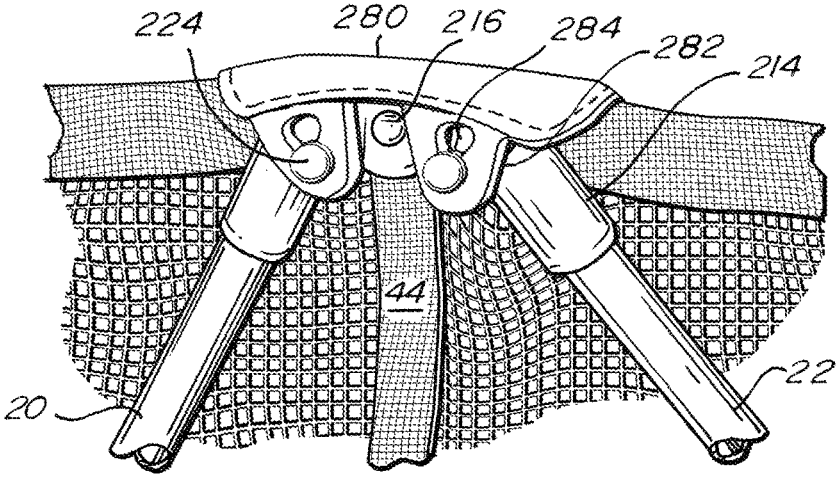
FIG. 13C shows a perspective detail view of a ninth embodiment of a connection for the side of the playyard to an upper junction of the playyard of FIG. 1.
Figure 14A:
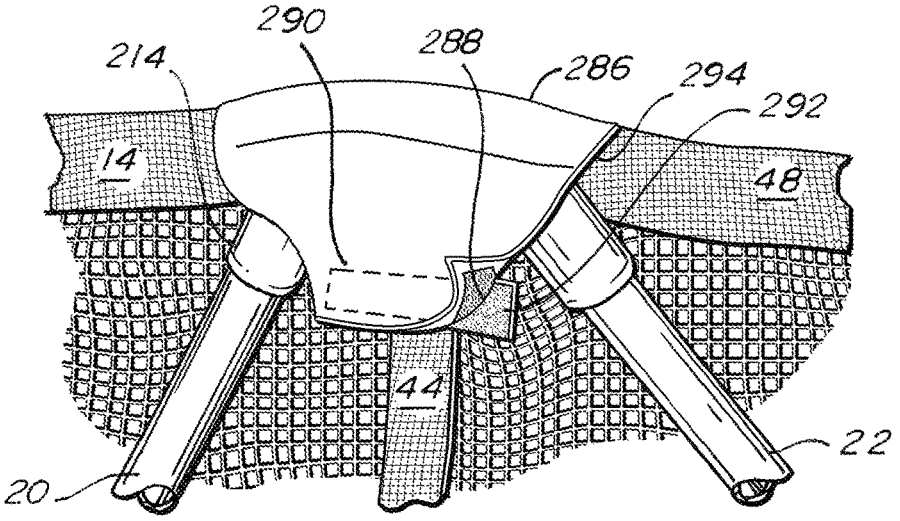
FIG. 14A shows a perspective detail view of a tenth embodiment of a connection for the side of the playyard to an upper junction of the playyard of FIG. 1.
Figure 14B:
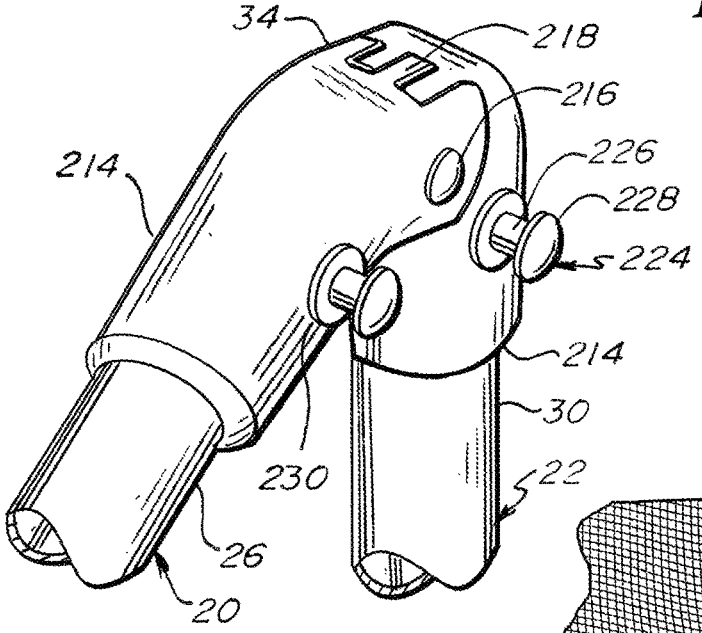
FIG. 14B shows a perspective detail view of an eleventh embodiment of a connection for the side of the playyard to an upper junction of the playyard of FIG. 1 without showing soft components, such as the mesh sidewall, of the playyard.

FIGS. 11B, 11C, 12A, 12B, 12C, 13A, 13B, 13C, 14A, 14B, and 14C relate to how the soft components of the playyard 10 connect to or engage the upper junctions 34. An upper junction 34 may take a number of forms. An upper junction 34 is essentially a pivoting or swinging connection between frame member 20 and frame member 22 or, more specifically, a pivoting or swinging connection between the upper end 26 of frame member 20 and the upper end of frame member 22. As shown in FIG. 14B, each of the frame members 20, 22 includes a receptor 214 having a cylindrical portion for receiving the upper ends 26, 30 of the frame members 20, 22. The receptors 214 are joined by a pivot pin 216. Receptor 214 includes an end 218 that is forked such that the receptors 214 interlock or mesh with one another to minimize twisting or spinning of the frame members 20, 22 relative to one another. The forks of end 218 extend in the axial or longitudinal direction. Pivot pin 216 extends in the lateral direction and extends through the forks of end 218.

Figure 11B:
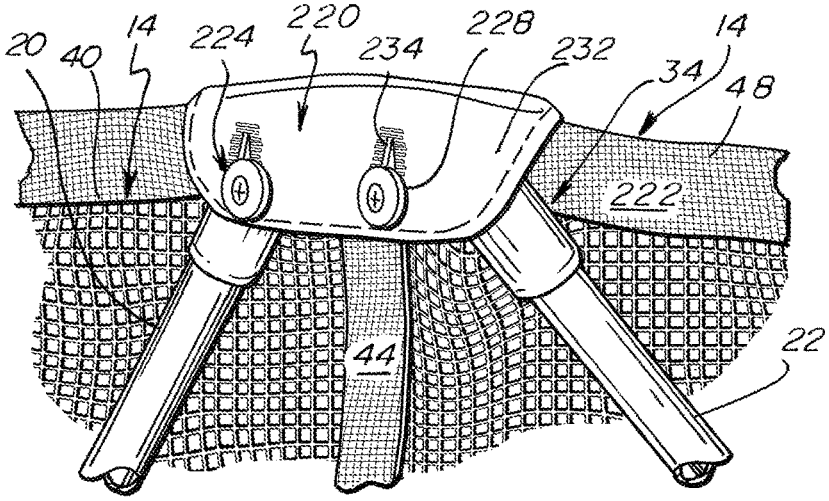
FIG. 11B shows a perspective detail view of a second embodiment of a connection for the side of the playyard to an upper junction of the playyard of FIG. 1, with the first embodiment of the connection for the side of the playyard to an upper junction being shown in FIG. 1.

FIG. 11B shows a perspective detail view of a second embodiment of a connection for the side of the playyard to an upper junction 34 of the playyard of FIG. 1, with the first embodiment of the connection for the side of the playyard 10 to an upper junction being shown in FIG. 1. In the FIG. 11B embodiment, a U-shaped piece 220 of flexible material, such as a fabric material, extends from an inner face of upper horizontal piece 48 and then around to an outer face of upper junction 34. Inner face of upper horizontal piece 48 is opposite to an outer face 222 of upper horizontal piece 48. The U-shaped piece 220 is engaged to the upper horizontal piece 48 and is further engaged to the upper junction 34 by a pair of rigid buttons 224. Rigid button 224 extends outwardly from receptor 214, as shown in FIG. 14B. Rigid buttons 224 are disposed on the outside of playyard 10, away from an inside of playyard 10 where the rigid buttons 224 would otherwise extend into the inside playing area of the playyard 10. Button 224 includes a rigid central shaft 226 and a rigid head 228 at the distal end of the rigid central shaft. A proximal end of the rigid central shaft rises from a boss 230 that in turn rises slightly from a surface of receptor 214. Each of the frame members 20, 22 includes one rigid button 224. U-shaped piece 220 includes an inner flap and an outer flap 232. Outer flap 232 includes a pair of vertical slots 234 that engage buttons 224. Outer flap 232 may have a length on the short side such that, when buttons 224 are engaged in slots 234, the outer flap 232 retreats upwardly and inwardly such that the shafts 226 confront lower ends of the slots 234 to minimize the chances that buttons 224 unintentionally slip out of the slots 234. Flap 232 is taut in the position shown in FIG. 11B where the shafts 226 are in the lower ends of the slots 234. In the position shown in FIG. 11B, an outer face 222 of upper horizontal piece 48 confronts an inner face of upper junction 34. Upper horizontal piece 48 is pinched between the inner flap of U-shaped piece 220 and the upper junction 34. The provisions of the rigid button 224 and 234 provide a quick connect and quick disconnect mechanism between the sidewall 14 and upper junction 34.

Figure 11C:
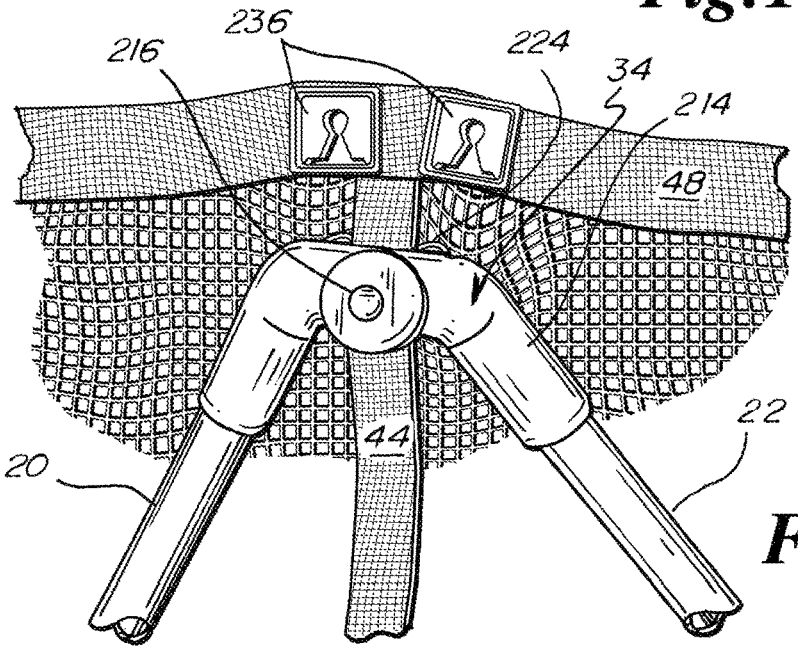
FIG. 11C shows a perspective detail view of a third embodiment of a connection for the side of the playyard to an upper junction of the playyard of FIG. 1.

FIG. 11C shows a perspective detail view of a third embodiment of a connection for the side of the playyard to an upper junction 34 of the playyard of FIG. 1. In the view shown in FIG. 14B, rigid button 224 is on an outside face of the upper junction 34. In the embodiment of FIG. 11C, rigid button 224 is on an inside face of upper junction 34. Receptors 214 for the upper ends 26, 30 of the frame members 20, 22 include a cylindrical portion and a base portion. Receptors 214 are L-shaped with the cylindrical portion, where the cylindrical portions receive the upper ends 26, 30 and where the base portions are joined by a pivot pin 216. Base portions are aligned in a straight line with each other when the playyard 10 is in the open position as shown in FIG. 1. Base portions share a common axis. Each of the rigid buttons 224 is engaged to an inside face of one of the base portions. Rigid buttons 224 extend inwardly from the base portion to which it is engaged. Each of the rigid buttons 224 engages a key slot receiver 236 that is engaged to the outer face of upper horizontal piece 48. Key slot receiver 236 is a molded plastic piece. Key slot receiver 236 includes a rectangular back piece that confronts and is engaged to the outer face of upper horizontal piece 48 and a front piece that opposes and is spaced from the rectangular back piece. This front piece of the key slot receiver 236 includes a first opening formed by tapering edges, which tapering edges taper toward each other as the tapering edges extend vertically. This front piece of the key slot receiver 236 includes a second opening that is circular. The first and second openings communicate with each other. The first opening leads into the second opening. The key slot receiver 236 includes a bottom opening or slot and is defined by a lower edge of the rectangular back piece and the lower edge of the front piece of the key slot receiver 236. To engage the sidewall 14 to the upper junction 34 in this embodiment, the key slot receivers 235 are slid onto the rigid buttons 224. The tapering edges of the first opening guide the shaft of the rigid button 224 into the circular second opening, whereupon the head of the rigid button 224 cannot escape in a horizontal manner because the head of the rigid button 224 has a greater size or diameter than the size or diameter of the second opening. The junction between the first and second openings includes a width that is equal to or slightly less than the diameter of the shaft of the rigid button 224 such that the rigid button snaps into and out of the circular second opening such that the key slot receiver 236 and the sidewall 14 can be quickly connected to and quickly disconnected from the rigid buttons 224 and upper junction 34.

FIG. 12A shows a perspective detail view of a fourth embodiment of a connection for the side of the playyard to an upper junction 34 of the playyard of FIG. 1. This embodiment employs a U-shaped flexible piece 238 and a quick connect and quick disconnect buckle 240. An inside portion of the U-shaped flexible piece 238 is engaged to an inside face of the sidewall 14 such as to the inside face of upper horizontal piece 48. U-shaped flexible piece 238 then extends over the top and front face of upper junction 34, where an outside portion of the U-shaped flexible piece 238 is tapered and permanently attached to a buckle portion 242, which is quickly connectable to and quickly disconnectable from a buckle portion 244, which is engaged to a flexible strap 246, which is engaged to vertical elongate strap piece 44 such as by stitching. The engagement between a lower end of strap 246 and a portion of the vertical elongate strap piece 44 may be disposed anywhere between a location immediately below the buckle 240 and the lower horizontal piece 50. Buckle portions 242 and 244 are quickly connectable and quickly disconnectable from each other by simultaneously pressing inwardly or squeezing together buttons 248. Buckle portion 242 includes a slot for the tapered end of the front portion of the U-shaped piece 238. The tapered end of the front portion of the U-shaped piece 238 includes a sleeve having two open ends and a post integral with the buckle portion 242 passes through this sleeve. Buckle portion 244 includes a slot through which strap 246 extends. Strap 246 extends through this slot and winds about a post integral with buckle portion 244. Strap 246 includes portions stitched back together after strap 246 extends through such slot and winds about such post. Strap 246 may be adjustable in length with a buckle identical to buckle 192 shown in FIG. 10A.

FIG. 12B shows a perspective detail view of a fifth embodiment of a connection for the side of the playyard to an upper junction 34 of the playyard of FIG. 1. This fifth embodiment includes L-shaped receptors 214 having cylindrical portions for receiving the upper ends 26, 30 of the frame members 20, 22. The L-shaped receptors 214 further include the base portions interconnected by pivot pin 216. Each of the L-shaped receptors 214 further includes an integral C-shaped or U-shaped post 250 that forms a slot 252. Post 250 includes two ends, with one end engaged at or adjacent to a lower end of the cylindrical portion of the receptor 214 and with the other end engaged at or adjacent to the junction between the cylindrical portion of the receptor 214 and the base portion of the receptor 214. A strap 254 extends from buckle portion 242, then is inserted through one of the slots 252, then is engaged to the sidewall 14, then is inserted through the other of the slots 252 of the other L-shaped receiver 254, and then extends to the other of the buckle portions 242. Buckle portion 242 is then engaged to buckle portion 244. Buckle portions 242 and 244 are part of the same buckle 240 as shown in FIG. 12A such that the buckle 240 of FIG. 12B also includes buttons 248 such the buckle 240 is a quick release and quick connect buckle. Each of the lower buckle portions 244 is engaged to a flexible strap 256 which are engaged to each other and to vertical elongate strip 44. The engagement of strap 254 to the sidewall 14 occurs by the horizontal piece 48 having a pair of slots through which strap 254 extends. The strap 254 thus extends on the inner face of horizontal piece 48 between the slots and pulls the horizontal piece 48 to the inner face of the upper junction 34. If desired, horizontal piece 48 may be a sleeve and strap 254 may extend through the sleeve such that, in this case, no slots or slits are formed on the inside face of the horizontal piece 48. Slots 252 and posts 250 contain the strap 254 from excessive sliding along the frame members 20, 22 in the axial direction. Buckle portion 242 is of a sufficient size or height such that buckle portion 242, when free and disconnected from buckle portion 244, does not slide through slot 252.

FIG. 12C shows a perspective detail view of a sixth embodiment of a connection for the side of the playyard to an upper junction 34 of the playyard of FIG. 1. In this sixth embodiment, the upper junction 34 is received in a pocket 258. A pocket may be defined as a small bag that is sewed or inserted in a garment so that it is open at the top or side, a receptacle, a container, an opening at the corner or side of a billiard table, a cavity containing a deposit such as of gold, water, or gas, the position of a contestant in a race hemmed in by others, or a small cavity or space. Pocket 258 is formed of a flexible material such as a fabric material. Pocket 258 is formed by a portion of a U-shaped piece 259 of material, such as fabric material. A rear side of the U-shaped piece 259 may be identical in shape to a front side of the U-shaped piece 259 such that, when the U-shaped piece 259 is engaged to the playyard 10, the rear side of the U-shaped piece 259 confronts the outer face of the sidewall 14. If desired, U-shaped piece 259 may be placed over upper horizontal piece 48 such that the U-shaped piece 259 receives the upper horizontal piece 48 and such that the rear side of the U-shaped piece 259 is on an inside of the playyard 10 and such that the front side of the U-shaped piece 250 is on the outside of the playyard 10, in which case the pocket 258 is formed by a portion of the inner face of the outer side of U-shaped piece 259 and a portion of the outer face of the sidewall 14. Preferably, pocket 258 is formed by a portion of the front side of the U-shaped piece 259 and by a portion of the rear side of the U-shaped piece, where both pieces are on the outer face of the sidewall 14. Pocket 258 includes a bottom opening 260 formed between a front side of the pocket 258 and a rear side of the pocket 258. Inner and outer sides of the U-shaped piece 259 are stitched together by stitching 262 where such stitching includes a line of tapered or oblique stitching, a line of vertical stitching, and a line of horizontal stitching. Each of the tapered, vertical and horizontal lines of stitching at least partially engages the upper horizontal piece 48 as well as the front side of the U-shaped piece 259 and the back side of the U-shaped piece 259. The two lines of tapered stitching run vertically and toward each other such that the pocket 258 includes tapered sides that confront and run adjacent to the tapering upper ends 26, 30 of the frame members 20, 22. An upper end of the pocket 258 runs adjacent to the upper edge of the sidewall 14 so as to run adjacent to the upper edge of the upper horizontal piece 48. The pocket 258 contains the upper junction 34 and limits the following movement of the upper junction 34: vertical movement, inner and outer movement relative to a central portion of the playyard 10 (or side to side movement or lateral movement), and end to end movement (or longitudinal movement). If desired, the rear side of the U-shaped piece 259 can be further stitched along its length to one or more of the upper horizontal piece 48 and sidewall 14, including the mesh of the sidewall 14. Pocket 258 includes a closed top end. Pocket 258 is a quick connect and quick disconnect for engagement of the upper junction 34.

FIG. 13A shows a perspective detail view of a seventh embodiment of a connection for the side of the playyard to an upper junction 34 of the playyard of FIG. 1. This seventh embodiment includes a U-shaped piece 264 of a flexible material such as a fabric. The rear side of the U-shaped piece 264 can be engaged to either the inner face of the sidewall 14 such as the inner face of the upper horizontal piece 48 or can be engaged to the outer face of the sidewall 14 such as the outer face of the upper horizontal piece 48. The front side of the U-shaped piece 264 includes a pair of snap portions 266. A cooperating pair of snap portions are fixed on the receptors 214 that receive the upper ends 26, 30 of the frame members 20, 22. The snap portions 266 engaged to the U-shaped piece 264 may be male or female snap portions. The snap portions engaged to the receptors 214 may be the other of the male or female snap portions such that this seventh embodiment is a quick connect and quick disconnect attachment mechanism. When the playyard 10 is in the open form as shown in FIG. 1 and when the snap portions 266 are engaged to the underlying snap portions on the frame members 20, 22, the flexible U-shaped piece 264 is pulled relatively tight. The underlying snap portions on the frame members 20, 22 are on the base portion of the L-shaped receptor 214. The L-shaped receptor 214 is a part of the frame and a part of an elongate frame member such as frame member 20, 22. The L-shaped receptor 214 includes a cylindrical portion that receives the upper ends 26, 30 and a base portion, with the base portions being interconnected by pivot pin 216. U-shaped piece 264 includes a periphery and the snap portions 266 are inset or spaced from the periphery. If desired, the underlying snap portions engaged on the L-shaped receptor 214 may be engaged on the cylindrical portions of the L-shaped receptors 214. The front side or front flap of U-shaped piece 264 includes tapering end edges 268. The tapering end edges 268 provide a greater surface portion of fabric that may be engaged to sidewall 14.

FIG. 13B shows a perspective detail view of an eighth embodiment of a connection for the side of the playyard to an upper junction 34 of the playyard of FIG. 1. This eighth embodiment includes a U-shaped piece 270 of flexible material such as a fabric material. The rear side of the U-shaped piece 270 can be engaged to either the inner face of the sidewall 14 such as the inner face of the upper horizontal piece 48 or can be engaged to the outer face of the sidewall 14 such as the outer face of the upper horizontal piece 48. The front side of the U-shaped piece 270 includes a pair of horizontally extending slits or slots 272. A cooperating pair of wing nuts 274 are rotatably engaged on shafts 276 that extend from receptors 214 that receive the upper ends 26, 30 of the frame members 20, 22. Wing nut 274 does not travel back and forth on the shaft 276. Shaft 276 is not threaded. Wing nut 274 rotates with some friction on shaft 276 such that if wing nut 274 is rotated to a position where the wings of the wing nut 274 extend horizontally, the wing nut 274 will stay at such horizontal position until manipulated by a user. If the wing nut 274 is rotated to a position where the wings extend vertically, the wing nut 274 will stay at such vertical position until manipulated by a user. When the wings of the wing nut 274 extend horizontally, the wing nut 274 is insertable through slot 272. When the wings of wing nut 274 extend vertically, the wing nut 274 is not insertable through slot 272 and, in such vertical position, the front side of U-shaped piece 270 is engaged to the upper junction 270. Wing nuts 274 and the cooperating slots 272 are a quick connect and quick release mechanism for attaching the sidewall 14 to the upper junction 34. When the playyard 10 is in the open form as shown in FIG. 1 and when the wing nuts 274 have been inserted through the slots 272 and are in the vertical position as shown in FIG. 13B, the flexible U-shaped piece 270 is pulled relatively tight. The shafts 276 extend from the base portion of the L-shaped receptor 214. The L-shaped receptor 214 is a part of the frame and a part of an elongate frame member such as frame member 20, 22. The L-shaped receptor 214 includes a cylindrical portion that receives the upper ends 26, 30 and a base portion, with the base portions being interconnected by pivot pin 216. U-shaped piece 270 includes a periphery and the slots 272 are inset or spaced from the periphery. If desired, the shafts 276 engaged on the L-shaped receptor 214 may be engaged on and extend from the cylindrical portions of the L-shaped receptors 214. The front side or front flap of U-shaped piece 270 includes tapering end edges 278. The tapering end edges 278 provide a greater surface portion of fabric that may be engaged to sidewall 14. The combined length of the wings of the wing nut 274 is less than or about equal to the length of slot 272. An endless piece of reinforcing material, such as a piece of fabric material, can be disposed around slot 272.

FIG. 13C shows a perspective detail view of a ninth embodiment of a connection for the side of the playyard to an upper junction 34 of the playyard of FIG. 1. In this ninth embodiment, a piece 280 of flexible material such as a fabric material includes a pair of ears 282. Each of the ears 282 includes a keyhole opening 284. Keyhole opening 284 includes a relatively large upper through hole and a relatively small lower through hole. Piece 280 is engaged, such as by stitching, to the sidewall 14 including the upper horizontal piece 48. Piece 280 may be engaged to the inner face of the sidewall 14 and the inner face of the upper horizontal piece 48. Piece 280 may be one or more of oblong, elongate and U-shaped. Ears 282 may be integral and one-piece with piece 280 and formed of the same flexible material such as a fabric. If desired, each of the ears 282 may be formed of a rigid material, such as plastic, be L-shaped, and sewn onto or into the piece 280. Rigid buttons 224 extend from the L-shaped receptor 214, such as from the cylindrical portion of the L-shaped receptor 214 or the base portion of the L-shaped receptor 214. Pin 216 pivotally engages the frame members 20, 22 to each other. The head of the rigid button 224 has a diameter less than the diameter of the relatively large upper through hole of the keyhole opening 284 such that the head of the rigid button 224 can pass through the relatively large upper through hole of the keyhole opening 284. The head of the rigid button 224 has a diameter greater than the diameter of the relatively small lower through hole of the keyhole opening 284 such that the head of the rigid button 224 cannot pass through the relatively small lower through hole of the keyhole opening 284 such that the piece 280 engages the upper junction 34. When the ears 282 are engaged to the rigid buttons 224, the shaft of the rigid button 224 has snapped into the relatively small lower through hole of the keyhole opening 284. The relatively large upper hole and the relatively small lower hole of the keyhole opening 284 communicate with each other through a passage that has a width about equal to or slightly less than the diameter of the shaft of the rigid button 224 such that a snapping action occurs as the shaft passes from the relatively large upper through hole to the relatively small lower through hole of the keyhole opening 284. The connection between piece 280, its ears 282 and keyhole opening 284 on the one hand and the rigid button 224 on the other hand is a quick connect and quick release connection.

FIG. 14A shows a perspective detail view of a tenth embodiment of a connection for the side of the playyard to an upper junction 34 of the playyard of FIG. 1. This tenth embodiment includes a U-shaped piece 286 of flexible material such as a fabric material. The rear side of the U-shaped piece 286 can be engaged to either the inner face of the sidewall 14 such as the inner face of the upper horizontal piece 48 or can be engaged to the outer face of the sidewall 14 such as the outer face of the upper horizontal piece 48. The front side or flap of the U-shaped piece 286 includes a distal end having an underside whereupon a strip 288 of macroscopic hook and/or loop material such as Velcro® is engaged. Strip 288 is engaged by stitching 290. Strip 288 is straight and horizontally disposed when the playyard 10 is in the open form shown in FIG. 1. Strip 288 connects to a strip 290 of macroscopic hook and/or loop material such as Velcro®, which is engaged to the front side of the sidewall 14. Strip 290 is also engaged to elongate vertical strip or strap 44 and runs laterally across elongate strap 44. Strip 290 is straight and horizontally disposed when the playyard is in the open form shown in FIG. 1. When U-shaped piece 286 is connected to the sidewall 14 through the engagement of the hook and loop strips 288, 292 and the playyard 10 is in the open and folded out form shown in FIG. 1, the U-shaped piece 286 is relatively taut and captures the upper junction 34, thereby minimizing the following movement by the upper junction: upper movement, side-to-side or lateral movement, downward movement, inner movement toward an inside of the playyard 10, and outer movement away from an inside of the playyard 10. The connection between the strips 288 and 292 is a quick connect and quick release connection and thus the capture or engagement of the upper junction 34 with the U-shaped piece 286 is a quick connect and quick release connection. U-shaped piece 286 includes a pair of opposing tapering side edges 294, each of which leads into a distal end edge. Hook and loop strip 288 is spaced from the tapering edges 294 and from the distal end edge. The tapering end edges 294 provide a greater surface portion of fabric of U-shaped piece 286 that may be engaged to sidewall 14.

FIG. 14B shows a perspective detail view of rigid button 224 and its location relative to the frame members 20, 22. As described above, rigid button 224 may extend from the cylindrical portion of L-shaped receiver 214 or the base portion of the L-shaped receiver 214. As described above, rigid button 224, includes a shaft 226, a head 228, and a boss 230.

FIG. 14B further shows the structure of the joint between the base portions of the L-shaped receiver 214, where such joint includes interlocking or meshing tines or forks or teeth. Pivot pin 216 extends through the interlocking tines or forks or teeth.

Figure 14C:
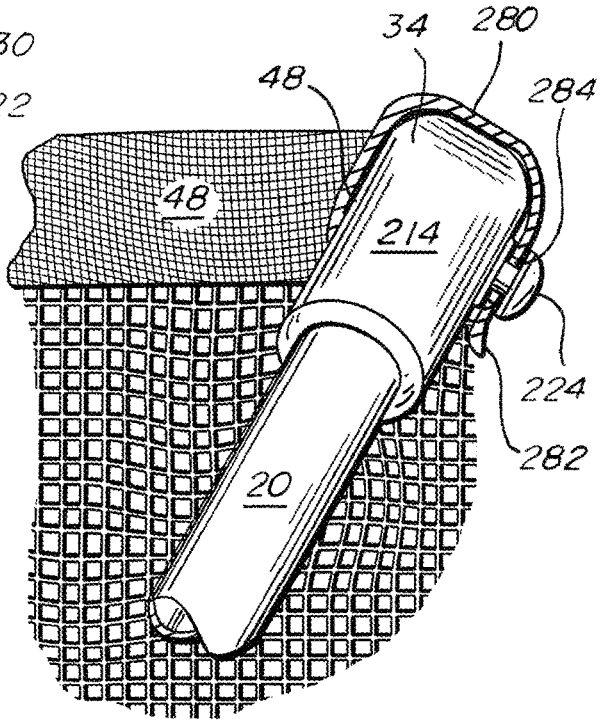
FIG. 14C shows a perspective, detail, partially sectional view of the eleventh embodiment of the connection for the side of the playyard of FIG. 14B to an upper junction of the playyard of FIG. 1 and further shows soft components of the playyard.

FIG. 14C shows a side detail partially section view of the embodiment of FIG. 13C. It can be seen that the upper horizontal piece 48 is pinched between the rear side of the U-shaped piece 280 and the upper junction 34 and that the front side of the U-shaped piece 280 includes the ears 282 that have the keyhole openings 284 that engage the rigid buttons 24.

Figure 15A:
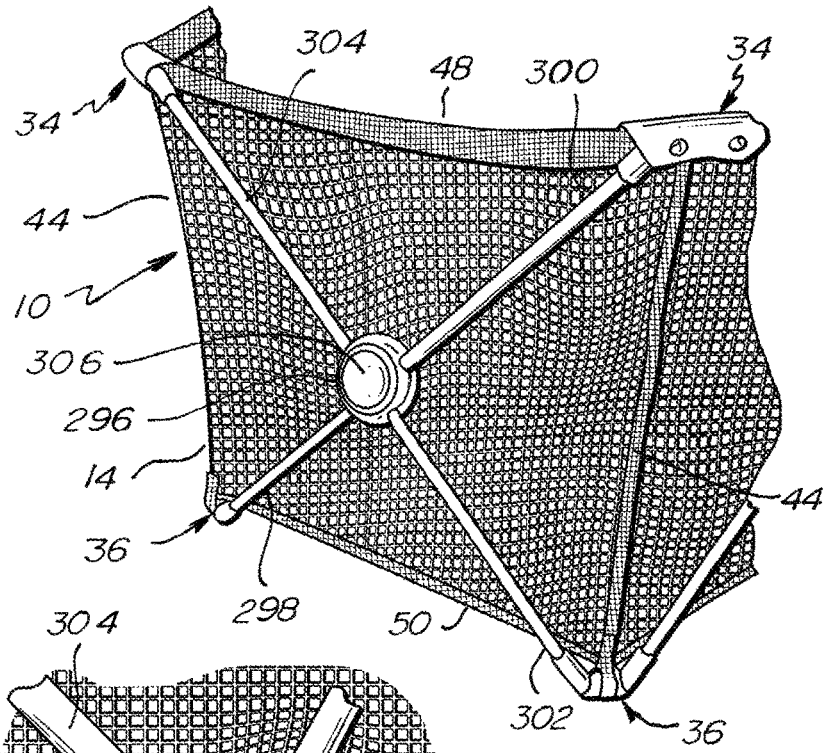
FIG. 15A shows a perspective view of a second embodiment of a lock for the frame of the playyard of FIG. 1, with the first embodiment of the lock being shown in FIG. 1.

FIG. 15A shows a perspective view of a second embodiment of a lock for the frame of the playyard of FIG. 1, with the first embodiment of the lock being shown in FIG. 1. Second lock 296 is positioned not at the upper junction 34 and not at the lower junction 36, but medially of the two junctions 34, 36. Second lock engages not full length frame members 20, 22, but half-length frame members 298, 300, 302 and 304. There is only one second lock 296 for the entire playyard 10. However, if preferred there may be further second locks 296. Frame members 298 and 300 are aligned with each other in a straight line. Frame members 302 and 304 are aligned with each other in a straight line. Frame members 298 and 302 are lower frame members. Frame members 300 and 304 are upper frame members. Upper frame members 304 and 300 tie into different upper junctions 34. Lower frame members 298, 302 tie into different lower junctions 36. Frame members 298, 300, 302, 304 radiate from second lock 296 at ninety degree angles from adjacent frame members 298, 300, 302, 304. The second lock 296 is locked and unlocked by pressing in a button 306.

Figure 15B:
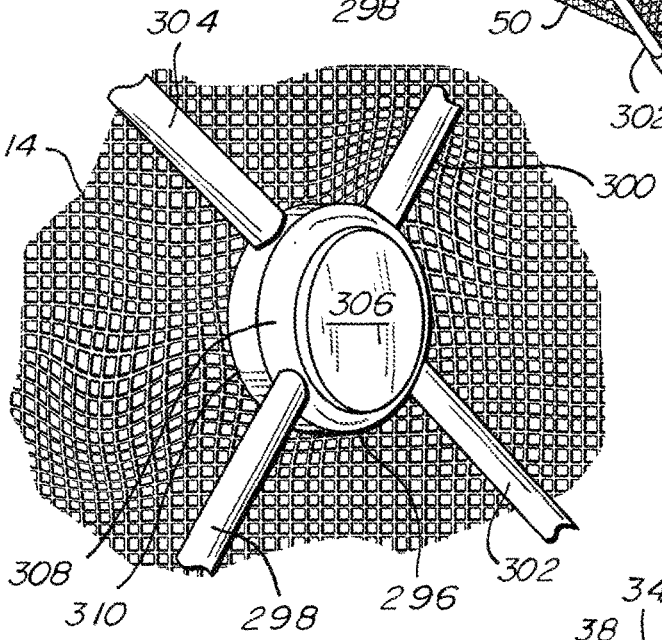
FIG. 15B is a perspective detail view of the lock of FIG. 15A.

FIG. 15B is a perspective detail view of the second lock of FIG. 15A. FIG. 15B shows that frame members 298, 300 are engaged to an outer lock half section 308 and that frame members 302, 304 are engaged to an inner lock half section 310. Half sections 308, 310 rotatably engage each other and rotate relative to each other after button 306 is pressed inwardly. When half sections 308, 310 rotate relative to each other, upper frame members 300, 304 are drawn together and lower frame members 298, 302 are drawn together, thereby permitting all of the upper junctions 34 and all of the lower junctions 36 of the playyard 10 to pivot, thereby permitting all of the frame members 20, 22 of the playyard to pivot relative to the upper and lower junctions 34, 46, and thereby permitting the playyard 10 to fold to the compact position shown in FIG. 5.

Figure 15C:
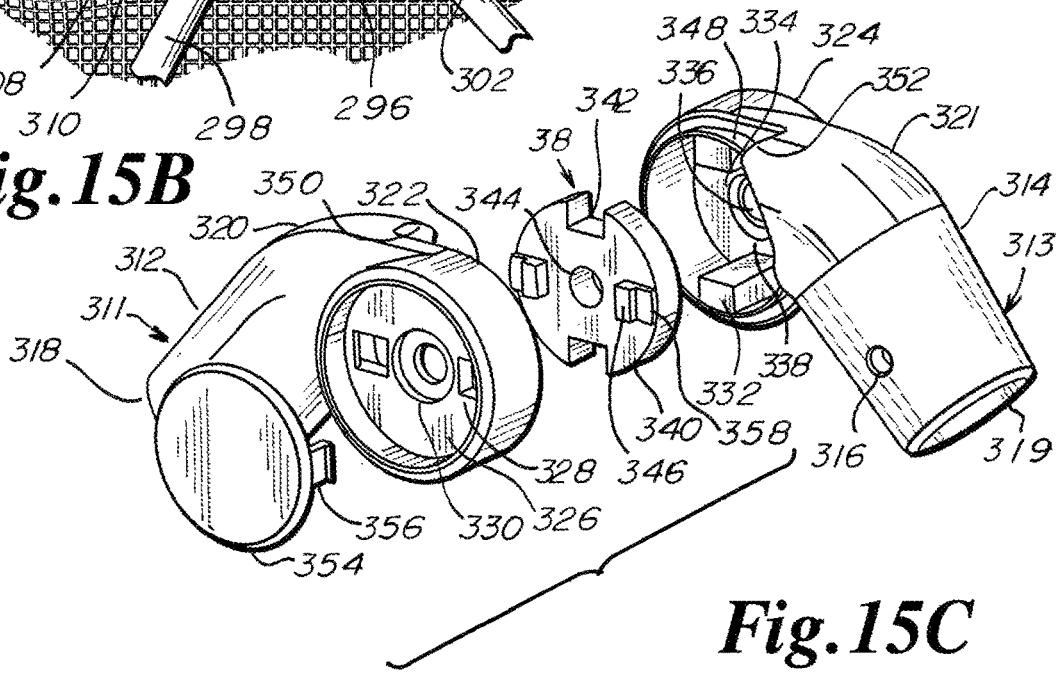
FIG. 15C is a perspective exploded detail view of the lock of FIG. 1, where the lock is positioned at preferably only one upper junction for the entire frame of the playyard, but where the lock may be positioned at two or more upper junctions of the frame of the playyard.

FIG. 15C is a perspective exploded detail view of the first lock 38 of FIG. 1, where the first lock 38 is positioned at preferably only one upper junction 34 for the entire frame 12 of the playyard 10, but where the first lock 38 may be positioned at two or more upper junctions 34 of the frame 12 of the playyard 10.

First lock 34 includes a first lock portion 311 having a first female receptor 312 for frame member 20 of the frame 12. First lock 34 includes a second lock portion 313 having a second female receptor 314 for frame member 22 of the frame 12. Each of the first and second receptors 312, 314 includes a through hole 316 extending laterally therethrough for engaging pin 72 that in turn engages the sidewall 14 of the playyard 10 such as at the upper horizontal piece 48 of the playyard 10. Pin 72 may also extend through and engage upper ends 26, 30 of the frame members 20, 22 that are received in the first and second receptors 312, 314. Each of the receptors 312, 314 has a respective end opening 318, 319 for receiving the respective upper end 26, 30 of the respective frame member 20, 22.

Opposite end openings 318, 319, each of the lock portions 311, 313 312 includes a transition 320, 321. Each of the transitions 320, 321 includes an axis that curves away from a straight axis of its respective receptor 312, 314. Transitions 320, 321 curve between respective receptors 312, 314 and respective cylinders 322, 324.

First lock portion 311 includes cylinder 322 that is engaged to transition 320. Cylinder 322 has an axis perpendicular to the curved axis of the transition 320 and to the straight axis of the receptor 312.

Second lock portion 313 includes cylinder 324 that is engaged to transition 321. Cylinder 324 has an axis perpendicular to the curved axis of the transition 321 and to the straight axis of the receptor 314.

Cylinder 322 includes a plate 326 intermediate open ends of the cylinder 322. Plate 326 is in the form of a disk. Plate 326 is coaxial with cylinder 322. The outside diameter of plate 326 is equal to the inside diameter of cylinder 322. Plate 326 includes a pair of side openings 328 and a central opening 330. Other than openings 328, 330, plate 326 is solid. Side openings 328 are square or rectangular. Central opening 330 includes a circular depression and a through hole within the circular depression. The circular depression and the through hole are coaxial. One side opening 328 is between the circular opening 330 and the inner sidewall of the cylinder 322. The other side opening 328 is between the circular opening 330 and the inner sidewall of the cylinder 322. The side openings 328 are diametrically opposite of each other. Side openings 328 are adjacent to and spaced from the inner wall of cylinder 322.

Cylinder 324 includes first and second tracks 332. The first and second tracks 332 are diametrically opposite of each other. Each of the tracks 332 engages the inner sidewall of cylinder 324. Each of the tracks 332 includes an axis that is parallel to the axis of cylinder 324. Track 332 includes a cross-sectional shape that is generally square or rectangular, but with one side being circular, with such circular side being the side adjacent to and engaged to the inner sidewall of cylinder 324. The three noncircular sides of such cross-section of track 332 may be a shape other than a square or rectangle. Such noncircular sides may be formed in a circular shape, a triangular shape, a star-shape, a dovetail shape, or some other shape.

A distal end of cylinder 324 is closed by a plate 334. Plate 334 is disk shaped. A cylindrical pin receiver 336 extends axially from the plate 334. A coil spring 338 is engaged about cylindrical pin receiver 336 and expands and retracts in the axial direction along cylindrical pin receiver 336. A pin extends through cylindrical pin receiver 336, opening 344 of locking disk 340, and opening 330 of plate 326 of cylinder 322. One head of the pin is engaged in circular depression of opening 330 and the other head of the pin confronts the distal face of cylinder 324 so as to pinch the cylinders 322, 324 together.

First lock 38 further includes an intermediate, sliding, relatively rotating, and locking disk 340. Locking disk 340 engages each of cylinders 322, 324. Locking disk 340 slides in cylinder 324. Locking disk 340 rotates relative to cylinder 322 when disk 340 is pushed in a sliding manner away from cylinder 322 and further into cylinder 324. Locking disk 340 includes diametrically opposed slots 342 opening to a periphery of the disk 340. Slots 342 ride on and slide on tracks 332. Slots 342 always are engaged on tracks 332. Slots 342 are shaped to match the cross-sectional shape of tracks 332. Slot 342 is formed by two sidewalls that are parallel to and spaced apart from each other and a floor that runs between the two sidewalls and is disposed at a right angle to each of the sidewalls. Slot 342 runs from one face of disk 340 to the other face of disk 340. Slot 342 runs in the axial direction. Disk 340 includes a central through hole 344. Hole 344 defines an axis of the locking disk 340. Hole 344 slidingly receives the pin that engages cylindrical receiver 336 of cylinder 324, which pin is also engaged in opening 330 of cylinder 322. Disk 340 further includes a pair of diametrically opposed locking tabs 346. Tabs 346 extend in the direction from cylinder 324 to cylinder 322. Tab 346 is spaced from and adjacent to the periphery of the disk 340. Tab 346 is received in the side openings 328 of plate 326 of cylinder 322. When lock tabs 346 are in their respective side openings 328, locking disk 340 is not rotatable relative to cylinder 322. When lock tabs 346 are out of their respective side openings 328, locking disk 340 is rotatable relative to cylinder 322, cylinder 322 is rotatable relative to cylinder 324, lock portion 311 is swingable relative to lock portion 313, upper ends 26, 30 are swingable relative to each other, and frame members 20, 22 are swingable relative to each other.

Tracks 332 extend in the axial direction from cylinder 314 to cylinder 312. Tracks 332 extend slightly out of cylinder 324. Locking disk 340 is received at least partially in cylinder 322. An annular inner portion of cylinder 322 fits over and rotates on an annular extension or annular shelf 348 of cylinder 324. Cylinders 322 and 324 capture and enclose locking disk 38. Cylinder 322 includes a stop 350. Cylinder 324 includes a stop 352. Cylinders 322 may be prevented from rotation relative to each other by the stops 350, 352 engaging or making contact with each other or by tabs 346 being pushed into sidewall openings 328 by the coil spring 338 bringing pressure to bear upon locking disk 340 that in turn pushes tabs 346 into sidewall openings 328.

First lock 38 further includes unlock button 354. Unlock button 354 has a periphery about equal to or slightly less than the inner sidewall of one end of cylinder 322 and is slidingly friction fit therein. Unlock button 354 includes diametrically opposed, unlock, push tabs 356. Tab 356 is adjacent to and spaced apart from a periphery of button 354. Push tab 356 includes a neck and a foot, with such foot having a greater lateral width than the neck. Push tab 356 extends through side openings 328 of cylinder 322 and then makes contact with and brings pressure to bear on a step 358 of locking disk 340 when the button 354 is pushed inwardly.

In operation, from the locked position where frame members 20, 22 cannot swing relative to each other, button 354 is pushed inwardly such that tabs 356 bring pressure to bear on steps 358, compresses coil spring 338, pushes locking disk 340 toward plate 334 and pushes lock tabs 346 out of side openings 328, which releases cylinder 322 and lock portion 311 to rotate relative to cylinder 324 and lock portion 313, which permits frame members 20, 22 to swing relative to each other, which permits frame 12 to fold in a scissor like fashion from the open form shown in FIG. 1 to the closed and folded form shown in FIG. 5. To then fold out the frame 12 from the closed form shown in FIG. 5 to the open form shown in FIG. 1, the frame members 20, 22 are swung apart so as to rotate cylinder 324 and locking disk 340 relative to cylinder 322, which rotates lock tabs 346 relative side openings 328 until lock tabs 346 approach and snap into side openings 328 under axial pressure from the compressed coil spring 338, thereby fixing cylinders 322 and 324 in place relative to each other and fixing frame 12 in the open position shown in FIG. 1.

Figure 16A:
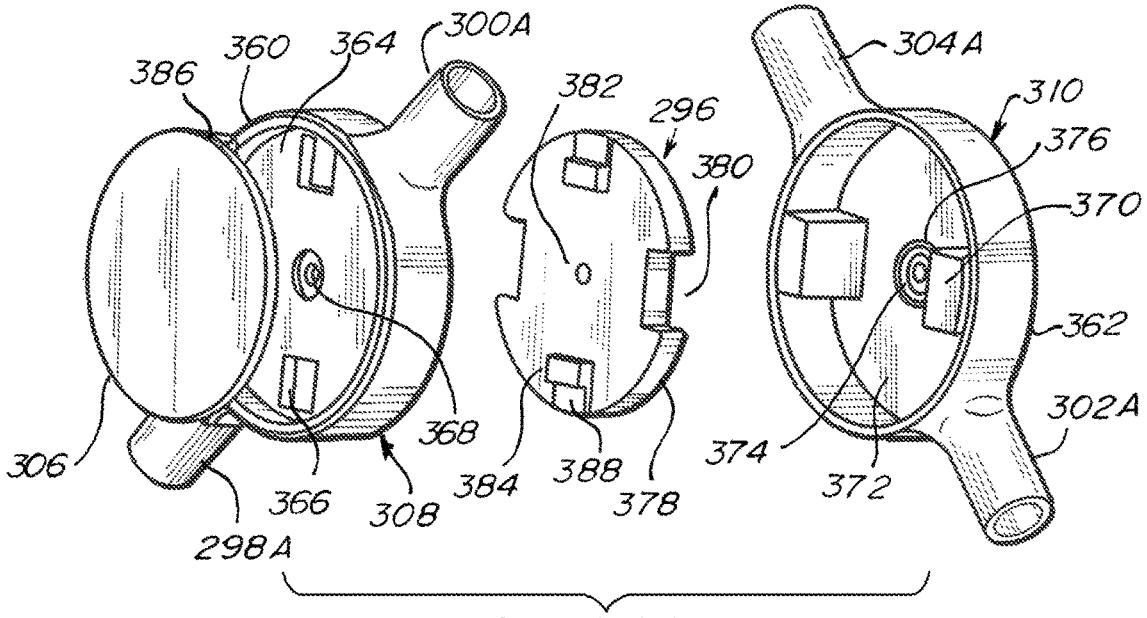
FIG. 16A is a perspective exploded detail view of the lock of FIGS. 15A and 15B, where the lock is positioned at the intersection of crossing frame members intermediate of the upper and lower junctions of the crossing frame members.
Figure 16B:
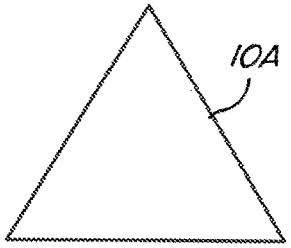
FIG. 16B shows that the playyard of the present invention may take a triangular form.
Figure 16C:
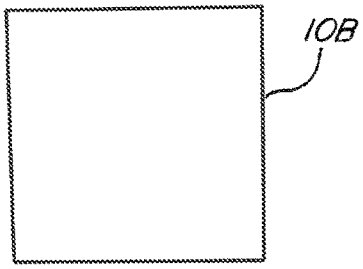
FIG. 16C shows that the playyard of the present invention may take a square or rectangular form.
Figure 16D:
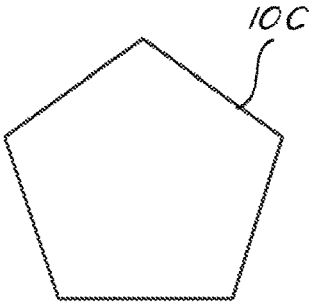
FIG. 16D shows that the playyard of the present invention may take a pentagonal form.
Figure 16E:
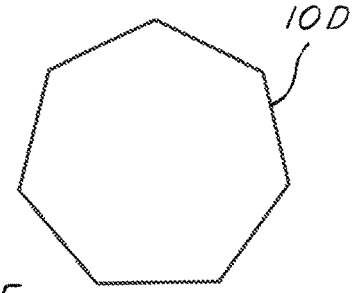
FIG. 16E shows that the playyard of the present invention may take a heptagonal form.
Figure 16F:
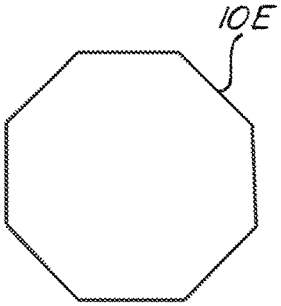
FIG. 16F shows that the playyard of the present invention may take an octagonal form.

FIG. 16A is a perspective exploded detail view of the second lock 296 of FIGS. 15A and 15B, where the second lock 296 is positioned at the intersection of crossing frame members intermediate of the upper and lower junctions 34, 36 of the frame members 298, 300, 302, and 304.

Second lock 296 has a structure and function that is substantially similar to first lock 38.

Outer half section 308 includes a cylinder 360 and two diametrically opposing receivers 297C and 300A extending from the cylinder 360. Receiver 297C engages and receives frame member 298. Receiver 300A engages and receives frame member 300.

Inner half section 310 includes a cylinder 362 and two diametrically opposing receivers 302A and 304A extending from the cylinder 362. Receiver 302A engages and receives frame member 302. Receiver 304A engages and receives frame member 304.

Cylinder 360 includes an axis that is perpendicular to the axis of receivers 297C and 300A. Cylinder 362 includes an axis that is perpendicular to the axis of receivers 302A and 304A.

Cylinder 360 includes a plate 364 intermediate open ends of the cylinder 360. Plate 364 is in the form of a disk. Plate 364 is coaxial with cylinder 360. The outside diameter of plate 364 is equal to the inside diameter of cylinder 360.

Plate 364 includes a pair of side openings 366 and a central opening 368. Other than openings 366, 368, plate 364 is solid. Side openings 366 are square or rectangular. Central opening 368 includes a circular depression and a through hole within the circular depression. The circular depression and the through hole are coaxial. One side opening 366 is between the circular opening 368 and the inner sidewall of the cylinder 360. The other side opening 366 is between the circular opening 368 and the inner sidewall of the cylinder 360. The side openings 366 are diametrically opposite of each other. Side openings 366 are adjacent to and spaced from the inner wall of cylinder 360.

Cylinder 362 includes first and second tracks 370. The first and second tracks 370 are diametrically opposite of each other. Each of the tracks 370 engages the inner sidewall of cylinder 362. Each of the tracks 370 includes an axis that is parallel to the axis of cylinder 362. Track 370 includes a cross-sectional shape that is generally square or rectangular, but with one side being circular, with such circular side being the side adjacent to and engaged to the inner sidewall of cylinder 362. The three noncircular sides of such cross-section of track 370 may be a shape other than a square or rectangle. Such noncircular sides may be formed in a circular shape, a triangular shape, a star-shape, a dovetail shape, or some other shape.

A distal end of cylinder 362 is closed by a plate 372. Plate 372 is disk shaped. A cylindrical pin receiver 374 extends axially from the plate 372. A coil spring 376 is engaged about cylindrical pin receiver 374 and expands and retracts in the axial direction along cylindrical pin receiver 374. A pin extends through cylindrical pin receiver 374 and opening 368 of plate 364 of cylinder 360. One head of the pin is engaged in circular depression of opening 368 and the other head of the pin confronts the distal face of the plate 372 of the closed end of cylinder 362 so as to pinch the cylinders 360, 362 together.

Second lock 296 further includes an intermediate, sliding, relatively rotating, and locking disk 378. Locking disk 378 engages each of cylinders 360, 362. Locking disk 378 slides in cylinder 362. Locking disk 378 rotates relative to cylinder 360 when disk 378 is pushed in a sliding manner away from cylinder 360 and further into cylinder 362.

Locking disk 378 includes diametrically opposed slots 380 opening to a periphery of the disk 378. Slots 380 ride on and slide on tracks 370. Slots 380 always are engaged on tracks 370. Slots 380 are shaped to match the cross-sectional shape of tracks 370. Slot 380 is formed by two sidewalls that are parallel to and spaced apart from each other and a floor that runs between the two sidewalls and is disposed at a right angle to each of the sidewalls. Slot 380 runs from one face of disk 378 to the other face of disk 378. Slot 380 runs in the axial direction.

Disk 378 includes a central through hole 382. Hole 382 defines an axis of the locking disk 378. Hole 382 slidingly receives the pin that engages cylindrical receiver 374 of cylinder 362, which pin is also engaged in opening 368 of cylinder 360.

Disk 378 further includes a pair of diametrically opposed locking tabs 384. Tabs 384 extend in the direction from cylinder 362 to cylinder 360. Tab 384 is spaced from and adjacent to the periphery of the disk 378. Tab 384 is received in the side openings 366 of plate 364 of cylinder 360. When lock tabs 384 are in their respective side openings 366, locking disk 378 is not rotatable relative to cylinder 360. When lock tabs 384 are out of their respective side openings 366, locking disk 378 is rotatable relative to cylinder 360, cylinder 360 is rotatable relative to cylinder 362, lock half section 308 is swingable relative to lock half section 310, frame members 300 and 304 are swingable relative to each other, and frame members 298, 302 are swingable relative to each other.

Tracks 370 extend in the axial direction from cylinder 362 to cylinder 364. Tracks 370 extend slightly out of cylinder 324. Locking disk 378 is received at least partially in cylinder 360. Cylinders 360 and 362 capture and enclose locking disk 378.

Cylinders 360, 362 may be prevented from rotation relative to each other by tabs 384 being pushed into sidewall openings 366 by the coil spring 376 bringing pressure to bear upon locking disk 378 that in turn pushes tabs 384 into sidewall openings 366.

Second lock 296 further includes unlock button 306. Unlock button 306 has a periphery about equal to or slightly less than the inner sidewall of one end of cylinder 360 and is slidingly friction fit therein. Unlock button 306 includes diametrically opposed, unlock, push tabs 386. Tab 386 is adjacent to and spaced apart from a periphery of button 306. Push tab 386 includes a neck and a foot, with such foot having a greater lateral width than the neck. Push tab 386 extends through side openings 366 of cylinder 360 and then makes contact with and brings pressure to bear on a step 388 of locking disk 378 when the button 306 is pushed inwardly.

In operation, from the locked position where frame members 300 and 304 cannot swing relative to each other and where frame members 298, 302 cannot swing relative to each other, button 306 is pushed inwardly such that tabs 386 bring pressure to bear on steps 388, compresses coil spring 376, pushes locking disk 378 toward plate 372 and pushes lock tabs 384 out of side openings 366, which releases cylinder 360 and half section 308 to rotate relative to cylinder 362 and half section 310, which permits frame members 300, 304 to swing relative to each other and permits frame members 298, 302 to swing relative to each other, which permits frame 12 to fold in a scissor like fashion from the open form shown in FIG. 1 to the closed and folded form shown in FIG. 5.

To then fold out the frame 12 from the closed form shown in FIG. 5 to the open form shown in FIG. 1, the frame members 300, 304 are swung apart and frame members 298 and 302 are swung apart so as to rotate cylinder 362 and locking disk 378 relative to cylinder 360, which rotates lock tabs 384 relative side openings 366 until lock tabs 384 approach and snap into side openings 366 under axial pressure from the compressed coil spring 376, thereby fixing cylinders 360 and 362 in place relative to each other and fixing frame 12 in the open position shown in FIG. 1.

In addition to the hexagonal form shown in FIG. 1, FIGS. 16B, 16C, 16D, 16E, and 16F show that the playyard 10 of the present invention may take, respectively, a triangular playyard form 10A, a square playyard form 10B, a pentagonal playyard form 10C, a heptagonal playyard form 10D, or an octagonal playyard form 10E.

Any of the triangular playyard form 10A, square playyard form 10B, pentagonal playyard form 10C, hexagonal playyard form 10D, or octagonal playyard form 10E, may utilize the frame shown in FIG. 1 and the first lock 38. Only one first lock 38 is required for any such forms.

Any of the triangular playyard form 10A, square playyard form 10B, pentagonal playyard form 10C, hexagonal playyard form 10D, or octagonal playyard form 10E, may utilize the frame shown in FIG. 15A and the second lock 296. Only one second lock 296 is required for any such forms.

Any of the triangular playyard form 10A, square playyard form 10B, pentagonal playyard form 10C, hexagonal playyard form 10D, or octagonal playyard form 10E, may utilize any of the lower junction embodiments shown in FIGS. 2A, 2B, 3, 7A, 7B, 7C, 7D, 8A, 8B, 8C, 8D, 9A, 9B, 9C, 9D, 10A, 10B, 10C, 10D, 11A, 24, and 26D.

Any of the triangular playyard form 10A, square playyard form 10B, pentagonal playyard form 10C, hexagonal playyard form 10D, or octagonal playyard form 10E, may utilize any of the upper junction embodiments shown in FIGS. 1, 5, 6, 11B, 11C, 12A, 12B, 12C, 13A, 13B, 13C, 14A, 14B, 14C, 18, 23, 25A, and 27B.

Any of the lower junction embodiments shown in FIGS. 2A, 2B, 3, 7A, 7B, 7C, 7D, 8A, 8B, 8C, 8D, 9A, 9B, 9C, 9D, 10A, 10B, 10C, 10D, 11A, 24 and 26D may be used with any of the upper junction embodiments shown in FIGS. 1, 5, 6, 11B, 11C, 12A, 12B, 12C, 13A, 13B, 13C, 14A, 14B, 14C, 18, 23, 25A, and 27B.

Figure 17A:
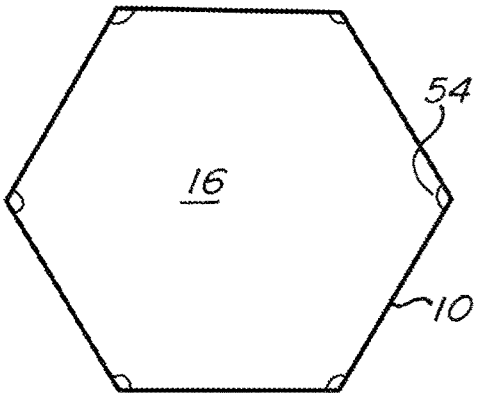
FIG. 17A is a bottom plan view of the playyard of FIG. 1 showing floor pulling straps terminating at the periphery of the floor.

FIG. 17A is a bottom plan diagrammatic view of the playyard 10 of FIG. 1 showing floor pulling straps 52 terminating at the periphery of the floor 16. Such floor pulling straps 52 may terminate at essentially one or more locations such as at the junction between floor 16 and sidewall 14, at a location on the floor 16 a centimeter or two from the sidewall 14, or at a location on the sidewall 14 a centimeter or two from the floor 16.

Figure 17B:
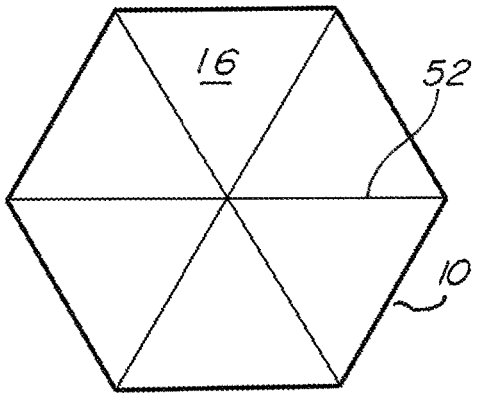
FIG. 17B is a bottom plan view of the playyard of FIG. 1 showing floor pulling straps extending radially and fully across the floor.

FIG. 17B is a bottom plan diagrammatic view of the playyard 10 of FIG. 1 showing one or more floor pulling straps 52 extending radially and fully across the floor 16. One floor pulling strap 52 may extend fully across, while the other four floor pulling straps 52 may terminate at the center to avoid a three layered strap bump at the center of the floor 16.

Figure 17C:
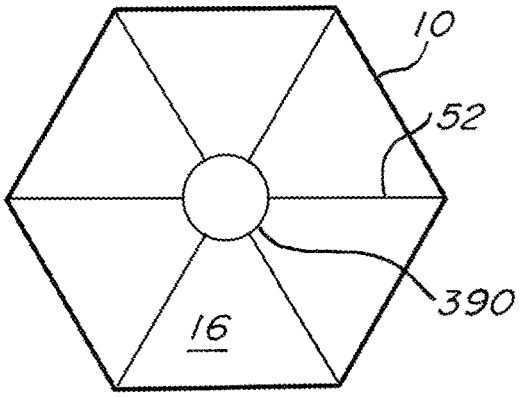
FIG. 17C is a bottom plan view of the playyard of FIG. 1 showing radially extending floor pulling straps engaging a central floor pulling strap.

FIG. 17C is a bottom plan diagrammatic view of the playyard 10 of FIG. 1 showing radially extending floor pulling straps 52 engaging a central and circular floor pulling strap 390.

Figure 17D:
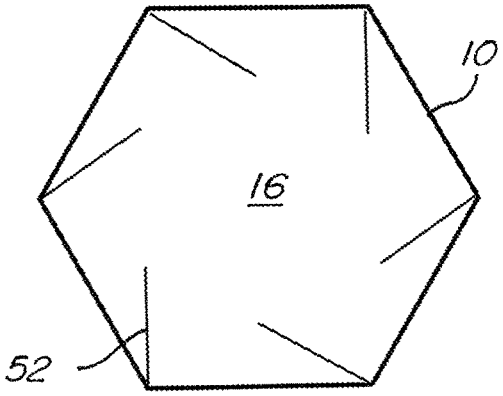
FIG. 17D is a bottom plan view of the playyard of FIG. 1 showing nonradially extending floor pulling straps.

FIG. 17D is a bottom plan diagrammatic view of the playyard 10 of FIG. 1 showing nonradially extending floor pulling straps 52.

Figure 17E:
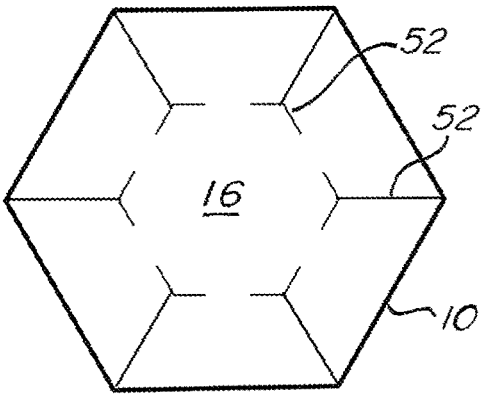
FIG. 17E is a bottom plan view of the playyard of FIG. 1 showing Y-shaped floor pulling straps.

FIG. 17E is a bottom plan diagrammatic view of the playyard 10 of FIG. 1 showing Y-shaped floor pulling straps 52.

Figure 17F:
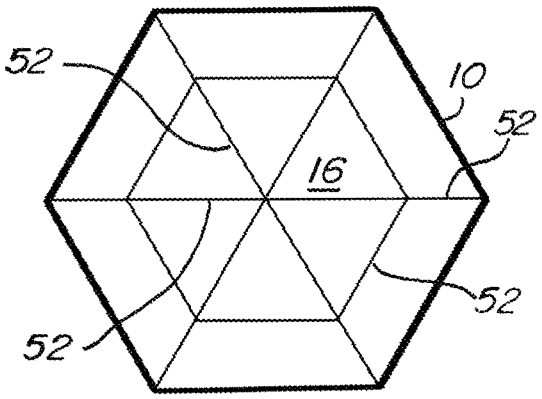
FIG. 17F is a bottom plan view of the playyard of FIG. 1 showing an interconnected network of floor pulling straps.

FIG. 17F is a bottom plan diagrammatic view of the playyard 10 of FIG. 1 showing an interconnected network of floor pulling straps 52.

Figure 18:
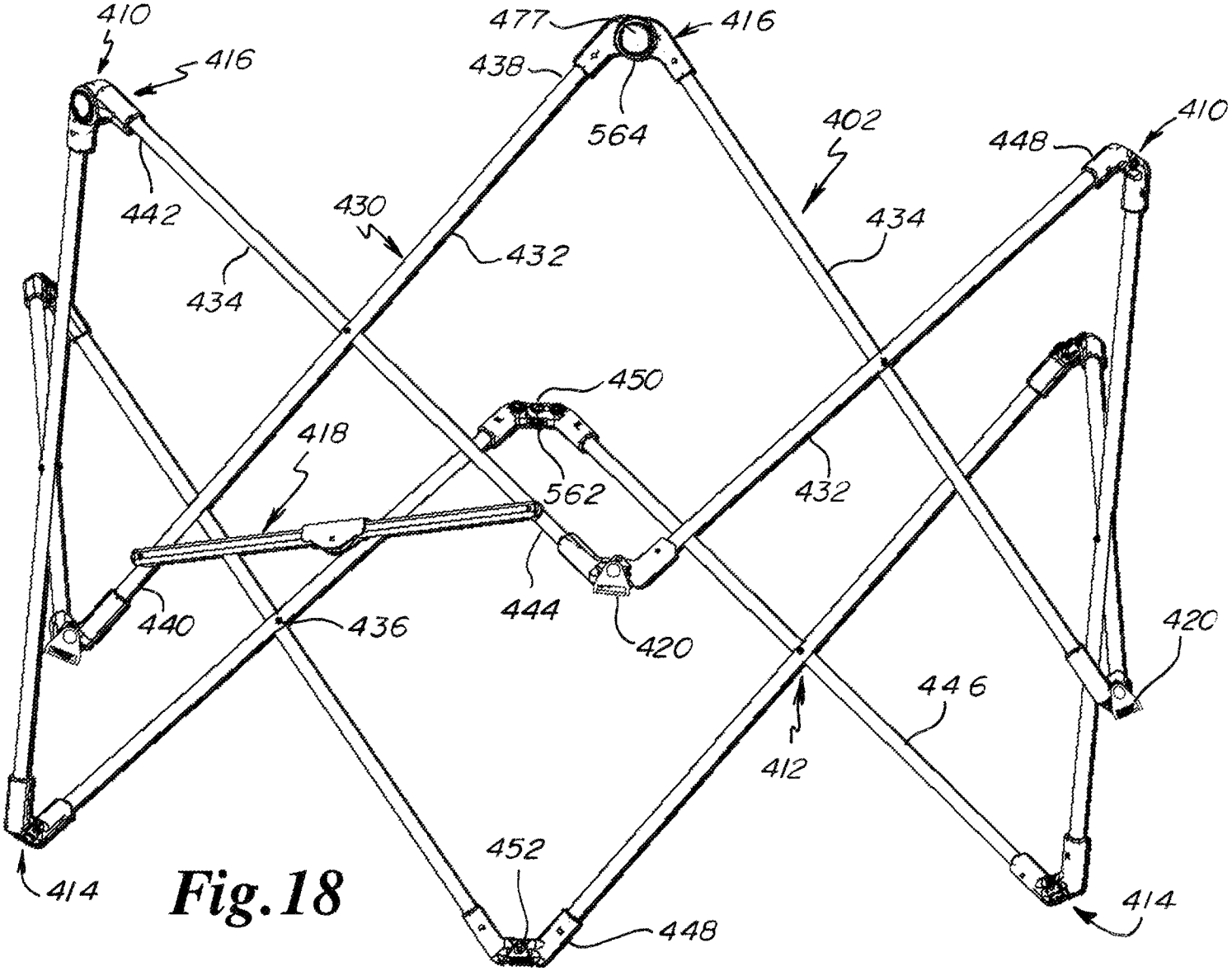
FIG. 18 is a perspective view of the frame of the playyard of FIG. 20 of the present invention.
Figure 19:
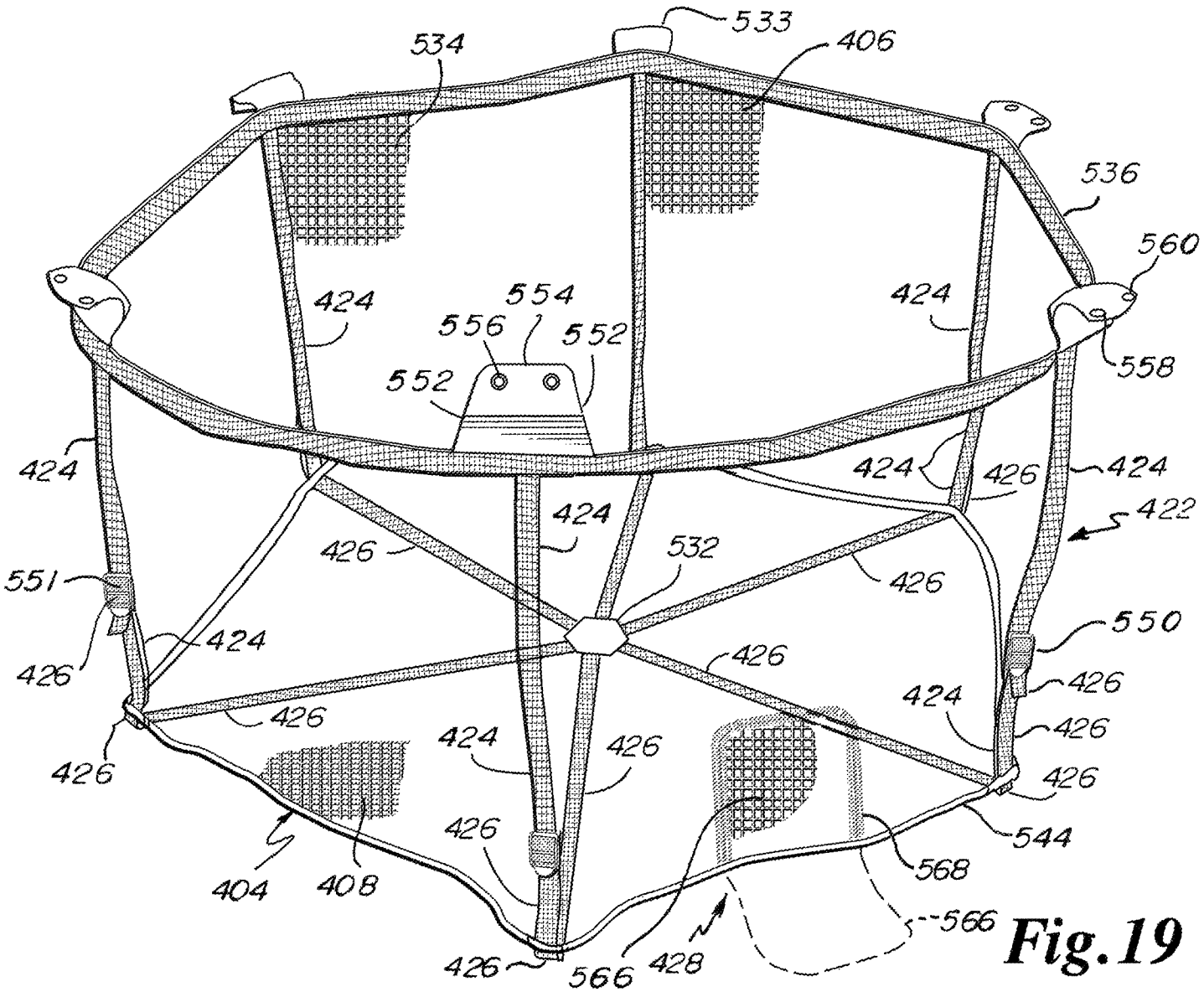
FIG. 19 is a perspective, diagrammatic, and partially phantom view of the flexible pen of the playyard of FIG. 20 with some components for clarity only partially shown or not shown, such as the mesh of the sidewall, which is only partially shown, or the mesh of the sidewall, which is only partially shown, or the second strap portion, the distal ends of which of are not shown.
Figure 20:
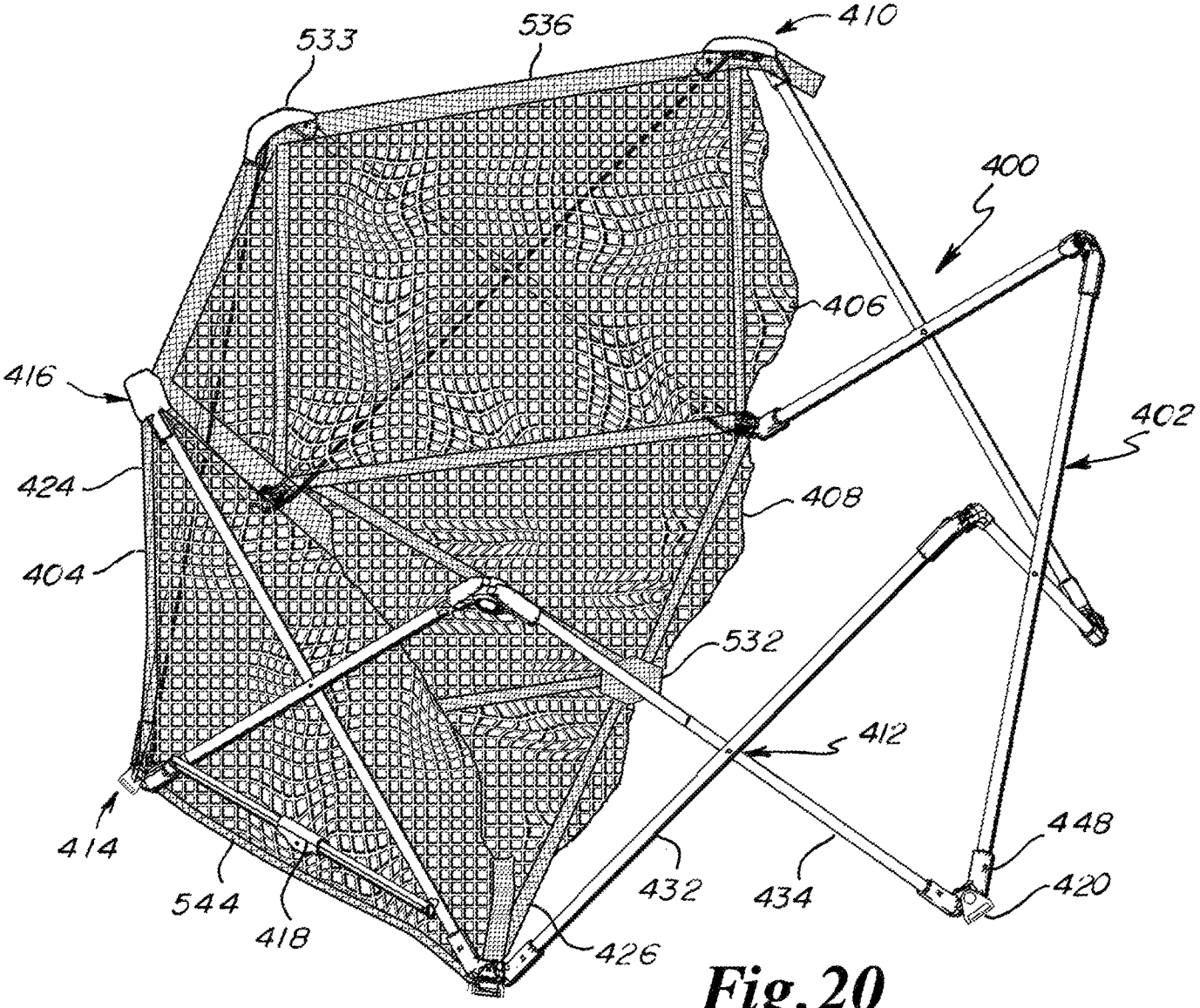
FIG. 20 is a perspective, partially cut away view of the playyard of the present invention, showing the flexible pen of FIG. 19 on the frame of FIG. 18.

FIGS. 18, 19 and 20 show another embodiment of the playyard of the present invention. This embodiment is indicated by the reference numeral 400. Playyard 400 includes an endless self-supporting frame 402 shown in FIG. 18 and a flexible pen 404 shown in FIG. 19. Flexible pen 404 includes an endless flexible sidewall 406 and a flexible floor 408. Flexible pen 404 includes an open top. Flexible pen 404 is receptacle shaped. Frame 400 includes upper junctions 410, intermediate junctions 412, and lower junctions 414. Frame 400 includes a pair of first locks 416 and a second lock 418. Frame 400 includes pivoting slotted feet 420. Flexible pen 404 includes a set of straps 422. Strap 422 extends from periphery of the open top of the flexible pen 404 down the flexible sidewall 406, through the pivoting slotted foot 420, along the underside of the flexible floor 408, and to a central portion of the flexible floor 408. Strap 422 includes a first strap portion 424 that is engaged to the sidewall 406 along the entire height of the sidewall 406, from upper rim 536 to lower rim 544, and a second strap portion 426 that is engaged to the first strap portion 424, where the second strap portion 426 extends from the first strap portion 424, at a location slightly above the lower rim 544, through a slot 548 formed by the lower rim 544, through the open channel of the pivoting slotted foot 420, along and unengaged to the underside of the flexible floor 498, and to a central portion of the flexible floor 408 where a distal end of the second strap portion 426 is engaged to a span 532. Flexible pen 404 includes an access door 428.

As shown in FIG. 18, frame 402 is a scissoring folding frame. Frame 402 includes six folding scissoring sections or support member pairs 430. Each of the support member pairs 430 includes a pair of tubular frame support members 432, 434 interconnected by a pin connector 436 at an intermediate junction 412.

Support member 434 is adjacent to and spaced from sidewall 406 with no other support members, including support member 432, between such support member 434 and the sidewall 406. Support members 432 is adjacent to and spaced from the sidewall 406 with support member 434 being between such support member 432 and the sidewall 406. Support member 432 extends up and to the right from a perspective outside of the playyard 400. Support member 434 extends up and to the left from a perspective outside of the playyard 400.

Frame section 430 can scissor out, or fold out, to the expanded "X" form and can scissor in, or fold in, to the retracted "X" form.

Support member 432 includes an upper end 438 and a lower end 440. Support member 434 includes an upper end 442 and a lower end 444.

Upper end 438 of support member 432 of one pair 430 is pivotally engaged at an upper junction 410 to upper end 442 of support member 434 of an adjacent pair 430.

Lower end 440 of frame member 432 of one pair 430 is pivotally engaged at a lower junction 414 to lower end 444 of frame member 434 of an adjacent pair 430.

Each of the support members 432, 434 includes an elongate tube 446. Each of the ends 438, 440, 442, 444 of support members 432, 434 includes a female receptor 448 for receiving the elongate tube. The female receptor 448 includes an open end at one end for receiving the elongate tube 446. At the other end, the female receptor 448 includes hinge intermeshing plates or teeth or prongs or fork tines that mesh with the hinge intermeshing plates or teeth or prongs or fork tines with another female receptor 448 so as to form an upper junction 410 or a lower junction 414. Pins can transversely engage the support members 432, 434 to the female receptor 448 through transverse pin openings formed in the female receptor.

A pin 450 joins the intermeshing hinge plates at the upper junction 410, except for lockable two upper junctions 410 that include the first lock 416. A pin 452 joins the intermeshing hinge plates at the lower junction 414.

None of the intermediate junctions 412 are lockable. All of the intermediate junctions 412 are free swinging. None of the lower junctions 414 are lockable. All of the lower junctions 414 are free swinging.

Two of the upper junctions 410 are lockable. The remaining upper junctions 410 are free swinging and not lockable.

First lock 416 is on two adjacent upper junctions 410 such that a caretaker can unlock or lock both of the locks 416 at substantially the same time and so that the caretaker need not walk around to every support member pair 430 or to every junction or hinge of the playyard 400, such that a caretaker can fold in and fold out the playyard 400 at one standing or sitting position.

First lock 416 is positioned at an upper junction 410 where a first support member 432 meets a second support member 434.

FIGS. 25A, 25B, 25C, 25D, 26A and 26B show details of the first lock 416.

First lock 416 includes an outer half section 454 and an inner half section 456.

Outer half section 454 includes a cylinder 458 and a female receptor 460 extending from the cylinder 458. Female receptor 460 engages and receives one of the support members 432, 434.

Inner half section 456 includes a cylinder 462 and a female receptor 464 extending from the cylinder 462. Female receptor 464 engages and receives the other of the support members 432, 434.

Cylinder 458 includes an axis that is perpendicular to the axis of female receptor 460. Cylinder 462 includes an axis that is perpendicular to the axis of female receptor 464.

Outside cylinder 458 includes two open ends. Outside cylinder 458 includes a plate 466 intermediate open ends of the outside cylinder 458. Plate 458 is in the form of a disk. Plate 458 is coaxial with cylinder 458. The outside diameter of plate 458 is equal to the inside diameter of cylinder 458.

Plate 458 includes a set of three side openings 468 and a central opening 470. Other than openings 468, 470, plate 458 is solid. Side openings 468 are square or rectangular. Central opening 470 includes a circular depression and a through hole within the circular depression. The circular depression and the through hole are coaxial. The side openings 468 are between the central opening 470 and the inner sidewall of the cylinder 458. The side openings 468 are 120 degrees relative to of each other. Side openings 468 are adjacent to and spaced from the inner wall of cylinder 458.

The other open end of outer cylinder 458 includes an annular set of teeth 472. Side openings 468 are disposed between the teeth 472 and an axle 474 is rigidly fixed to the plate 466 and extends axially therefrom. Teeth 472 extend radially inwardly toward the axle 474.

Outer half section 454 further includes a button 477 mounted on an axially extending post 476. Post 476 slides or rides in central opening 470 and in axle 474. A set of three push tabs 479 extend inwardly from an underside of the button 477 and through the side openings 468. Button 477 has a diameter about equal to or slightly smaller than the inside diameter of cylinder 458 such that button 477 can be pressed at least partially into cylinder 458.

Inner half section 456 includes inner cylinder 462 that has a closed end 478 and an open end 480. The open end 480 includes a set of annular teeth 482 and further includes an axial cylinder 484 in which is housed a coil spring 486.

Disposed between the outer and inner cylinders 458, 462 is a toothed disk 488. Toothed disk 488 slides axially on axial cylinder 484. Axle 474 of outer cylinder 458 is engaged in axial cylinder 484 and extends through toothed disk 488. Push tabs 479 bring pressure to bear upon and push upon the outer face of toothed disk 488. The teeth of toothed disk 488 engage each of the annular teeth 482 of inner cylinder 462 and the annular teeth 472 of outer cylinder 458. An end of coil spring 486 constantly brings pressure to bear on the inside fact of toothed disk 488 to normally bias toothed disk 488 in the outward direction.

Toothed disk 488 is an intermediate, sliding, relatively rotating, and locking disk. Locking or toothed disk 488 engages each of cylinders 458, 462. Locking or toothed disk 488 slides axially along the annular teeth 482 of inner cylinder 42. Locking or toothed disk 488 slides axially relative to outer cylinder 458 when button 477 is depressed and then, when toothed disk 488 slides out of engagement with annular teeth 472 of outer cylinder 458, locking or toothed disk 488 rotates relative to outer cylinder 458 so as to unlock the cylinders 458, 462 relative to each other.

When the toothed disk 488 is engaging each of the set of annular teeth 472, 482, first lock 416 is locked. This is the normal position. Coil spring 486 keeps the toothed disk 488 engaged with annular teeth 472 of the outer cylinder 458. Toothed disk 488 always is engaged with annular teeth 482 of inner cylinder 462.

To unlock the first lock 416, button 477 is depressed, which pushes tabs 479 inwardly against disk 488, which moves out of engagement with annular teeth 472, which allows outer half section 454 to rotate relative to inner half section 456.

Then, to lock the outer half section 454 relative to the inner half section 456, the half sections 454, 456 are rotated relative to each other until large tooth 490 snaps back into a large tooth receiver 492 formed in annular teeth 472. Such indexing provides for the proper angle between the female receptors 460, 464 and their respective support members 432, 434.

Outer and inner cylinders 458, 462 rotatably engage each other at their inner edges. Axial pin 493 ties outer and inner cylinders 458, 462 by, for example, engaging closed end 478 of inner cylinder 462 with the axle 474 of outer cylinder 458.

The annular teeth 472, 482 run or extend in the axial direction of cylinders 458, 462.

Cylinders 458 and 462 capture and enclose locking disk 488.

In operation, from the locked position where support members 432, 434 cannot swing relative to each other and frame 402 as a whole is locked, button 477 of each of the two first locks 416 is pushed inwardly such that tabs 479 bring pressure to bear upon toothed locking disk 488, which brings pressure to bear upon and compresses coil spring 486. This axial sliding of toothed locking disk 488 slides disk 488 out of engagement with annular teeth 472, which releases cylinder 458 and half section 456 to rotate relative to cylinder 462 and half section 460, which permits support members 432, 434 to swing relative to each other, which permits frame 402 to fold in a scissor like fashion from the open form to a closed form.

To then fold out the frame 402 from the closed form to the open form, the support members 432, 434 are swung apart so as to rotate cylinder 458 (having unengaged annular teeth 472) relative to cylinder 462 (having annular teeth 482 engaged with the toothed locking disk 488). When the indexed relatively large tooth 490 aligns with its respective relatively large tooth space or receptor, toothed locking disk 488, under pressure from coil spring 486, snaps into annular teeth 472, thereby fixing cylinders 458, 462 in place relative to each other and fixing frame 402 in the open position.

It should be noted that upper junctions 410 may have first locks 416 or upper pins 450. Two adjacent upper junctions 410 have first locks 416. All remaining upper junctions 410 have pins 450.

Two adjacent upper junctions 410 have button locks or first locks 416 that are normally locked. In other words, the first locks 416 are normally biased in an outward position such that the locking mechanism prevents upper ends 438, 442 of two adjacent support member pairs 430 from pivoting relative to each other, which in turn prevents all of the remaining four upper junctions 410 from pivoting and further prevents all six lock free lower junctions 414 from pivoting and still further prevents all six lock free intermediate junctions 412 from pivoting. When pressed in, the button 477 unlocks the upper ends 438, 442 from each other, thereby allowing such upper ends 438, 442 to pivot relative to each other, thereby unlocking such two upper junctions 410 to pivot, thereby permitting the remaining four upper junctions 410 to pivot, thereby permitting all six lock free lower junctions 410 to pivot, and thereby permitting the frame 402 and playyard 400 as a whole to fold from an open form or configuration to the closed and compact form or configuration.

Frame 402 further includes pivoting foot 420. Pivoting foot 420 is shown in FIGS. 18, 20, 22A, 22B, 22C, 24, 26C, and 26D.

One pivoting foot 420 is engaged to each of the lower junctions 414. Each of the lower junctions 414 includes a pair of female receptors 448 that are hingedly joined by hinge intermeshing plates or teeth 494 that are in turn engaged by transversely extending pivot pin 452. The hinge intermeshing plates or teeth 494 are on one end of the female receptor 448. On the other end of the female receptor is an open end for elongate tube 446.

Support member 432 extends upward and to the right (from a perspective outside of playyard 400). Support member 432 includes lower end 440, which includes female receptor 448, which include intermeshing plates 494.

Support member 434 extends upward and to the left (from a perspective outside of playyard 400). Support member 433 includes lower end 444, which includes female receptor 448, which include hinge intermeshing plates 494.

Distal closed end of female receptor 448 includes an L-shaped portion. At the inner end of the L-shaped portion, the distal closed end includes an inner end portion 496 having inner and upper faces and inner and lower faces. At the base of the L-shaped portion, the distal closed end includes a base face 498. Base face 498 makes contact with the surface upon which the playyard 400 rests when the playyard 400 is in the open position. When playyard 400 is in the closed configuration, base face 498 is spaced from and does not make contact with such surface since the pivoting foot 420 makes contact at such time with such surface.

When the playyard 400 is in the closed position, the inner and upper faces of the inner end portions 496 of the opposing female receptors 448 are disposed generally parallel to each other, confront each other, and are adjacent to each other. When the playyard 400 is in the open position, the inner and lower faces of the inner end portions 496 are disposed at an oblique angle relative to each other and lie generally parallel to the ramps of the triangular plate portions 500.

Pivoting foot 420 includes a pair of opposing, inner and outer, triangular plate portions 500 interconnected by radially extending floor braces 502. The radially extending floor braces 502 are interconnected by a transversely extending brace 504. The radially extending floor braces 502 form a strap receiving radially extending open channel 506. Lower junction pin 452 engages the triangular plate portions 500 which lie on both sides of the intermeshing hinge teeth 494. A tab or stop 508 rises from the apex of the outer triangular plate portion 500. Tab or stop 508 abuts the inner and upper faces of the inner end portions 496 of the female receptors 448 and minimizes pivoting of the pivoting foot 420 when the playyard 400 is in the closed and compact position so as to thereby minimize movement of strap 422 relative to the playyard 400 as a whole and maximize retainment of the strap 422 in the channel 506. Channel 506 serves as a retainer or guide for strap 422, namely, the second strap portion 426.

Figure 26A:
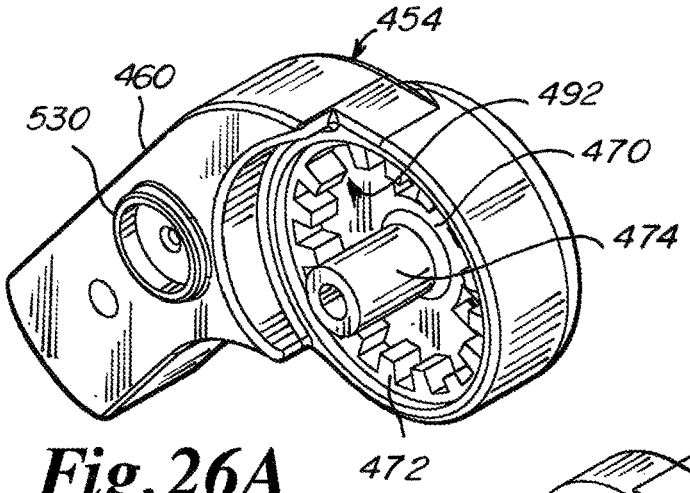
FIG. 26A is a perspective, partial view of the lock of the lockable upper junction of the playyard of FIG. 20, showing inner components of the outer half section of such lock.
Figure 26B:
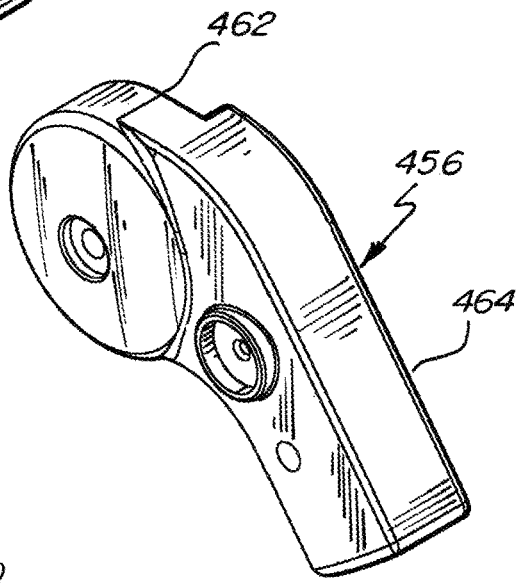
FIG. 26B is a perspective, partial view of the lock of the lockable upper junction of the playyard of FIG. 20, showing the back of the inner half section of such lock.
Figure 26C:
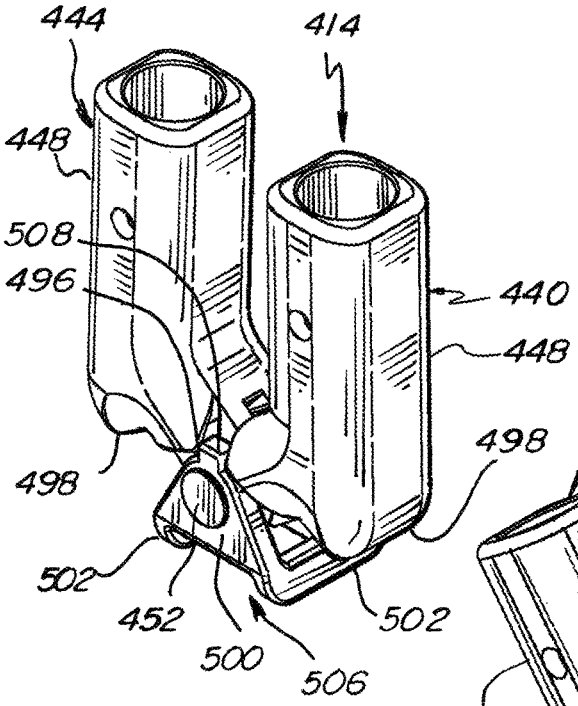
FIG. 26C is a perspective view of the lower junction of the playyard of FIG. 20, where the playyard is in a closed position.
Figure 26D:
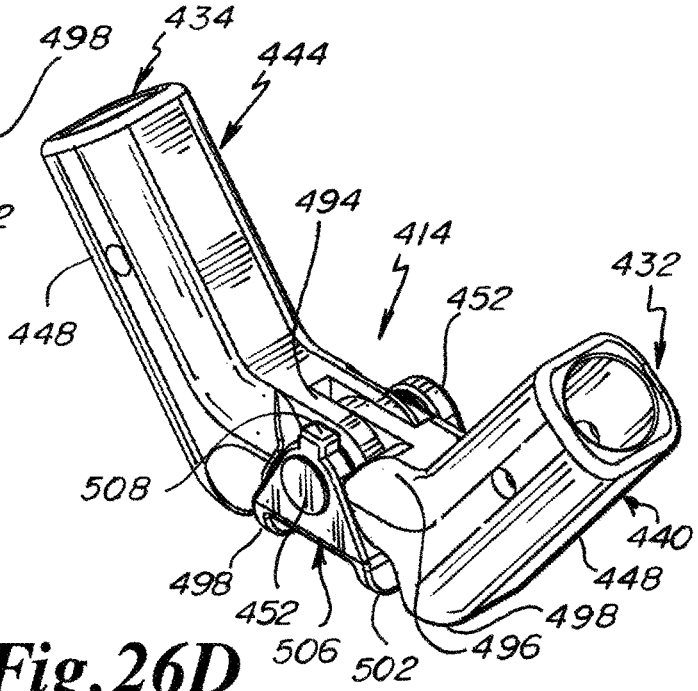
FIG. 26D is a perspective view of the lower junction of the playyard of FIG. 20, where the playyard is in a fully locked position, where both the first and second locks have been locked.

When the playyard 400 is in the open position, the pivoting foot 420 engages, or is slightly spaced from the surface upon which the base faces 498 of the distal closed ends of the female receptors 448 lie, such that the pivoting foot 420 shares some of the load of the playyard 400 with the distal closed ends and base faces 498 relative to the surface on which the playyard 400 rests. The pivoting or rocking of the foot 420 provides greater stability for the playyard 400 in each of the open position (as shown in FIG. 26D where load is shared with the distal most end of the female receptor 448) and the closed position (as shown in FIG. 26C, where the pivoting foot 420 alone handles the load).

The structural relationships between the ramps of the triangular piece 500 and the inner and lower faces of inner end portions 496 and between the tabs 508 and the inner and upper faces of inner end portions 496 orientate the pivoting foot 420, such that the pivoting foot 420 more likely will have a true vertical position to engage the surface on which playyard 400 is standing, such that pivoting foot 420 will have less movement relative to second strap portion 426, and such that it is less likely that second strap portion 426 will slip out of guide or channel 506.

While tab or stop or post or tongue 508 minimizes the pivoting or rocking of the foot 420 when the playyard 400 is in the closed and compact position, the upper oblique surfaces or ramps of the triangular plate portions 500 minimize the pivoting or rocking of the foot 420 when the playyard 400 is in the open position. In other words, inner and upper faces of inner end portions 496 of the distal ends of the support members 432, 434 minimize rocking of the pivoting foot 420 by being minimally spaced from the tabs 508, as shown in FIG. 26C, when the playyard 400 is in the closed and compact position, and the inner and lower faces of inner end portions 496 of the distal ends of the support members 432, 434 minimize rocking of the pivoting foot 420 by being minimally spaced from the upper oblique surfaces of the triangular plates 500, as shown in FIG. 26D, when the playyard 400 is in the open and operating position.

Figure 27A:
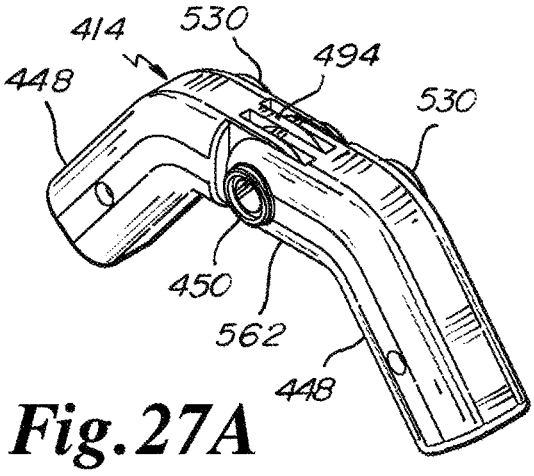
FIG. 27A is a front perspective view of the nonlockable upper junction of the frame of the playyard of FIG. 20, where the nonlockable upper junction does not include the first lock.
Figure 27B:
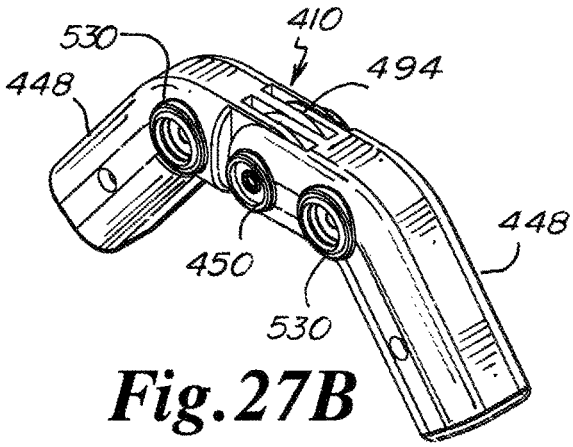
FIG. 27B is a rear perspective view of the nonlockable upper junction of the frame of the playyard of FIG. 20, where the nonlockable upper junction does not include the first lock.
Figure 27C:
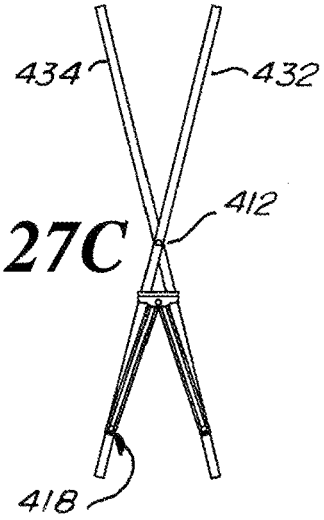
FIG. 27C is an elevation view of the second lock of the playyard of FIG. 20, where the playyard is in, or close to being in, a closed position, and where the first lock is unlocked.
Figure 27D:
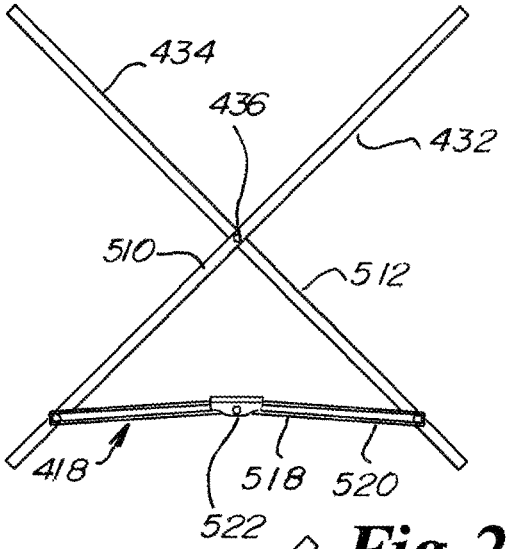
FIG. 27D is an elevation view of the second lock of the playyard of FIG. 20, where the first lock has been locked and where the second lock has not been locked.
Figure 27E:
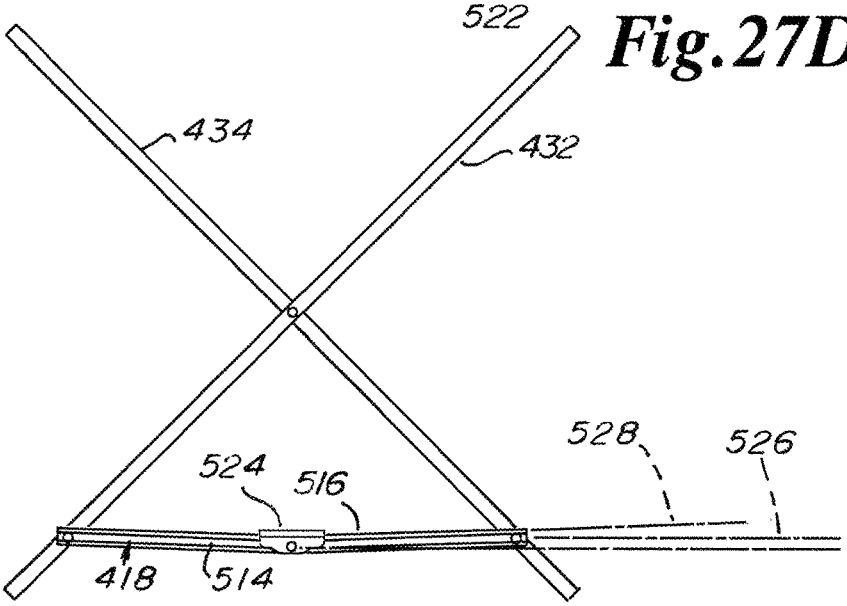
FIG. 27E is an elevation view of the second lock of the playyard of FIG. 20, where both the first and second locks have been locked.

Second lock 418 is shown in FIGS. 27C, 27D and 27E. Second lock 418 is engaged between first support member 432 and second support member 434 on one support pair 430. Support member 432 extends upwardly and to the right (from a perspective outside of the playyard 400). Second support member 434 extends upwardly and to the left (from a perspective outside of the playyard 400). Support member 434 passes between support member 432 and the sidewall 406 of the flexible pen 404. Second lock 418 has an over center lock mechanism or tension bar.

Each of the first and second support members 432, 434 have lower support member portions 510, 512. Each of the lower support member portions 510, 512 extends from the intermediate junction 412 to its respective lower junction 414. Each of the lower support member portions 510, 512 includes a female receptor 448. The second lock 418 is preferably engaged between lower support member portions 510, 512 of one support member pair 430. If desired, the second lock 418 can be engaged between upper support member portions of the support members 432, 434, where such upper support member portions run between the intermediate junctions 412 and the upper junctions 410.

Second lock 418 includes first and second elongate members 514, 516. Each of the first and second elongate members 514, 516 includes a proximal end 518 and a distal end 520. The proximal ends 518, 520 have laterally extending plates and such laterally extending plates are pivotally joined to each other with a pin 522. This lateral displacement of pin 522 permits the absolute ends of the proximal ends 518, 520 to remain available and exposed so as to make contact with each other during the over center locking step.

Distal end 520 of elongate member 516 is pivotally joined to support member 434. Distal end 520 of elongate member 514 is pivotally joined to support member 432.

The second lock 418 includes a channel piece or pedal 524 having a back plate 590 and an open face 592. The back plate 590 and opposing face 592 are disposed across from each other.

The channel piece 524 receives the proximal ends 518 of the first and second elongate support members 514, 516. Proximal end portions of the proximal ends 518 swing through the open face 592 of the channel piece 524 when the second lock 418 is opened and closed. The back plate 590 brings pressure to bear upon proximal end portions of the proximal ends 518 when the second lock 418 is locked.

When the playyard 400 is in a closed configuration, the entire length of the elongate members 514, 516 are adjacent to the support member 432, 434 to which the elongate member 514, 516 is pivotally connected. In such a position, the channel piece 524 is adjacent to the intermediate junction 412. In such a position, the absolute ends of the proximal ends 518 are spaced apart from each other. In such a position the elongate members 514, 516 form a V with a relatively small inner angle, and with such angle being less than 180 degrees and defined by the lower faces of the elongate members 514, 516.

When the playyard 400 is being opened from the closed position to the open position, the absolute ends of the proximal ends 518 are drawn into adjacent spaced apart positions relative to each other. In this position, the elongate members 514, 516 form a V with a relatively large inner angle and do not yet form a straight line. Such relatively large inner angle is less than 180 degrees and is defined by the lower faces of the elongate members 514, 516.

When the playyard 400 is opened further, such as when the first locks 416 automatically lock (i.e., the indexing tooth 490 finds it unique tooth receptor 492 in annular teeth 472) or automatically snaps into the locked position, the absolute ends of the proximal ends 518 make contact with each other. At this point in time, with the first locks 416 locked, the caretaker steps down on the channel piece or pedal 524 to push the elongate members 514, 516 into and through a straight line relationship. This straight line relationship is indicated by reference number 526. The caretaker presses through the straight line relationship and to a position where an angle, measured by the bottom surfaces of the elongate members 514, 516, is slightly greater than 180 degrees. This position, where the second lock 418 has been drawn over center, is indicated by reference number 528.

As the second lock 418 is being drawn over center, the absolute ends of the proximal ends 518 make contact with each other and, in doing so, push apart the lower portions 510, 512 of the support members 432, 434. As such pair of lower portions 510, 512 are pushed apart, all of the remaining lower portions of the support member pairs 430 are pushed apart, as also is all of the upper portions of the support member pairs 430.

As the second lock 418 moves from the straight line relationship indicated by reference number 526 (where the support members 432, 434 are under the greatest tension) to the locked position shown by reference number 528, the support members 423, 434 and support member pairs 430 and frame 402 as a whole expand to a greatest degree and then retract to a lesser degree. This expansion and retraction is insurance against an unintended folding in or collapse of the frame 402 because force must be applied in the upward direction, such as by a foot, against the underside of the elongate members 514, 516, to unlock the second lock 418. This expansion and retraction is insurance against an unintended unlocking of first locks 416.

The pair of first locks 416 and the second lock 418 share support members, such as support members 432, 434. In other words, support member 432 extends upward and to the right to its own respective unique first lock 416, and support member 434 extends upward and to the left to its own respective unique first lock 416. In this relationship, second lock 418 is adjacent to and immediately below the first locks 416. However, if desired, the second lock 418 may be found on a support member pair 430 that includes one or no first locks 416, such that only one or no first lock 416 is shared with the second lock 418.

In the straight line relationship indicated by reference number 526, the elongate members 514, 516 define a distance A, where distance A is measured as a straight line between the points where elongate members 514, 516 are pivotally engaged to the support members 432, 434.

In the locked position relationship indicated by reference number 528, there is a distance B. Distance B is a straight line distance between the same two points of distance A, except that the lower portions 510, 512 are slightly closer together such that these same two points (pivot locations) define a distance B that is less than distance A.

Channeled piece 524 is a pedal or protective piece that protects against a pinching of fingers when second lock 418 is opened and closed. Pedal 524 may or may not aid in holding second lock 418 in a locked over center position.

As shown in FIGS. 27A and 27B, frame 402 further includes a pair of snap portions 530 on the inner face of upper junction 410, in the case where the upper junction 410 includes a first lock 416 and in the case where the upper junction 410 does not include a first lock 416 but instead is free swinging and includes a pair of female receptors 448 having the intermesh hinge plates or teeth 494. Each of the female receptors 448 is elbow shaped or includes a bend and snap portion 530 is adjacent to such bend. Snap portion 530 is further adjacent to upper pivot pin 450. Snap portions 530 are disposed on either side of pivot pin 450. Snap portions 530 are oriented to have an axis extending generally radially toward a center of frame 402.

As shown in FIG. 19, flexible pen 404 includes endless flexible sidewall 406 and flexible floor 408. Flexible pen 404 further includes strap 422 that includes first strap portion 424 and second strap portion 426. Flexible pen 404 further includes central flexible span or reinforcement 532 and flexible ties or flexible extensions 533. Flexible pen 404 further includes a double layer flexible fabric upper rim 536.

Endless sidewall 406 is flexible. Endless sidewall 406 may be formed of a fabric material. Endless sidewall 406 may be formed of a mesh material.

Endless sidewall 406 includes six sections 534. Each of the six sections 534 may form a rectangle or square. Each of the six sections 534 may be trimmed or reinforced along each of its four sides with a strip of material such as fabric material.

Figure 21A:
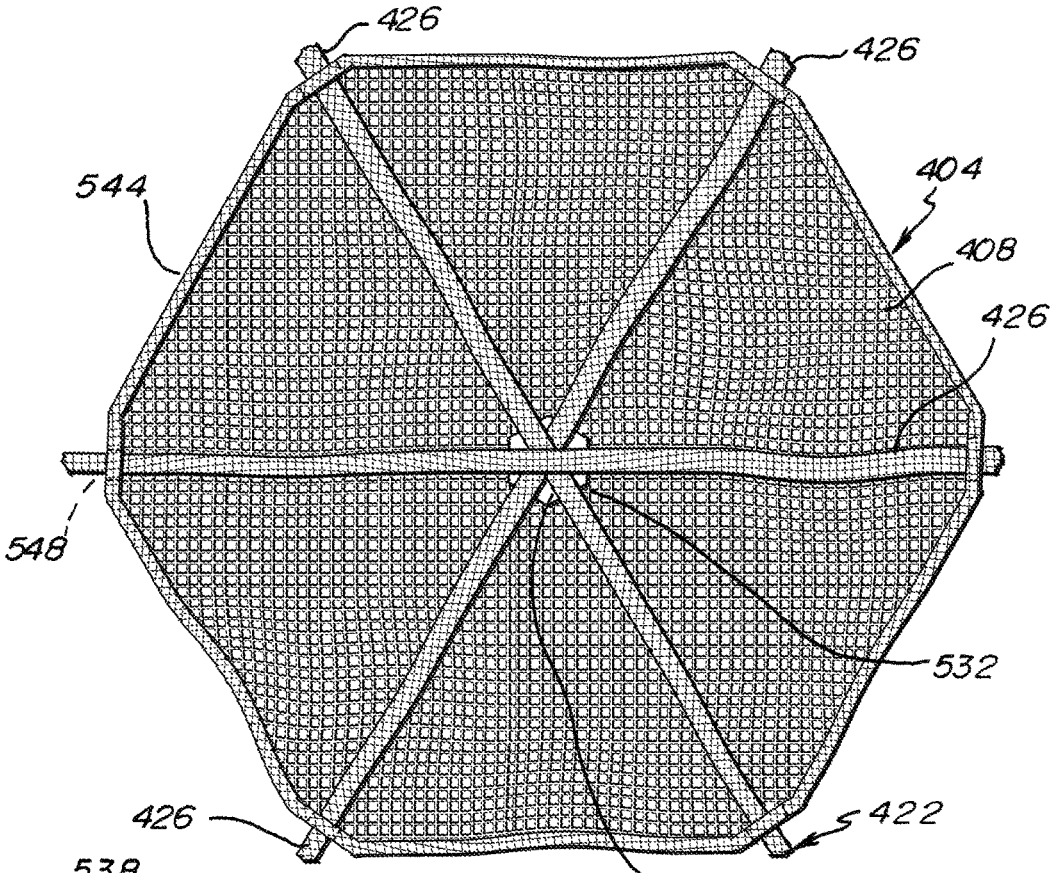
FIG. 21A is a bottom plan view of the flexible pen of the playyard of FIG. 20.
Figure 21B:
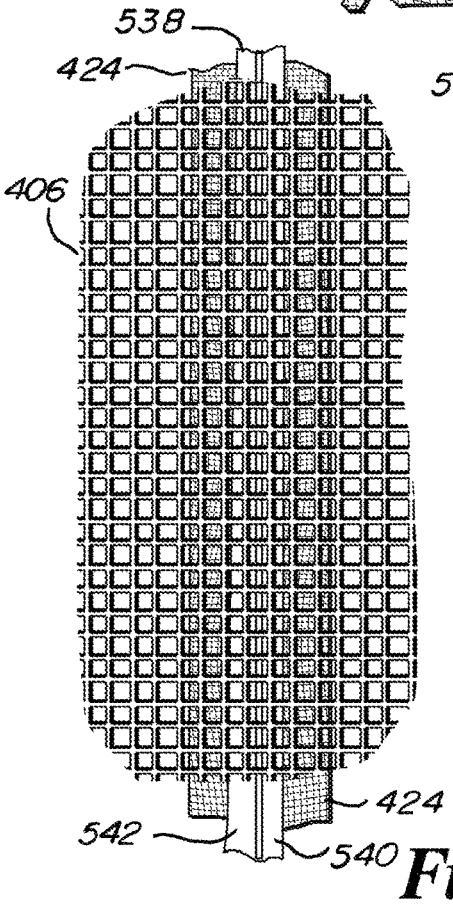
FIG. 21B is an elevation view from inside of the playyard of FIG. 20 and shows a main first strap portion of the flexible pen and further shows trim for a vertical edge of a sidewall section.
Figure 21C:
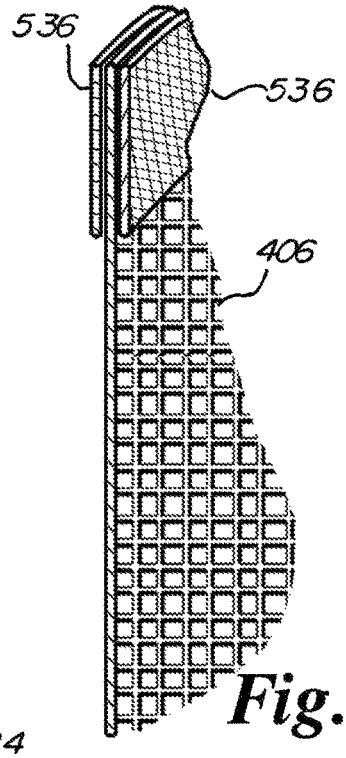
FIG. 21C is a perspective, partially sectional view of the upper rim and sidewall of the playyard of FIG. 20, showing the upper edge of the mesh sidewall pinched between the double layers of the upper rim.

As shown in FIG. 21C, in the case of the upper edge of section 534, such upper edge is pinched between two layers of strap material. The two layers of strap material form the upper rim 536. Upper rim 536 extends endlessly about the upper periphery of the flexible sidewall 406.

As shown in FIG. 21B, in the case of each of the vertical edges of section 534, one or more of the adjacent vertical edges of adjacent sections 534 is pinched between a folded over fabric strip 538 having a first side 540 and a second side 542. If desired, a pair of strips 538 may be used for the vertical edges of section 534 where each of the strips 538 captures or pinches one vertical edge 534 and where the strips 538 are then stitched together. Further, first strap portion 424 is engaged over the strip 538 where a single strip 538 is employed or over a pair of strips 538 where a pair of strips 538 is employed. First strap portion 424 is engaged to each of the mesh of sections 534 and to the strip 538 or strips 538. First strap portion 424 is wider and thicker and stronger than strip 538 or two strips 538. First strap portion 424 runs from upper rim 536 to lower rim 544 and is preferably engaged to and in each of the upper rim 536 and lower rim 544.

In joining two sidewall sections 534 of mesh, strip 538 pinches the rough edge of a mesh cut. Then the strip 538 is folded into the mesh, which fold is stitched closed. Such folded edge is then stitched or otherwise engaged to the folded edge of an adjacent sidewall sections. Thus, in FIG. 21B, which is a view looking from inside of the playyard 400 toward the inner face of the flexible pen 404, mesh covers the strip 538, which covers the first strap portion 424.

Figure 21D:
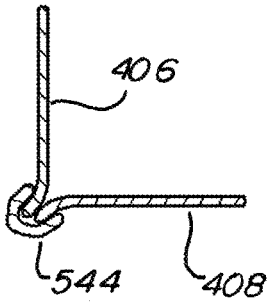
FIG. 21D is a section view of a connection between the sidewall and floor of the flexible pen of the playyard of FIG. 20.
Figure 22A:
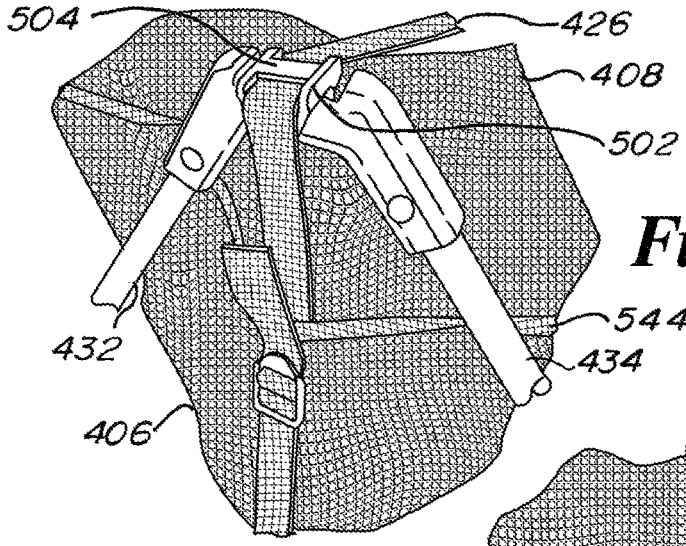
FIG. 22A is a perspective partial view of the lower junction of the playyard of FIG. 20, showing an engagement between the second strap portion of the flexible pen and the pivoting foot of the frame of the playyard of FIG. 20, where the playyard is an upside down position.
Figure 22B:
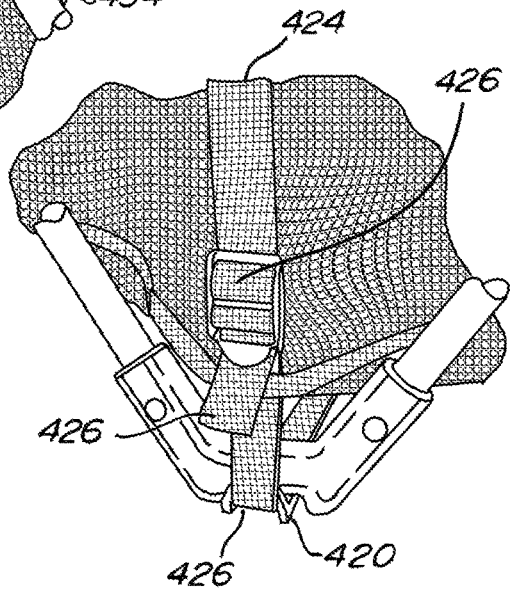
FIG. 22B is a perspective partial view similar to the view of FIG. 22A with the lower junction of the playyard of FIG. 20 in the right side up position.
Figure 22C:
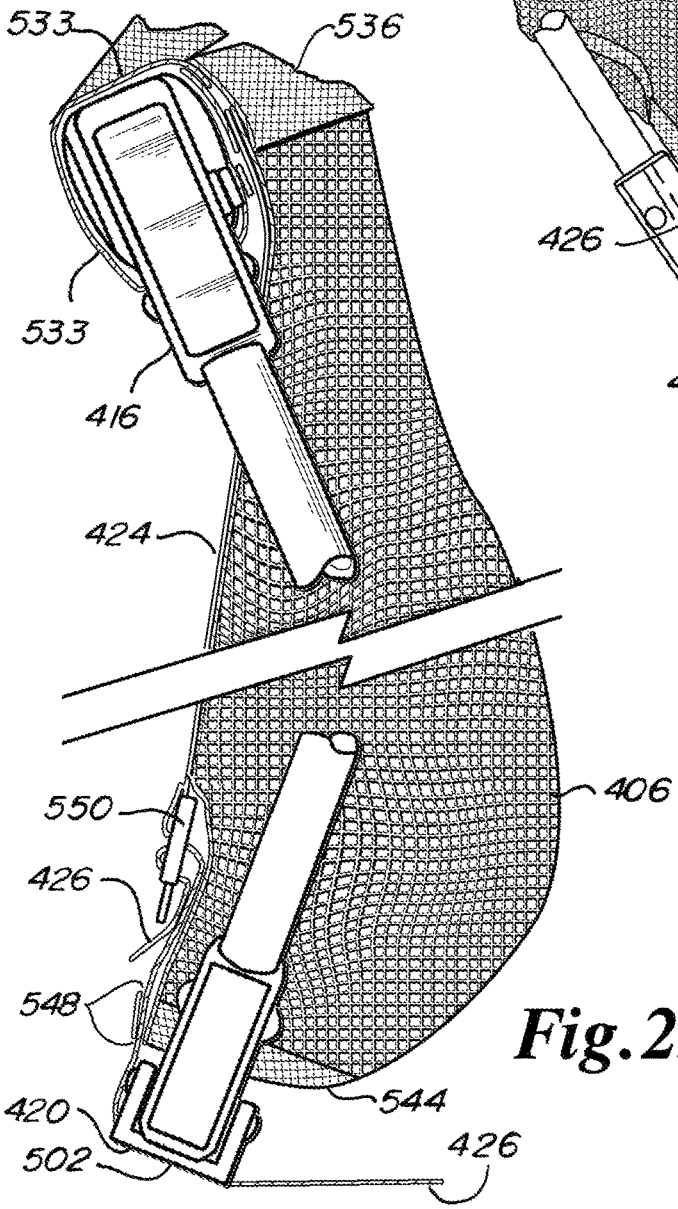
FIG. 22C is a side, partially sectional, partially cut away view of a lockable upper junction and a lower junction of the playyard of FIG. 20.
Figure 23:
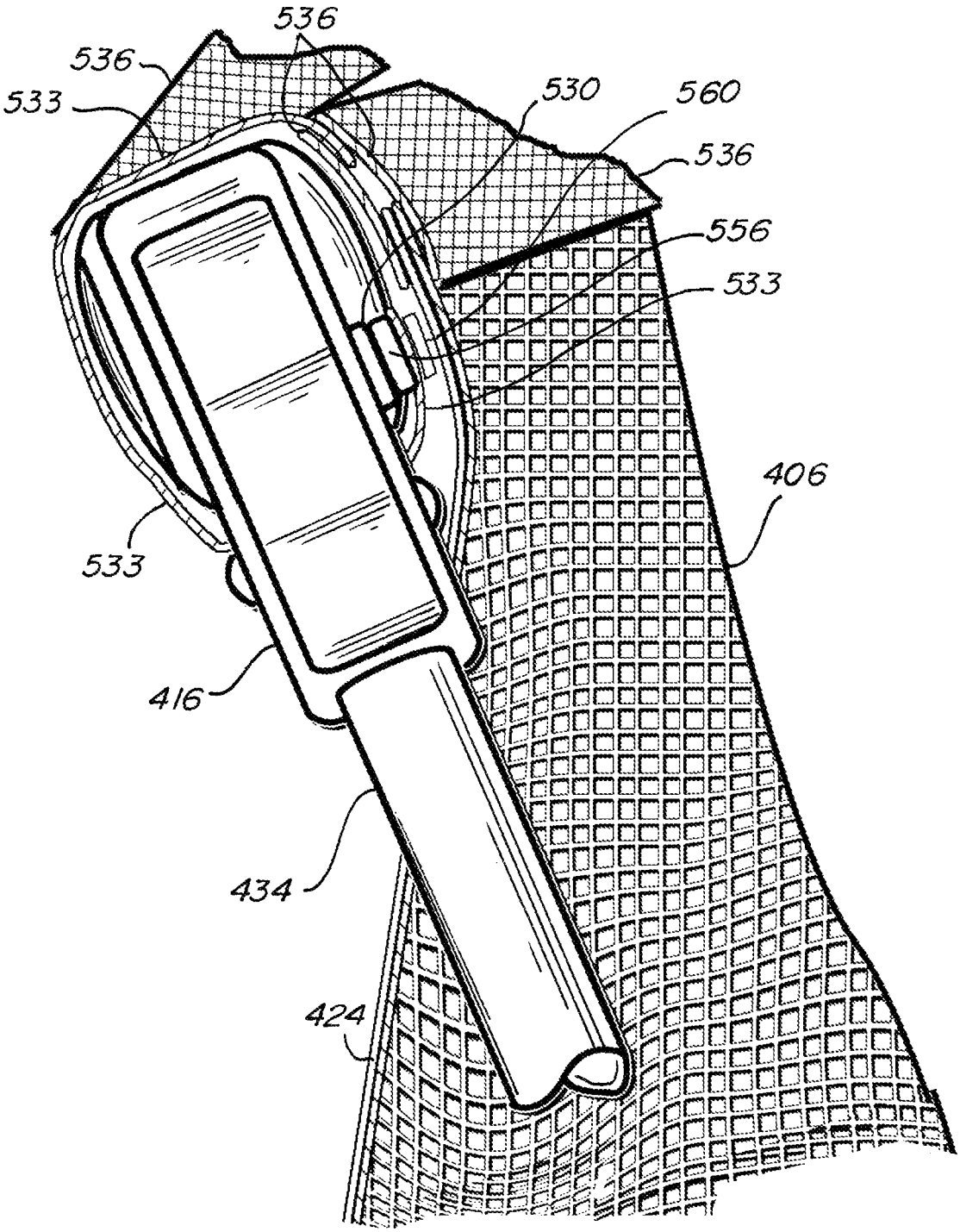
FIG. 23 is a detail, side, sectional view of the lockable upper junction of FIG. 22C.

As shown in FIG. 21D, in the case of the bottom edge of section 534, lower rim 544 is the trim or reinforcement. Lower rim 544 is a folded over strip of flexible fabric material. Lower rim 544 pinches the bottom edge of section 534 along with a straight side edge of flexible floor 408. Lower rim 544 engages the flexible sidewall 406 to the flexible floor 408. Second strap portion 426 also engages the flexible sidewall 406 to the flexible floor 408.

Flexible floor 408 may be a one-piece sheet of mesh or a two-piece sheet of mesh or a multi-piece sheet of mesh, where the two-pieces or multi-pieces are stitched together. Flexible floor 408 may be a non-mesh material such as a solid or porous plastic or nylon flexible material or solid or porous fabric flexible material. Flexible floor 408 preferably is in the shape of a hexagon having six straight edges. Each of the six straight edges is engaged to one of the six sections 534 to form the receptacle shaped flexible pen 404 having an open top, where the open top opposes the flexible floor 408.

Span 532 is shown in FIGS. 19, 20, and 21A. Span 532 is a piece of flexible fabric or flexible sheeting or flexible plastic that spans the distal ends 546 of the second strap portion 426. Sidewall 406 and floor 408 may be flexible fabric or flexible sheeting or flexible plastic as well.

Span 532 may be formed in the shape of a hexagon. Span 532 is engaged to the underside of the flexible floor 408. The distal ends 546 include more than the absolute ends of second strap portion 426. Second strap portion 426 begins to engage the span 532 at the outer edges of the span 532 and then continuously engages the span 532 radially for the remaining length of the second strap portion 426.

Figure 24:
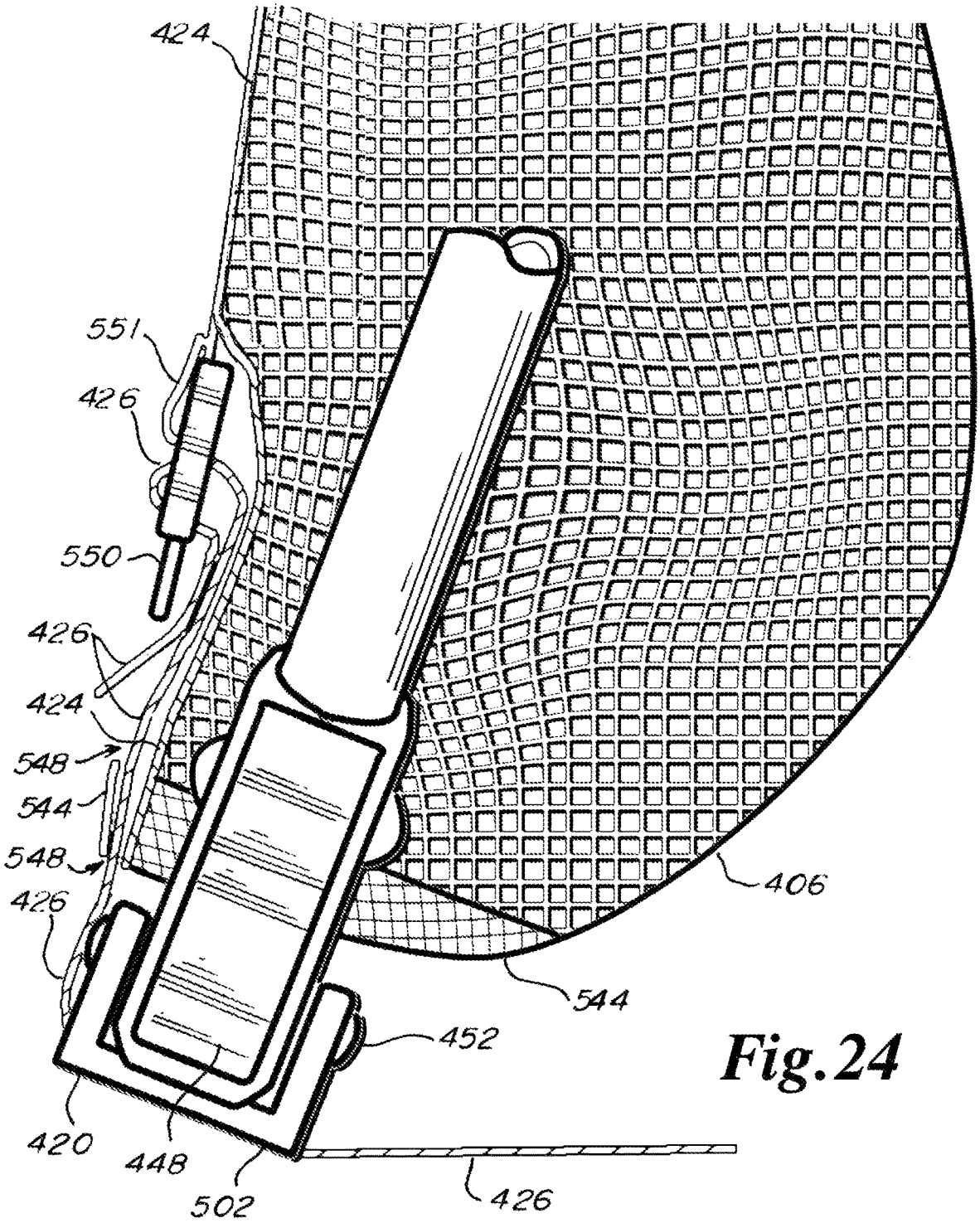
FIG. 24 is a detail, side, sectional view of the lower junction of FIG. 22C.
Figure 25A:
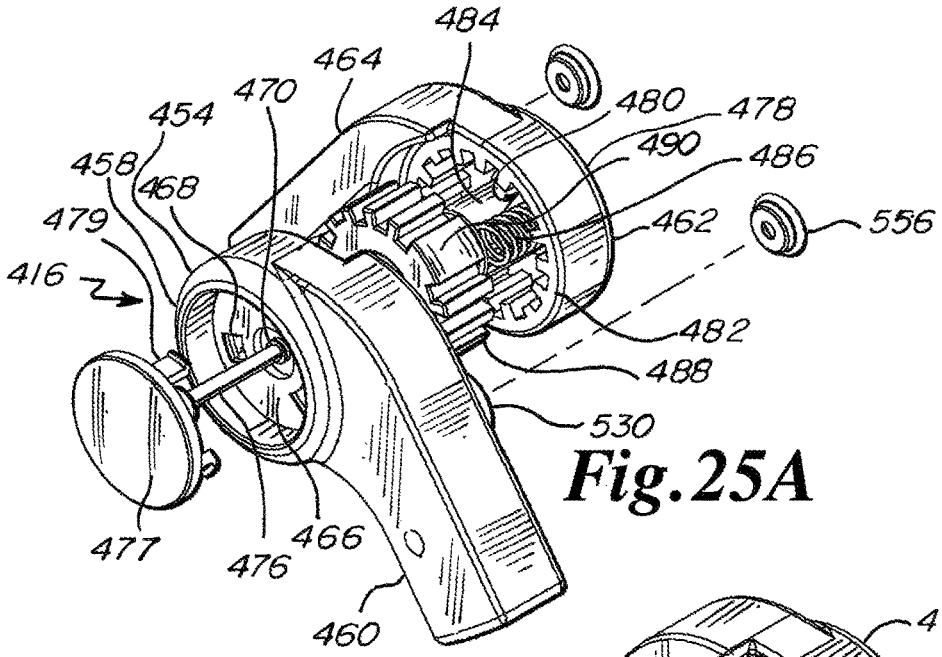
FIG. 25A is a perspective, broken apart view of the lock of the lockable upper junction of the playyard of FIG. 20.
Figure 25B:
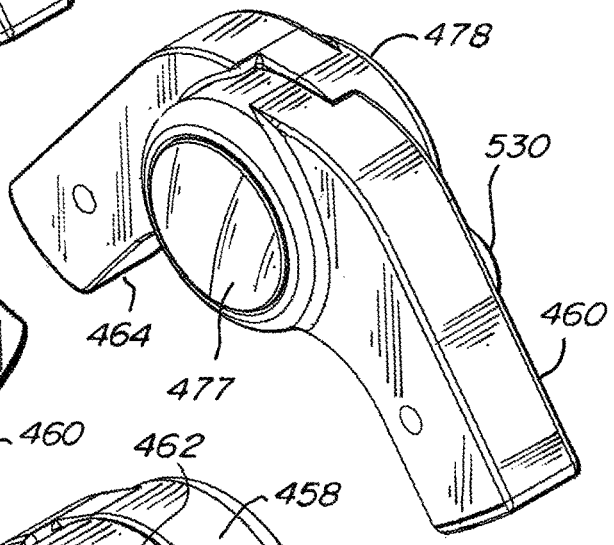
FIG. 25B is a front perspective view of the assembled lock of FIG. 25A in a locked position.
Figure 25C:
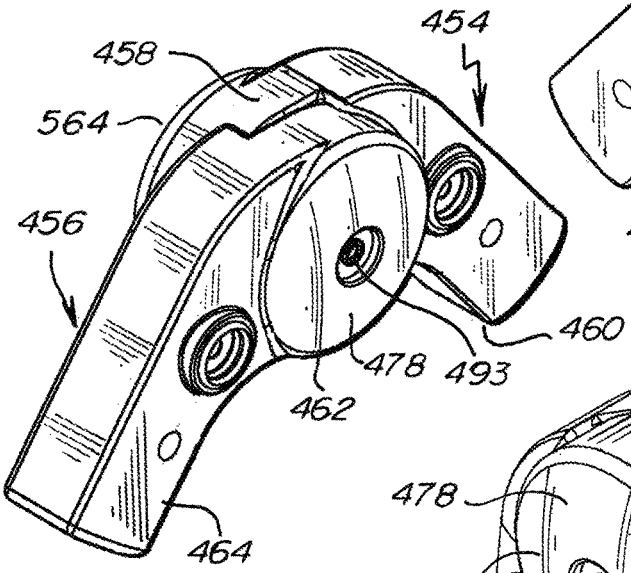
FIG. 25C is a rear perspective view of the assembled lock of FIG. 25A in a locked position.
Figure 25D:
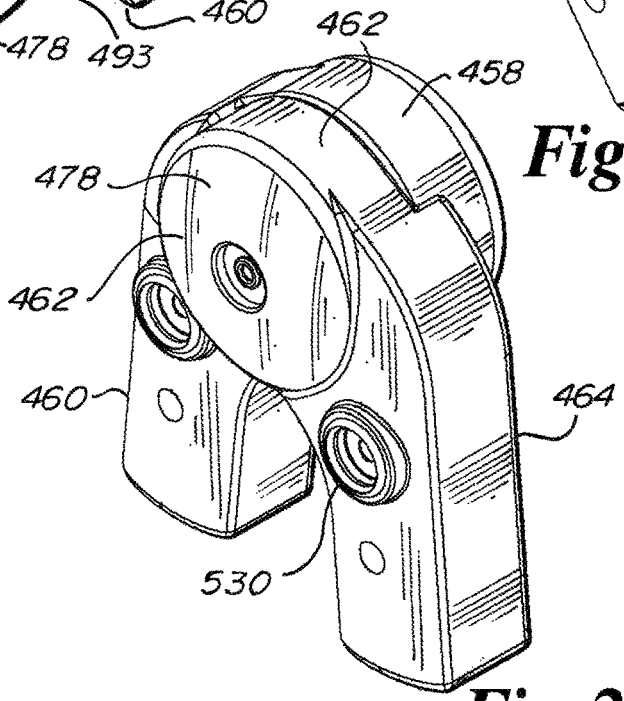
FIG. 25D is a rear perspective view of the assembled lock of FIG. 25A in an open and unlocked position where the playyard of FIG. 20 is in a folded, closed, and compact position.

Each of the second strap portions 426 radially meet an opposing second strap portion 426 and such opposing second strap portions 426 are engaged to each other such that strap 422 effectively extends from one upper junction 410, then extends downwardly on one side of the sidewall 406, through slot 548, then ties into lower junction 414, then extends across flexible floor 408, then ties into another lower junction 414, through slot 548, and then extends up an opposing side of the sidewall 406 to an opposing upper junction 410. Second strap portion 426 of strap 422 is free and unengaged to floor 408 except at the span 532 and except at bottom rim 544 where slot 548 is formed and permits second strap portion 426 to pass through. Second strap portion 426 extends through slot 548 at a location above the location where the second strap portion 426 engages pivoting foot 420. Slot 548 runs the height of the lower or bottom rim 544, which is a double layer endless piece of sheeting or fabric or plastic. Slot 548 has a top opening and a bottom opening, as shown in FIG. 24. First strap portion 424 can form a rear wall of the slot 548.

Second strap portion 426 is removably engaged to first strap portion 424 at buckle 550. Buckle 550 is engaged to first strap portion 424 at a location above lower rim 544. Buckle 550 is a quick connect buckle. The length of second strap portion 426 is adjustable at buckle 550 such that the tension of flexible floor 408 may be adjusted by the tension at which the distal ends 546 pull collectively on the span 532. Buckle 550 is affixed to first strap portion 424 by an auxiliary looped short strap portion 551.

It can be appreciated that first strap portion 424 runs the height of the flexible sidewall 406 from bottom rim 544 to upper rim 536. It can be appreciated that second strap portion 426 ties into the first strap portion 424 between the upper and lower ends of the first strap portion 424 and at a location that is adjacent to and spaced apart from the lower or bottom rim 544. After tying into the first strap portion 424 at the buckle 550, second strap portion 426 depends from the buckle 550, then engages slot 548, then runs unengaged to and free from the underside of the flexible floor 408 until the second strap portion 426 engages the span 532 to which the distal end 546 of the second strap portion 426 is continuously engaged. The distal end 546 of such second strap portion 426 then engages the distal end 546 of a radially aligned second strap portion 426 and further engages the distal ends 546 of all of the other second strap portions 426.

Flexible pen 404 includes flexible extensions 533 at each of the upper junctions 410. Flexible extensions 533 are shown in FIGS. 19, 20, 22C, and 23.

Extension 533 is a flexible fabric or flexible plastic or flexible sheeting that includes two opposing side tapering straight edges 552 and a straight end edge 554. A base edge or base portion of the extension 533 is pinched between and engaged between the double strap layers of the upper rim 536.

If the flexible extension 533 is held upright, engaging ends 556 of snap portion 558 are oriented on the outside of the flexible extension 533 and thumb pushable heads 560 of the snap portions 558 are oriented on the inside of the flexible extension 533. Heads 560 are flat or slightly dome shaped and provide a base for a finger to push engaging end 556 of snap portion 558 into snap portion 530 fixed on the female receptor 448 of one type of upper junction 410 or on one of the half sections 454, 456 of the first locks 416 of the other type of upper junction 410.

Flexible extension 533 is wrapped almost 360 degrees about a portion of frame 402 for strength. Locating snaps 530 on an inside portion of frame 402 provides strength for the flexible pen 404. An almost 360 degree wrap of flexible extension 533 further hides upper junction 410 and minimizes a pinching of fingers in hinge portions of the upper junction 410.

As indicated above, there are two types of upper junctions 410. One type of upper junction 410 includes two female receptors 448 engaged to each other by the intermeshing hinge plates 494. The other type of upper junction 410 includes first lock 416 that is formed by outer and inner half sections 454, 456. Both of these types of upper junctions 410 provide a base around which the flexible extension 533 is wrapped. With the female receptors 448, the base 562 includes the intermeshing hinge plates 494. With the half sections 454, 456, the base 564 includes the inner and outer cylinders 458, 460. Each base extends obliquely relative to each of the support members 432, 434. Each base extends horizontally and is adjacent to upper rim 536. Flexible extension 533 extends over the upper face of this base, around to the outer face of this base, further to the underside of this base, still further to the inside face of this base, whereupon the engaging ends 556 of snap portions 558 snap into snap portions 530. This engagement is preferably undertaken after the frame 402 has been folded out somewhat, but prior to a point where the first locks 416 automatically snap into place.

It should be noted that this step of engaging and disengaging the flexible extensions 533 is not a daily task. Flexible pen 404 and frame 402 are folded up and folded out while engaged to each other. Flexible extension 533 is normally engaged. Buckle 550 is normally at one point of adjustment.

It should be noted that intermediate junction 412 is free of and not engaged to sidewall 406. There is no connection, such as a loop or tie, from the intermediate junction 412 radially or inwardly into the sidewall 406.

Floor 408 defines a closed bottom to the playyard 400. Floor 408 is opposite of an open top of the playyard 400. Floor 408 is hexagonal. Floor 408 includes a hexagonal periphery. Floor 408 is flexible. Floor 408 may be formed of a fabric or fabric like material or sheeting material. Floor 408 may be formed of a non-see-through material. Floor 408 may be formed of a water-tight or a water-proof material. Floor 408 may be formed of a material having pores or spaces that keep out water or moisture in a liquid form but that permit water or moisture in a gas form to pass therethrough. Floor 408 may be formed of a material having pores or spaces that permit water or moisture in a liquid or gas form to pass therethrough. Floor 408 may be formed of a material having pores or spaces that do not permit the passage of either water or moisture in a liquid or gas form.

Second strap portion 426 pulls the floor 408 taut or relatively tight when the playyard 400 is folded out from the compact or closed form to the open form by engaging an interior portion of the floor 408 through distal end portions 546 and by engaging a peripheral portion of the floor 408 through peripheral slot 548.

Second strap portion 426 further pulls flexible sidewall 406 taut or relatively tight by engaging first strap portion 424 that runs the height of sidewall 406 and that ties into extension 533. Sidewall 406 is also pulled taut or relatively tight by the extension 533 engaging the upper junctions 410.

Access door 428 is shown in FIG. 19. Access door 428 permits access to and from the interior of the flexible pen 404. Access door 428 is positioned intermediate two adjacent vertical first strap portions 424 such that access door 428 is positioned generally immediately below intermediate junction 412. Access door 428 is a flexible flap 566 that is engaged with a zipper 568 to the mesh sidewall 406. Flexible flap 566 is formed of mesh. Flexible flap 566 can be formed of the same material of sidewall section 534 or formed of a different material from sidewall section 534. Flap 566 can be formed of a non-see-through material or a see-through material such as mesh. Zipper 568 is a quick connect mechanism. Zipper 568 includes a flexible two strip base formed of flexible sheeting such as flexible plastic or flexible fabric. One strip of the flexible base is engaged to the mesh sidewall section 534 and the other strip is engaged to flap 566. Teeth are engaged in each of the strips and interlock when the zipper 568 is closed. The teeth are drawn apart when the zipper 568 is opened. Zipper 568 forms an inverted U-shaped. First and second vertically extending portions of zipper 568 are straight. A horizontally extending top portion of the zipper 568 is straight. Transitions between the vertically and horizontally extending portions of the zipper 568 are rounded or curved or have a radius. A horizontally extending bottom portion of flap 566 opposes the horizontally extending top portion of the zipper 568. This horizontally extending bottom portion of flap 566 is pinched and engaged in the fold of bottom rim 544, like FIG. 21D shows sidewall section 406 pinched therein in such a fold. Zipper 568 includes two zipper ends such that, when the zipper 568 is fully opened or fully closed, the zipper finger handle or tooth separator is disposed adjacent to the bottom rim 544. Each of the ends of the zipper 568 is disposed adjacent to the bottom rim 544. Some portion of zipper 568, or some interlocking tooth portion, is always engaged such that there is no need to feed a starting point of the zipper 568 into a receptor such that the zipper 568 may always be operated with one hand, whether the access door 428 is being opened or closed. Zipper 568 may be partially opened or partially closed anywhere along the U-shaped run of the zipper 568 and self-supporting at such partially open or partially closed position. The size, or height and width, of the access door 428 is sufficiently great to permit an adult cat or small dog into and out of the flexible pen 404 and sufficiently small to minimize the chance that a toddler can exit the flexible pen 404. The flap 566 has a horizontal axis defined by the horizontal lower rim 544. However, the access door 428 may have a vertical axis or a top horizontal axis. The access door 428 may swing outwardly, as shown in FIG. 19, or may swing inwardly regardless of the position of the swing axis.

In operation, to assemble the playyard 400, the frame 402 is folded out, preferably to a position just short of being fully folded out. Then the flexible sidewall 406 is fixed to the upper junctions 410 with the extensions 533. Then the proximal end of the second strap portion 426 is engaged in channel 506 of pivoting foot 420. Then the proximal end of the second strap portion 426 is fed through the slot 548. Then the proximal end of the second strap portion 426 is engaged to buckle 550. Then the frame 402 is folded out until the first locks 416 automatically and snappingly lock. Then the second lock 418 is locked by a user stepping down on the second lock 418. Then the second strap portion 426 is adjusted to the desired tightness by employing the buckle 550 to adjust the flexible floor 408 and sidewall 406 to the desired tightness. When the frame 402 is fully opened and the first and second locks 416, 418 are locked, sidewall sections 534 are substantially planar and flat with no folds and the floor 408 is substantially planar and flat with no folds. Second lock or tension bar 418 tightens the sidewall 406 and floor 408 to a greater degree than just locking first locks 416.

To collapse the playyard 400 from the open position to the closed or compact position, the second lock 418 is unlocked by pulling the center of the lock 418 up through the over center position. Then the two first or button locks 416 are unlocked by pushing in on the buttons 477, which are hidden behind their respective extensions 533 such that the flexible extension 533 is pushed upon to thereby push in its respective button 477.

This unlocking of the two first locks 416 permits permitting their respective upper junctions 410 to pivot, which permits the remaining four lock free upper junctions 410 to pivot, which yet further permits all six of the lock free lower junctions 414 to pivot and all lock free intermediate junctions 412 to pivot. Then the frame 402 is folded further, with flexible pen 404 still engaged therein, to place the upper junctions 410 adjacent to each other and to place the lower junctions 414 adjacent to each other. During this step of folding the playyard 400 from the open form to the closed or compact form, second strap 426 remains engaged to buckle 550. During this step of folding in, second strap portion 426 slides in slot 548.

To open the playyard 400 from the closed or compact form to the open form, the support members 432, 434 may grasped and pulled apart so as to snappingly and automatically lock the first locks 416. Then the second lock 418 is locked by pressing the lock 418 to the over center position. During this step of folding the playyard 400 from the closed or compact form to the open form, second strap portion 426 remains fixed in place. During this step, second strap portion 426 slides in slot 548. In the open position, the length of second strap portion 426 may be adjusted if desired, but this step is most often not necessary to attain the form where the sidewall sections 534 and flexible floor 408 are substantially flat and planar.

The over center mechanism or second lock or split tension locking bar 418 shown in FIGS. 18, 20, 27C, 27D, 27E, 28A, 28B includes a first embodiment of an absolute end of elongate members 514, 516. A second embodiment of the absolute end of elongate members 514, 516 of the second lock or over center mechanism or split tension locking bar 418 is shown in FIGS. 29, 30A, 30B, 30C and 30D. This absolute end is indicated by reference number 582.

Figures 30A, 30B, 30C, 30D:
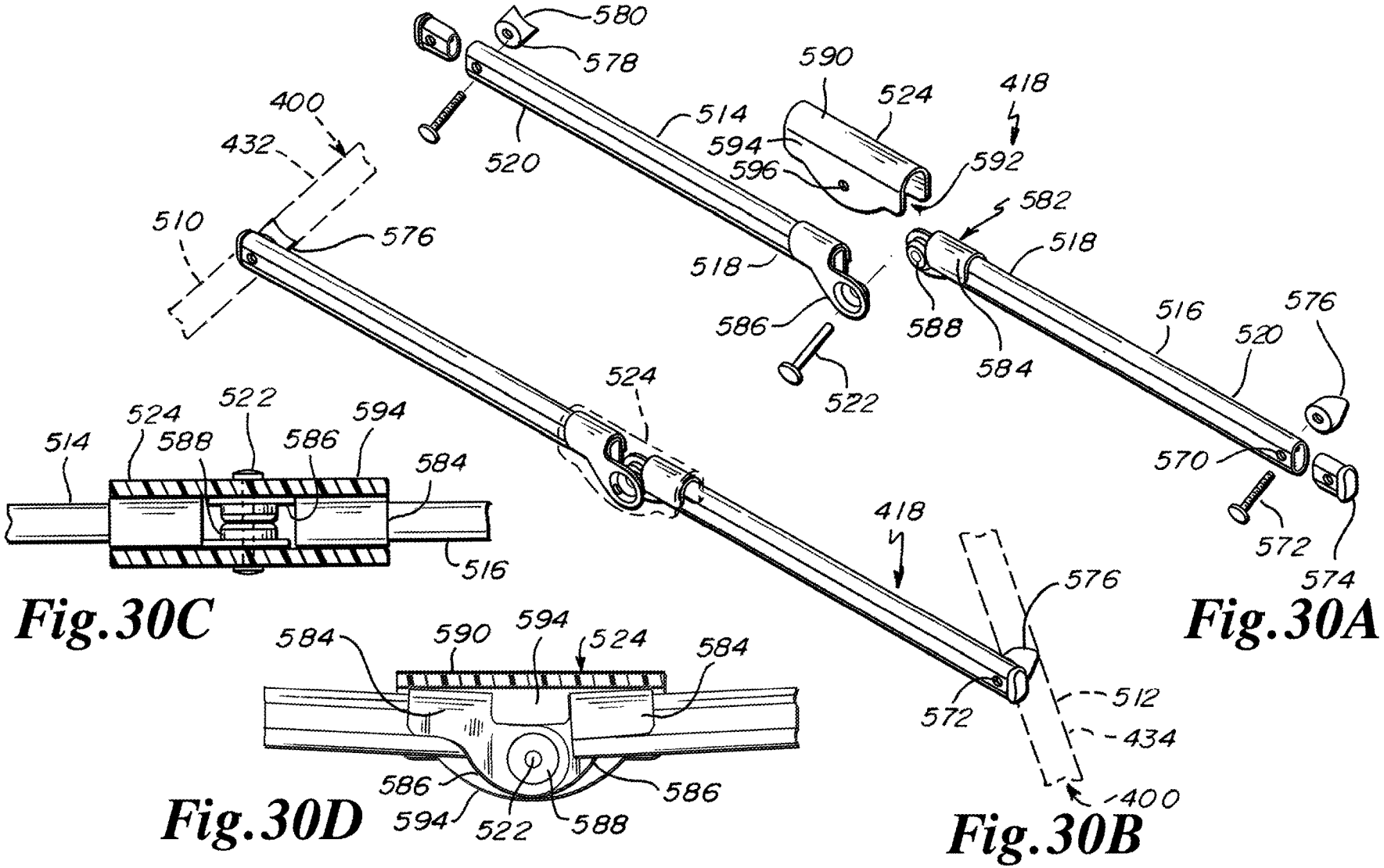
FIG. 30A is a broken apart, perspective, detail view of the over center mechanism or second lock of FIGS. 27C, 27D, and 27E having a second embodiment for the inner absolute end of each of the elongate members.
FIG. 30B is a phantom, perspective, detail view of the over center mechanism or second lock of FIG. 30A, and further shows two support members of the frame in phantom.
FIG. 30C is a section, detail, top view of a central portion of the over center mechanism or second lock of FIGS. 30A and 30B.
FIG. 30D is a section, detail, side view of a central portion of the over center mechanism or second lock of FIGS. 30A, 30B and 30C.

FIG. 30A shows elongate tubular members 514 and 516. FIG. 30A further shows the distal ends 520 of each of the elongate members 514, 516. Each of the distal ends 520 includes a through opening 570, a pin 572, an end cap 574, and a base 576. Through opening 570 receives pin 572. Pin 572 may be a rivet having a pair of heads. The axis of each of the pins 572 is parallel to the axis of pin 522. End cap 574 is inserted into the open end of distal end 520, up to its cap portion, and includes a through opening for receiving pin 572. Base 576 includes a flat face or end 578 for confronting a side of distal end 520. Base 576 further includes an opposing curved face or end 580 for confronting the circular face of the respective support member 432 or support member 434. Flat face or end 578 is flat to permit the elongate members 514, 516 to pivot relative to the respective support member 432 or support member 434. Base 576 includes a through opening for pin 572. Base 576 is pinched between distal end 520 and its respective support member 432, 434. Each of the support members 432, 434 includes a through hole for receiving pin 572. Distal end 572 is a pivoting end, with the pin 572 defining the pivot axis.

Each of the elongate members 514, 516 includes a proximal end 518. Each of the proximal ends 518 includes a one-piece and integral absolute end 582. Each of the absolute ends 582 includes an outer saddle or U-shaped portion 584 and an inner, offset, displaced cup shaped plate 586. The saddle 584 is welded or otherwise rigidly fixed to its respective elongate member 514, 516. The inner edge of saddle 584 is flush with the end of the tube of elongate member 514, 516. One side of saddle 584 leads into cup shaped plate 586. Cup shaped plate 586 extends from one side of saddle 584. Plate 586 includes a cup or receptacle shaped portion 588 axially aligned with pin 522. Center portions of the receptacle shaped portions 588 confront each other and make contact with each other in the assembled form of the over center mechanism 418. Cup shaped plate 586 includes a through opening for reception of pin 522. Cup shaped portion 588 has an open face that opens outwardly.

Channel piece or pedal 524 includes a U-shaped back plate portion 590, an open face 592, and a pair of side plate portions 594. Each of the side plate portions 594 includes a through hole 596. In the assembled condition, pedal 524 covers the absolute ends 582 and pin or rivet 522 extends from one side plate portion 594, through abutting cup shaped portions 588, and then through the other side plate portion 594. Pin 522 provides for a pivoting relationship between the distal ends 518 of the elongate members 514, 516 and between pedal 524 and elongate members 514, 516.

Each of the elongate members 514, 516 includes a longitudinal axis that extends from the proximal end 518 to the distal end 520. The axis of the cup shaped portions 588 is offset or displaced from the longitudinal axis of the elongate members 514, 516. The axis of the cup shaped portions 588 is perpendicular to the axis of the longitudinal axis of the elongate members 514, 516. When a user presses on pedal 524 so as to bring the elongate members 514, 516 from the unlocked position shown in FIG. 27D to the locked position shown in FIG. 27E, the cup shaped plates 586 twist so as to draw the pin 522 out of a perpendicular relationship with the longitudinal axes of elongate members 514, 516 to an oblique relationship with the longitudinal axes of elongate members 514, 516. This twisting of cup shaped plates 586 and pin 522 places both frame 402 under pressure and the second lock 418 under pressure at the same time and permits the elongate members 514, 516 to move from the inverted V relationship of the unlocked position of FIG. 27D, through the straight line relationship designated by reference number 526, and into the upright V relationship of the locked position of FIG. 27E. Pin 522 is placed in an oblique relationship relative to the longitudinal axis of elongate members 514, 516 just prior to when the elongate members 514, 516 move into the straight line relationship indicated by reference number 516 and pin 522 maintains this oblique relationship, albeit less oblique, when the second lock 418 is in the locked position as shown in 27E. In other words, second lock 418 places a first pressure upon the frame 402 and the frame 402 places this same first pressure back upon the second lock 418 when the elongate members 514, 516 are in the straight line relationship indicated by reference number 526. When the second lock 418 is in the upright V relationship shown in FIG. 27E, second lock 418 places a second pressure upon the frame 402 and the frame 402 places this same second pressure back upon the second lock 418, with the second pressure being less than the first pressure, and with the second pressure being greater than a third pressure. This third pressure is found when the frame 402 is in the collapsed position of FIG. 27C or FIGS. 28A, 28B when the elongate members 514, 516 are steeply inverted. Work or pressure is required to move the elongate members 514, 516 from the upright V position of FIG. 27E, to the straight line relationship indicated by reference number 526, and through the straight line relationship indicated by reference number 526 so as to unlock the second lock 418.

With the alternate embodiment of the second lock 418, which alternate embodiment includes absolute end 582 with the cup shaped plates 586, distance A remains the same. In other words, in the straight line relationship indicated by reference number 526, the elongate members 514, 516 define a distance A, where distance A is measured as a straight line between the points where elongate members 514, 516 are pivotally engaged to the support members 432, 434 and where each of the elongate members 514, 516 include the absolute end 582 with the cup shaped plate 586.

With the alternate embodiment of the second lock 418, which alternate embodiment includes the absolute end 582 with the cup shaped plates 586, distance B remains the same. In other words, in the locked position relationship indicated by reference number 528, there is a distance B. Distance B is a straight line distance between the same two points of distance A, except that the lower portions 510, 512 are slightly closer together such that these same two points (pivot locations) define a distance B that is less than distance A, where each of the elongate members 514, 516 include the absolute end 582 with the cup shaped plate 586.

Second lock or tension bar or over center mechanism 418 is shown in FIGS. 18, 20, 27C, 27D, 27E, 28A, 28B and 29. Either of the first and second embodiments of the absolute end of elongate members 514, 516 may be employed in these structures, i.e., the structures of FIGS. 18, 20, 27C, 27D, 27E, 28A, 28B and 29. The first embodiment of the absolute end of elongate members 514, 516 is where the absolute ends of the proximal ends 518 abut each other when the second lock 418 is drawn through over center. The second embodiment of the absolute end of elongate members 514, 516 is indicated by reference number 582 and is shown in FIGS. 30A, 30B, 30C, and 30D.

Figure 29:
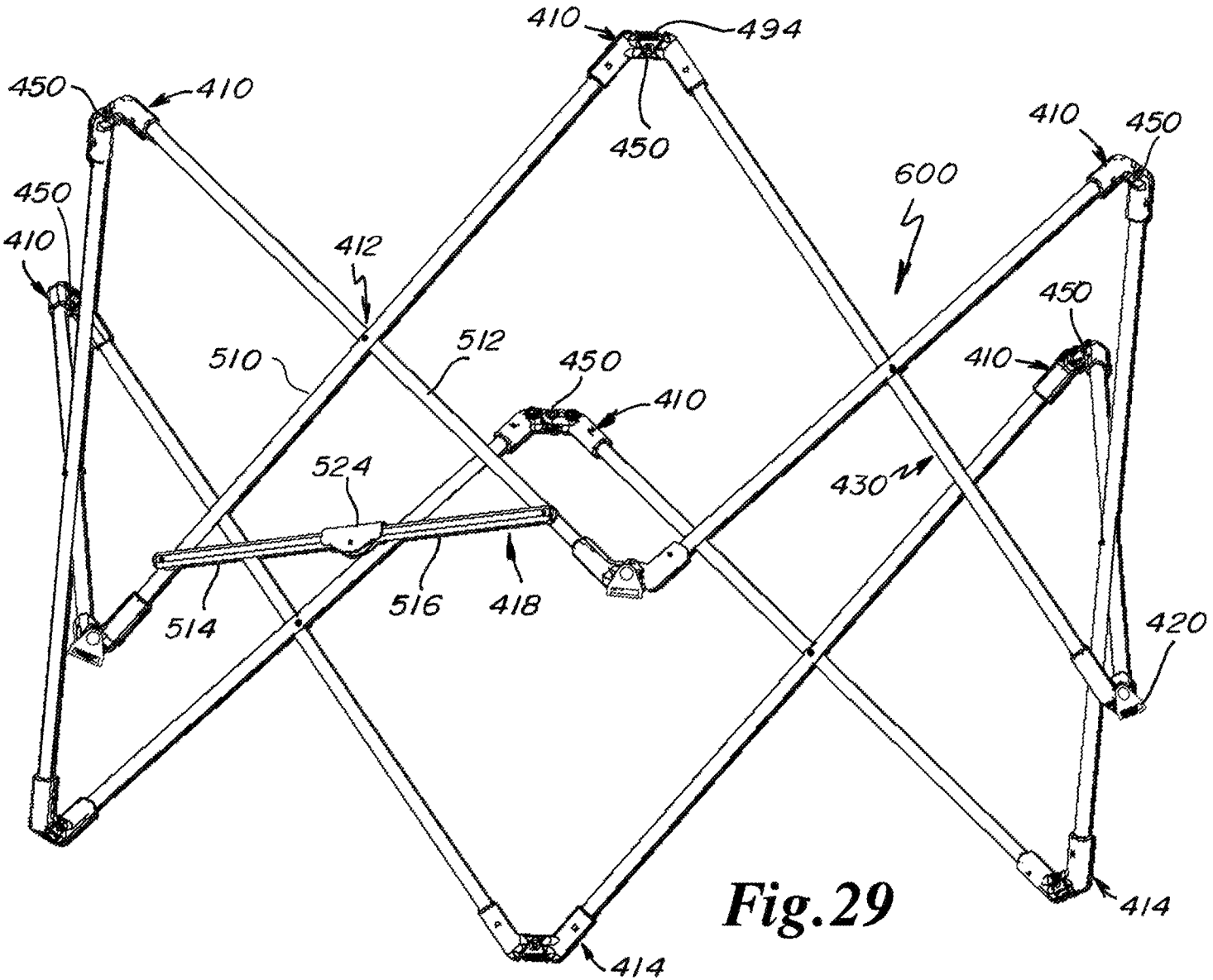
FIG. 29 is a perspective view of a frame of the present invention that may be used with the flexible pen of FIG. 19, where the frame is identical to the frame of FIG. 18 but with the first locks removed from their two upper junctions and replaced with free-swinging upper junctions that are identical to the four free-swinging upper junctions of the frame of FIG. 18.

FIG. 29 is a perspective view of a frame 600 of the present invention that may be used with the flexible pen of FIG. 19, where the frame is identical to the frame of FIG. 18 but with the first locks 416 removed from their two upper junctions 410 and replaced with free-swinging upper junctions 410 that are identical to the four free-swinging upper junctions 410 of the frame of FIG. 18. In other words, each of the six free-swinging upper junctions 410 includes the hinge structures of FIGS. 27A, 27B. This hinge structure includes no locks of any kind and is free swinging. This hinge structure includes the pin 450 and the hinge intermeshing plates or teeth 494.

Figure 28A:
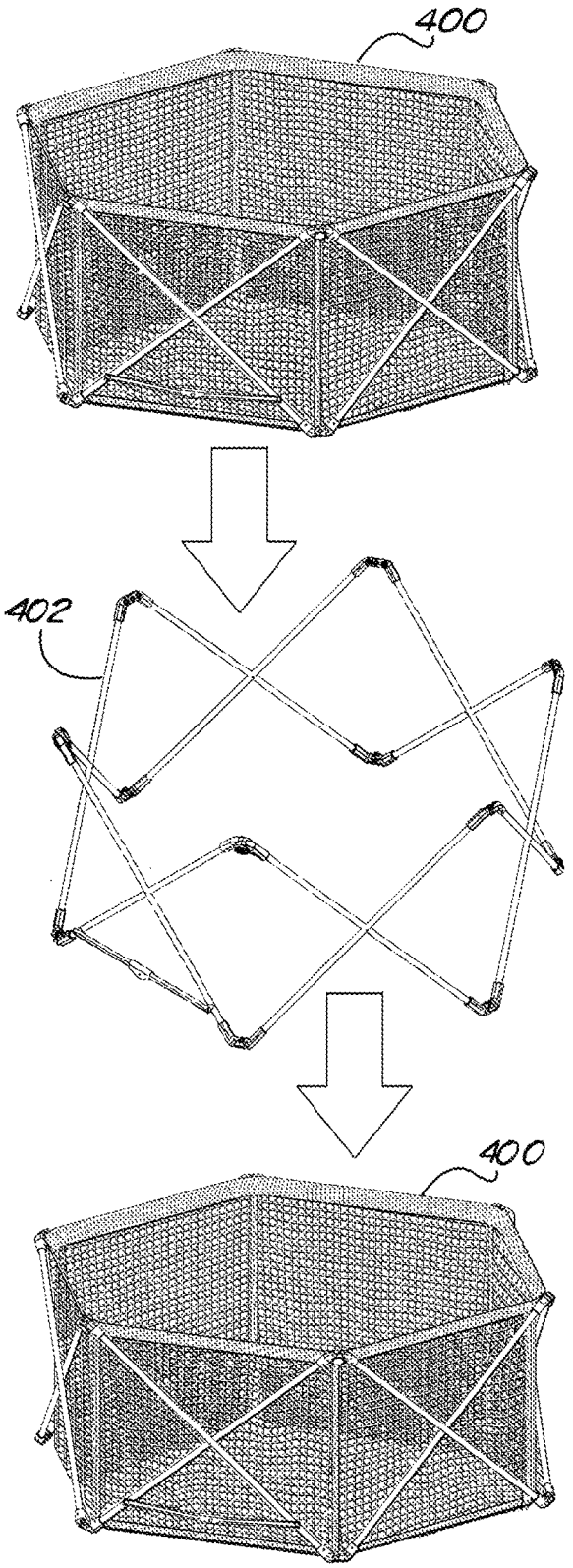
FIG. 28A shows a sequence of steps relating to the playyard of FIG. 20, illustrating that the flexible pen can be removed from the frame of the playyard and, at the same time, the frame can remain fully locked and self-supporting.
Figure 28B:
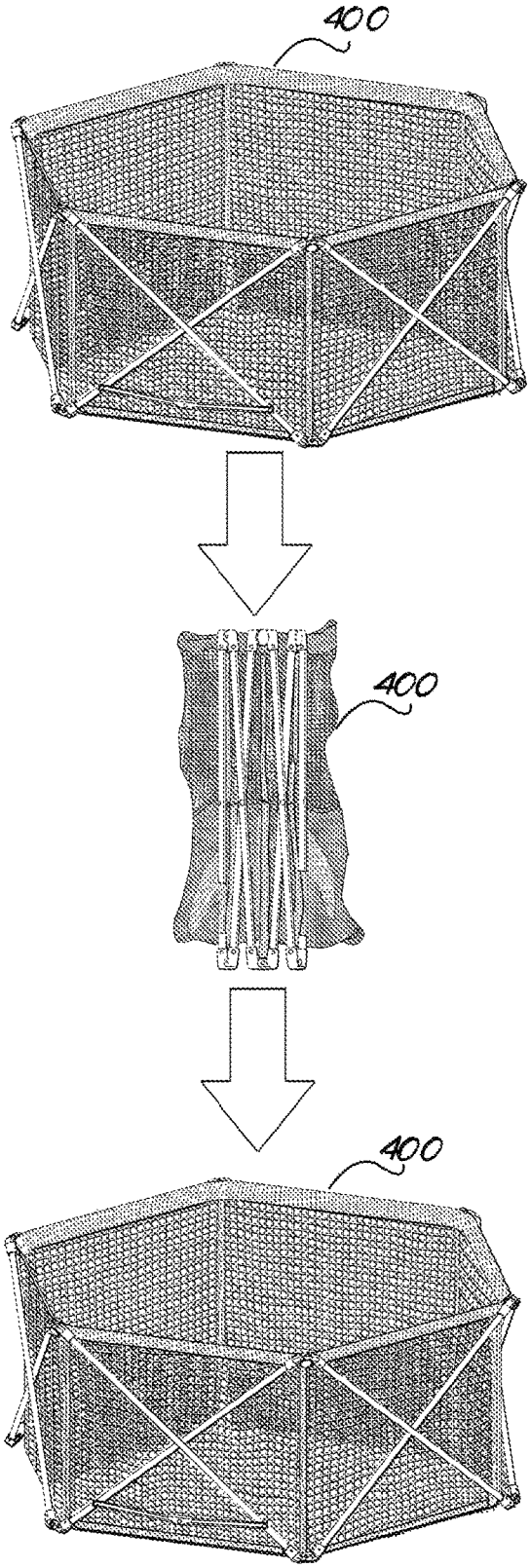
FIG. 28B shows a sequence of steps relating to the playyard of FIG. 20, illustrating that the frame and flexible pen can, at the same time and joined at the same time, be folded from an open position to a closed position and back to an open position without removing the flexible pen from the frame and without adjusting or disengaging either the second strap portions that engage the lower junctions or the extensions that engage the upper junction.

In folding out the frame 600 from a compact and closed configuration, such as shown in FIGS. 5, 28A and 28B, the frame 600 may be almost completely folded out such that the support members 432, 434 will be drawn out to the position shown in 27D, where the inverted V relationship between elongate members 514, 516 has an angle approaching 180 degrees. At this point it should be noted that flexible pen 404 is fully attached to frame 600 and was also fully attached in the compact and closed configuration. Then the user steps down on channel piece or pedal 524 to draw the tension bar or over center mechanism 418 through the straight line relationship indicated by reference number 526 and to the locked position shown in FIG. 27E where the elongate members 514, 516 attain an upright V configuration. As the over center mechanism 418 is drawn down, all of the support member pairs 430 are drawn apart. As the over center mechanism 418 reaches its ultimate position, where the elongate members 514, 516 are prevented from further pivoting by the back plate 590 of the pedal 524, each of the support member pairs 430 release slightly and are drawn slightly together. When the over center mechanism 418 is locked, the frame 600 with the flexible pen 404 attached therein may be carried from here to there without collapsing or folding in.

In folding in the frame 600 from an open and operating position, such as shown in FIGS. 1, 6, 18, 20, 28A, 28B and 29, the user first lifts up on the over center mechanism 418 with his or her foot. The user places the upper side of his or her foot at a location under the pin 522, then lifts up with his or her foot to draw the pin 522 upwardly and to draw the over center mechanism 418 upwardly through the straight line relationship indicated by reference number 526. As the over center mechanism 418 is drawn upwardly through the straight line relationship, all of the support member pairs 430 are momentarily drawn apart. Then, as the over center mechanism 418 begins to form the inverted V, the support member pairs 430 relax and are slightly drawn together, whereupon frame 600 is unlocked and may be folded to the closed and compact position.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A flexible playyard pen, comprising:

a) a flexible sidewall, a flexible floor, and an open top;

b) the flexible sidewall being endless, the flexible sidewall having an upper endless edge and a lower endless edge;

c) the flexible sidewall comprising a set of six flexible panels;

d) each of the six flexible panels having an upper edge portion, a lower edge portion, a first side edge portion, and a second side edge portion, the first side edge portion of one flexible panel being adjacent to the second side edge portion of an adjacent flexible panel;

e) each of the six flexible panels having mesh extending from the upper edge portion to the lower edge portion, each of the six flexible panels having mesh extending from the first side edge portion to the second side edge portion;

f) a set of six upright strip portions of flexible material, each of the six upright strip portions of flexible material extending from the upper endless edge of the flexible sidewall to the lower endless edge of the flexible sidewall, each of the six upright strip portions of flexible material engaging the first side edge portion of one flexible panel and the second side edge portion of an adjacent flexible panel, each of the six upright strip portions of flexible material having an upper end portion;

g) the lower endless edge of the sidewall comprising a set of six lower horizontal strip portions of flexible material, each of the six lower horizontal strip portions of flexible material engaging one of the six flexible panels and the floor, each the six flexible panels having one of the six lower horizontal strip portions of flexible material engaging the lower edge portion of said flexible panel from the first side edge portion to the second side edge portion of said flexible panel;

h) the upper endless edge of the sidewall comprising a set of six upper horizontal strip portions of flexible material, each the six flexible panels having one of the six upper horizontal strip portions of flexible material engaging the upper edge portion of said flexible panel from the first side edge portion to the second side edge portion of said flexible panel;

i) a set of six flexible extensions;

j) each of the six flexible extensions extending from the flexible sidewall at a location adjacent to an upper end portion of one of the six upright strip portions of flexible material;

k) each of the six flexible extensions extending from two upper horizontal strip portions of flexible material that are adjacent to each other; and l) each of the six flexible extensions having a first quick connect to engage a second quick connect on a playyard frame.

2. The flexible playyard pen of claim 1 and the playyard frame having a set of six playyard locations, each of the six playyard locations having an upper face and an outer face, wherein each of the six flexible extensions is adjacent to one of the six playyard locations, wherein each of the six flexible extensions extends about one upper face and further extends about one outer face.

3. The flexible playyard pen of claim 1 and the playyard frame having a set of six playyard locations, each of the six playyard locations having an upper face, an outer face, and a lower face, wherein each of the six flexible extensions is adjacent to one of the six playyard locations, wherein each of the six flexible extensions extends about one upper face, further extends about one outer face, and further extends about one lower face.

4. The flexible playyard pen of claim 1 and the playyard frame having a set of six playyard locations, each of the six playyard locations having an upper face, an outer face, a lower face, and an inside face, wherein each of the six flexible extensions is adjacent to one of the six playyard locations, wherein each of the six flexible extensions extends about one upper face, further extends about one outer face, further extends about one lower face, and further extends about one inside face.

5. A flexible playyard pen, comprising:

a) a flexible sidewall, a flexible floor, and an open top;

b) the flexible sidewall being endless, the flexible sidewall having an upper endless edge and a lower endless edge;

c) the flexible sidewall comprising a set of flexible panels;

d) each of the flexible panels having an upper edge portion, a lower edge portion, a first side edge portion, and a second side edge portion, the first side edge portion of one flexible panel being adjacent to the second side edge portion of an adjacent flexible panel;

e) each of the flexible panels having mesh extending from the upper edge portion to the lower edge portion, each of the flexible panels having mesh extending from the first side edge portion to the second side edge portion;

f) a set of upright strip portions of flexible material, each of the upright strip portions of flexible material extending from the upper endless edge of the flexible sidewall to the lower endless edge of the flexible sidewall, each of the upright strip portions of flexible material engaging the first side edge portion of one flexible panel and the second side edge portion of an adjacent flexible panel, each of the upright strip portions of flexible material having an upper end portion;

g) the lower endless edge of the sidewall comprising a set of lower horizontal strip portions of flexible material, each of the lower horizontal strip portions of flexible material engaging one of the flexible panels and the floor, each the flexible panels having one of the lower horizontal strip portions of flexible material engaging the lower edge portion of said flexible panel from the first side edge portion to the second side edge portion of said flexible panel;

h) the upper endless edge of the sidewall comprising a set of upper horizontal strip portions of flexible material, each the flexible panels having one of the upper horizontal strip portions of flexible material engaging the upper edge portion of said flexible panel from the first side edge portion to the second side edge portion of said flexible panel;

i) a set of flexible extensions;

j) each of the flexible extensions extending from the flexible sidewall at a location adjacent to an upper end portion of one of the upright strip portions of flexible material;

k) each of the flexible extensions extending from two upper horizontal strip portions of flexible material that are adjacent to each other; and l) each of the flexible extensions having a first quick connect to engage a second quick connect on a playyard frame.

6. The flexible playyard pen of claim 5 and the playyard frame having a set of playyard locations, each of the playyard locations having an upper face and an outer face, wherein each of the flexible extensions is adjacent to one of the playyard locations, wherein each of the flexible extensions extends about one upper face and further extends about one outer face.

7. The flexible playyard pen of claim 5 and the playyard frame having a set of playyard locations, each of the playyard locations having an upper face, an outer face, and a lower face, wherein each of the flexible extensions is adjacent to one of the playyard locations, wherein each of the flexible extensions extends about one upper face, further extends about one outer face, and further extends about one lower face.

8. The flexible playyard pen of claim 5 and the playyard frame having a set of playyard locations, each of the playyard locations having an upper face, an outer face, a lower face, and an inside face, wherein each of the flexible extensions is adjacent to one of the playyard locations, wherein each of the flexible extensions extends about one upper face, further extends about one outer face, further extends about one lower face, and further extends about one inside face.

9. A flexible playyard pen, comprising:

a) a flexible sidewall, a flexible floor, and an open top;

b) the flexible sidewall being endless, the flexible sidewall having an upper endless edge and a lower endless edge;

c) the flexible sidewall comprising a set of flexible panels;

d) each of the flexible panels having an upper edge portion, a lower edge portion, a first side edge portion, and a second side edge portion, the first side edge portion of one flexible panel being adjacent to the second side edge portion of an adjacent flexible panel;

e) a set of upright strip portions of flexible material, each of the upright strip portions of flexible material extending from the upper endless edge of the flexible sidewall to the lower endless edge of the flexible sidewall, each of the upright strip portions of flexible material engaging the first side edge portion of one flexible panel and the second side edge portion of an adjacent flexible panel, each of the upright strip portions of flexible material having an upper end portion;

f) the lower endless edge of the sidewall comprising a set of lower horizontal strip portions of flexible material, each of the lower horizontal strip portions of flexible material engaging one of the flexible panels and the floor, each the flexible panels having one of the lower horizontal strip portions of flexible material engaging the lower edge portion of said flexible panel from the first side edge portion to the second side edge portion of said flexible panel;

g) the upper endless edge of the sidewall comprising a set of upper horizontal strip portions of flexible material, each the flexible panels having one of the upper horizontal strip portions of flexible material engaging the upper edge portion of said flexible panel from the first side edge portion to the second side edge portion of said flexible panel;

h) a set of flexible extensions;

i) each of the flexible extensions extending from the flexible sidewall at a location adjacent to an upper end portion of one of the upright strip portions of flexible material;

j) each of the flexible extensions extending from two upper horizontal strip portions of flexible material that are adjacent to each other; and k) each of the flexible extensions having a first quick connect to engage a second quick connect on a playyard frame.

10. The flexible playyard pen of claim 9 and the playyard frame having a set of playyard locations, each of the playyard locations having an upper face and an outer face, wherein each of the flexible extensions is adjacent to one of the playyard locations, wherein each of the flexible extensions extends about one upper face and further extends about one outer face.

11. The flexible playyard pen of claim 9 and the playyard frame having a set of playyard locations, each of the playyard locations having an upper face, an outer face, and a lower face, wherein each of the flexible extensions is adjacent to one of the playyard locations, wherein each of the flexible extensions extends about one upper face, further extends about one outer face, and further extends about one lower face.

12. The flexible playyard pen of claim 9 and the playyard frame having a set of playyard locations, each of the playyard locations having an upper face, an outer face, a lower face, and an inside face, wherein each of the flexible extensions is adjacent to one of the playyard locations, wherein each of the flexible extensions extends about one upper face, further extends about one outer face, further extends about one lower face, and further extends about one inside face.

* * * * *